US005797080A

United States Patent [19]

Okamoto

[11] Patent Number: 5,797,080

[45] Date of Patent: Aug. 18, 1998

[54] COPYING MACHINE HAVING A MECHANISM FOR FEEDING RECORDING SHEETS IN SYNCHRONIZATION WITH THE IMAGE READING TIMING

[75] Inventor: Yuji Okamoto, Nara, Japan

[73] Assignee: Sharp Kabushiki Kaisha, Osaka, Japan

[21] Appl. No.: 826,233

[22] Filed: Mar. 27, 1997

[30] Foreign Application Priority Data

Mar. 27, 1996 [JP] Japan ..... 8-071709

[51] Int. Cl.[6] ..... G03G 15/00; B65H 7/04

[52] U.S. Cl. ..... 399/391; 271/265.01; 399/374; 399/388

[58] Field of Search ..... 399/388, 391, 399/394, 374, 373, 364, 45, 43; 271/3.16, 3.17, 9.02, 265.01, 265.04, 902; 395/111; 346/134

[56] References Cited

U.S. PATENT DOCUMENTS

| | | | |
|---|---|---|---|
| 4,914,485 | 4/1990 | Emori | 399/394 |
| 4,918,489 | 4/1990 | Inage et al. | 399/391 |
| 4,980,729 | 12/1990 | Okamoto | 399/374 |
| 5,056,771 | 10/1991 | Beck et al. | 271/114 |
| 5,155,540 | 10/1992 | Yamada et al. | 399/364 X |
| 5,257,064 | 10/1993 | Okamoto | 399/374 X |
| 5,323,220 | 6/1994 | Yasuda | 399/391 |
| 5,528,353 | 6/1996 | Ushio et al. | 399/364 |

FOREIGN PATENT DOCUMENTS

| | | |
|---|---|---|
| 2-131958 | 5/1990 | Japan . |
| 3-138234 | 6/1991 | Japan . |
| 7-133040 | 5/1995 | Japan . |

*Primary Examiner*—Sandra L. Brase
*Assistant Examiner*—Sophia S. Chen
*Attorney, Agent, or Firm*—David G. Conlin; George W. Neuner; Eric P. Raciti

[57] ABSTRACT

A copying machine allowing high copying efficiency and reliability by feeding recording sheets from any of a plurality of recording sheet storage regions to an image transfer region at a constant timing. Recording sheets stored in a cassette are fed one by one to a conveyance path by a sheet feed roller. The recording sheets P retained in an intermediate tray are fed one by one to a conveyance path by a sheet feed roller. The timings at which the sheet feed rollers, which are first drive rollers, are driven are controlled in such a way that a register roller, which is a second drive roller, can be driven at a constant cycle time with respect to a plurality of recording sheets fed from the conveyance path. Even when the cassette and the tray are switched over, the register roller is driven always at a constant cycle time. Thus, the image forming operation can be executed by feeding recording sheets in synchronization with the image-reading timing.

13 Claims, 26 Drawing Sheets

COPYING MACHINE HAVING A MECHANISM FOR FEEDING RECORDING SHEETS IN SYNCHRONIZATION WITH THE IMAGE READING TIMING

BACKGROUND OF THE INVENTION

1. Field of the Invention

The present invention relates to a copying machine to be used as it is equipped with an automatic document feeder.

2. Description of the Related Art

An example of the copying machine that is used as it is equipped with an automatic document feeder is disclosed in, for example, Japanese Patent Laid-Open Publication No. HEI 7-133040. In the prior art described in this publication, there is disclosed a technique that copying process is carried out at high copying efficiency and with reliability in the case of double-side recording in which images are formed on both sides of a recording sheet or in the case of synthetic recording in which an image is further formed on a recording sheet on which an image has been formed. A copying machine concretely comprises an exposure scanner for reading an image depicted on a document, an automatic document feeder, mounted on the exposure scanner, for supplying the exposure scanner with a plurality of document sheets one by one and for collecting the document from which the image has completely been read, an image-forming apparatus for forming an electrostatic latent image of the read image on a photoconductive drum, developing and transferring the formed image onto the recording sheet, a sheet feed unit for storing the recording sheet and feeding it to the image-forming apparatus, an intermediate tray section for temporarily storing the recording sheet, on which the image has been formed, in the case of double-side recording or synthetic recording, and an reversal unit for reversing the recording sheet top to bottom or bottom to top in the case of double-side recording.

The prior art technique, for the process of double-side recording or synthetic recording, enables a first-out mode that, before recording sheets over recording process of a first document are all stored in the intermediate tray, the feeding of sheets from the intermediate tray is started for the recording operation on a second document, by which the copying efficiency is enhanced. For this purpose, the intermediate tray section is provided with a guide for guiding the recording sheet under conveyance as well as with a storage unit. On one side of the storage unit on which the recording sheet is carried in, there is provided a rear-end holding member which, in the first-out mode, holds a conveyance-upstream side end of a recording sheet that has first been conveyed to the intermediate tray section so that subsequent recording sheets stacked and stored on the recording sheet, when first re-fed, will not be fed simultaneously. On the other side of the storage unit on which the recording sheet is carried out, also provided are a plurality of rollers or the like for re-feeding the recording sheets.

Further in the prior art technique, with a setting of a plurality of copies, for example, ten copies, the feed timing of recording sheets is controlled so that when the image-forming operation has exceeded a specified number of times, for example, seven times, the start of subsequent image-forming operations is delayed by a specified time. More specifically, the delay timer is actuated in response to the feed of the eighth recording sheet from the feed unit so that the timing at which the recording sheet is given to the image-forming apparatus is delayed by a timing roller. With this arrangement, the gap between the seventh recording sheet and the eighth recording sheet is widened and the image-forming operation on the second document will be started before the recording sheet on which the image of the first document has been formed is completely stored in the intermediate tray section. As a result, even if the re-feeding of recording sheets stored in the intermediate tray is started, the recording sheets will not interfere with one another.

Also, Japanese Patent Laid-Open Publication No. HEI 3-138234 discloses a technique that the gap between recording sheets is adjusted during continuous printing operation. Even when different gaps between recording sheets and different feed speeds of recording sheets are involved, it is preferable to feed recording sheets at a proper speed and gap which are so selected that adjacent recording sheets will not overlap with each other. With a selection of such an enough long gap between recording sheets as will not be determined as paper jam or the like, as well as a speed for holding the gap, longer time would be needed for printing, deteriorating the throughput of printing. The prior art technique maximizes the throughput by selecting such a minimum gap between recording sheets as will not be determined as paper jam or the like.

More specifically, a parameter that affects the gap between recording sheets sent to the printing mechanism of a printer is detected. When a parameter that narrows the gap is detected, the time point at which the subsequent recording sheet is taken out from the storage means is delayed so that a sufficient margin is ensured. Conversely, when a parameter that widens the gap is detected, the time point at which the subsequent recording sheet is taken out from the storage means is selected as such that will narrow the gap.

FIG. 30 is a timing chart for explaining disadvantages associated with an improper sheet gap between recording sheets P1 and P2 that are fed in succession. With a relatively small gap between the recording sheets P1 and P2, with a corresponding period T1, there is a possibility that a signal waveform due to a chattering of the sensors is mis-sensed as the conveyance-downstream side end of the recording sheet P2, such that the timing of starting the drive of the optical system relating to image reading is advanced, and that the timing of synchronization between the front end of the recording sheet and the front end of the document is off, resulting in copying failure. On the other hand, with a relatively large sheet gap between the recording sheets P2 and P3, with a corresponding period T2, indeed the timing control is made easier, but the copying efficiency would deteriorate.

FIG. 31 is a view showing a detection piece 270 provided on the conveyance path along which the recording sheet is conveyed. A recording sheet is conveyed along a conveyance direction 274, and the recording sheet contacts the detection piece 270, by which the detection piece 270 biased by a spring 273 is angularly shifted to a specified position, causing the sensor to turn on. For example, when the conveyance-downstream side end of the recording sheet has come into contact with the detection piece 270 and the detection piece 270 is angularly shifted to a position shown by a two-dot chain line 271 by the recording sheet that is further conveyed, the sensor will turn on. The sensor that has turned on will next turn off when the recording sheet completely passes through the detection piece, where the detection piece has angularly shifted to a position shown by a two-dot chain line 272. This means that the sensor keeps on longer than the actual length of the recording sheet by an extent from point X1 to point X2 in the figure. Therefore, because the actual gap between recording sheets is detected shorter than a preset gap between recording sheets based on the length of recording sheets, it is more likely that the sensor is affected by the chattering.

In the prior art technique disclosed in Japanese Patent Laid-Open Publication No. HEI 7-133040, for a plurality of copies, the sheet feed timing of recording sheets is so controlled that the start of subsequent image-forming operations will be delayed by a specified time period when the number of times of image-forming operation has exceeded a specified number, with the result that the recording sheets will not interfere with each other. That is, for example, with the sheet feed port switched over between the sheet feed unit and the intermediate tray section, the gap between conveyed recording sheets is intentionally widened. Therefore, a problem arises that the copying efficiency deteriorates. From the viewpoint of enhancing the copying efficiency, it is desirable that the image-forming section is actuated in synchronization with the image-reading timing of the exposure scanner, which is always the same timing. For this purpose, even if the sheet feed port is switched over between the sheet feed unit and the intermediate tray section, recording sheets need to be fed to the image-forming section always at the same timing. Because the prior art technique is not designed to feed recording sheets always at the same timing, the copying efficiency cannot be enhanced.

In another prior art disclosed in Japanese Patent Laid-Open Publication No. HEI 3-138234, the gap between recording sheets under continuous printing operation is adjusted in a printer having one sheet feed port. Therefore, with a plurality of sheet feed ports, when the sheet feed ports are switched over, the copying operation cannot be carried out at high copying efficiency and with reliability.

SUMMARY OF THE INVENTION

Accordingly, an object of the present invention is to provide a copying machine which is capable of executing copying operation at high copying efficiency and with reliability by feeding recording sheets to the image transfer means always at the same timing even if the recording sheets are fed from different storage means which are to be switched over among a plurality of recording-sheet storage means.

In one aspect, the present invention provides a copying machine comprising:

- document feed means for storing a plurality of document sheets on which an image has been drawn and continuously feeding the document sheets one by one to a predetermined image-reading position;
- image-reading means for reading an image from a document sheet fed to the image-reading position;
- at least one recording-sheet storage means for storing a plurality of recording sheets onto which an image is transferred;
- image transfer means for transferring onto a recording sheet an image read by the image-reading means;
- intermediate recording-sheet storage means for temporarily storing the recording sheet onto which the image has been transferred by image transfer means;
- at least one first conveyance path for conveying a recording sheet from the recording-sheet storage means to the image transfer means;
- a second conveyance path for conveying a recording sheet from the intermediate recording-sheet storage means to the image transfer means;
- at least one first drive roller for feeding the recording sheets stored in the recording-sheet storage means one by one to the first conveyance path;
- a second drive roller for feeding the recording sheets stored in the intermediate recording-sheet storage means one by one to the second conveyance path;
- a third drive roller, which is driven in synchronization with the image-reading timing, for feeding a recording sheet conveyed along the first or second conveyance path to the image transfer means; and
- control means for controlling timing at which the first and second drive rollers are driven, so that the third drive roller can be driven at a constant cycle time when a recording sheet is conveyed along the first conveyance path with the conveyance path of recording sheets switched over after a recording sheet fed from the intermediate recording-sheet storage means by the second drive roller has been conveyed.

According to this aspect of the invention, a plurality of document sheets stored in the document feed means are continuously fed one by one to a predetermined image-reading position, and an image drawn on a document sheet is read by the image-reading means. The recording sheets stored in the at least one recording-sheet storage means are fed one by one to the first conveyance path by the first drive roller. The timing at which the first and second drive rollers are driven is controlled by the control means so that the third drive roller can be driven at a constant cycle time when a recording sheet is conveyed along the first conveyance path with the conveyance path of recording sheets switched over after a recording sheet fed from the intermediate recording-sheet storage means by the second drive roller has been conveyed. The recording sheet conveyed along the conveyance path is fed to the image transfer means by the third drive roller that is driven in synchronization with the image-reading timing. The read image is transferred to the recording sheet by the image transfer means. The recording sheet onto which the image has been transferred can be temporarily stored in the intermediate recording-sheet storage means. The recording sheets stored in the intermediate recording-sheet storage means are fed one by one to the second conveyance path by the second drive roller the drive timing of which is controlled by the control means.

Therefore, since the timing at which the first and second drive rollers are driven is controlled so that the third drive roller can be driven at a constant cycle time with respect to a plurality of recording sheets that are fed in a plurality of conveyance paths, respectively, the third drive roller is driven always at the same cycle time even when a plurality of recording-sheet storage means is switched over from one to another. Thus, the image-forming operation can be executed by feeding recording sheets in synchronization with the image-reading timing, by which the copying efficiency can be enhanced.

In another aspect of the invention, the copying machine is characterized in that: the length from the conveyance-downstream side end of a recording sheet to the third drive roller is selected so as to be different between recording sheets stored in the recording-sheet storage means and recording sheets stored in the intermediate recording-sheet storage means; and that the control means controls the timing at which the first and second drive rollers are driven, so that the third drive roller can be driven at the same cycle time with respect to a plurality of recording sheets of different lengths which are fed along the first and second conveyance paths, respectively.

According to this aspect of the invention, because the plurality of conveyance paths along which recording sheets are conveyed differ in length from one another, the conveyance path along which a recording sheet is conveyed will differ in length when the recording-sheet storage means is switched over among a plurality of recording-sheet storage means. Even in such a case, the third drive roller is driven always at the same cycle time. Thus, the image-forming operation can be executed by feeding recording sheets in synchronization with the image-reading timing, and therefore the copying efficiency can be enhanced.

In another aspect of the invention, the copying machine is characterized in that the recording-sheet storage means and the intermediate recording-sheet storage means store a plurality of kinds of recording sheets having different sizes, and the length from the conveyance-downstream side end of a recording sheet to the third drive roller is selected so as to be different between recording sheets stored in the recording-sheet storage means and recording sheets stored in the intermediate recording-sheet storage means; and that the control means controls the timing at which the first and second drive rollers are driven, so that the third drive roller can be driven at the same cycle time with respect to a plurality of recording sheets of different lengths which are fed along the first and second conveyance paths, respectively.

According to this aspect of the invention, recording sheets stored in the recording-sheet storage means and recording sheets stored in the intermediate recording-sheet storage means are different in size from each other, and the plurality of conveyance paths along which recording sheets are conveyed are different in length from one another. Therefore, when the plurality of recording-sheet storage means are switched over from one to another, the conveyance paths along which recording sheets are conveyed are different in length from one another. Even in such a case, the third drive roller is driven always at the same cycle time. Thus, the image-forming operation can be executed by feeding recording sheets in synchronization with the image-reading timing, and therefore the copying efficiency can be enhanced.

In another aspect of the invention, the copying machine is characterized in that the control means comprises:

a first timer for counting the lapse of time from a conveyance start of a recording sheet stored in the recording-sheet storage means to the first conveyance path or a conveyance start of a recording sheet stored in the intermediate recording-sheet storage means to the second conveyance path until the recording sheet reaches the third drive roller; and first correction means for correcting a time shift of the timing at which the first or second drive roller is next driven, when the counted value has a shift from a time interval at which the first or second drive roller is driven, the time interval having been pre-selected so that the third drive roller can be driven at a constant cycle time with respect to a plurality of recording sheets fed in the first and second conveyance paths, respectively.

According to this aspect of the invention, the control means for controlling the timing at which the first and second drive rollers are driven performs control processes of: counting the lapse of time from a conveyance start of a recording sheet stored in the recording-sheet storage means to the first conveyance path or a conveyance start of a recording sheet stored in the intermediate recording-sheet storage means to the second conveyance path until the recording sheet reaches the third drive roller; and correcting a time shift of the timing at which the first or second drive roller is next driven, when the counted value has a shift from a time interval at which the first or second drive roller is driven, the time interval having been pre-selected so that the third drive roller can be driven at a constant cycle time with respect to a plurality of recording sheets fed in the first and second conveyance paths, respectively.

Therefore, for example when the actual time lapse from the conveyance start of a recording sheet stored in the recording-sheet storage means to the conveyance path until the recording sheet reaches the third drive roller is longer than the pre-selected time interval, the timing at which the first drive roller is next driven can be delayed to an extent of the time shift. Because this allows the start of feeding the next recording sheet to be delayed even if the actual conveyance of a recording sheet is delayed by some adverse effect such as a slip, copying operation can be achieved at high efficiency and with reliability by securely feeding recording sheets. This is the case also with recording sheets stored in the intermediate recording-sheet storage means.

In another aspect of the invention, the copying machine is characterized in that the control means comprises:

a second timer for counting a time interval at which recording sheets stored in the recording-sheet storage means are fed to the first conveyance path or a time interval at which recording sheets stored in the intermediate recording-sheet storage means are fed to the second conveyance path; and second correction means for correcting a time shift of the timing at which the first or second drive roller is next driven, when the counted value has a shift from a time interval at which recording sheets stored in the recording-sheet storage means are fed to the first conveyance path or a time interval at which recording sheets stored in the intermediate recording-sheet storage means are fed to the second conveyance path, the time interval having been pre-selected so that the third drive roller can be driven at a constant cycle time with respect to a plurality of recording sheets fed in the first and second conveyance paths, respectively.

According to this aspect of the invention, the control means for controlling the timing at which the first and second drive rollers are driven performs control processes of: counting the time interval at which recording sheets stored in the recording-sheet storage means are fed to the first conveyance path or the time interval at which recording sheets stored in the intermediate recording-sheet storage means are fed to the second conveyance path; and correcting a time shift of the timing at which the first or second drive roller is next driven, when the counted value has a shift from the time interval at which recording sheets stored in the recording-sheet storage means are fed to the first conveyance path or the time interval at which recording sheets stored in the intermediate recording-sheet storage means are fed to the second conveyance path, the time interval having been pre-selected so that the third drive roller can be driven at a constant cycle time with respect to a plurality of recording sheets fed in the first and second conveyance paths, respectively.

Therefore, for example when the actual time interval at which recording sheets stored in the recording-sheet storage means are fed to the conveyance path is longer than the pre-selected time interval, the timing at which the first drive roller is next driven can be delayed to an extent of the time shift. This allows the start of feeding the next recording sheet to be delayed even if the actual conveyance of a recording sheet fed to the image transfer means by the third drive roller is delayed by some shift of the synchronization timing of the third drive roller that is driven in synchronization with the image-reading timing. As a result, copying operation can be achieved at high efficiency and with reliability by securely feeding recording sheets. This is the case also with recording sheets stored in the intermediate recording-sheet storage means.

In another aspect of the invention, the copying machine is characterized in that the control means comprises:

a third timer for counting a standby time of a recording sheet during which the recording sheet remains on standby at the third drive roller; and third correction means for correcting a time shift of the timing at which the first or second drive roller is next driven, when the counted value has a shift from the standby time during which a recording sheet remains on standby at the third drive roller, the standby time having been pre-selected so that the third drive roller can be driven at a constant cycle time with respect to a plurality of recording sheets fed in the first and second conveyance paths, respectively.

According to this aspect of the invention, the control means for controlling the timing at which the first and second drive rollers are driven performs control processes of: counting the standby time of a recording sheet for which the recording sheet remains on standby at the third drive roller; and correcting a time shift of the timing at which the first or second drive roller is next driven, when the counted value has a shift from the standby time for which a recording sheet remains on standby at the third drive roller, the standby time having been pre-selected so that the third drive roller can be driven at constant cycle time with respect to a plurality of recording sheets fed in the first and second conveyance paths, respectively.

Therefore, for example when the standby time for which a recording sheet remains on standby at the third drive roller is longer than the pre-selected standby time, the timing at which the first drive roller is next driven can be delayed to an extent of the time shift. This allows the start of feeding the next recording sheet to be delayed even if the actual conveyance of a recording sheet fed to the image transfer means by the third drive roller is delayed by some shift of the synchronization timing of the third drive roller that is driven in synchronization with the image-reading timing. As a result, copying operation can be achieved at high efficiently and with reliability by securely feeding recording sheets. This is the case also with recording sheets stored in the intermediate recording-sheet storage means.

In another aspect of the invention, the copying machine further comprises a sensor located on a side of the first conveyance path on which the recording-sheet storage means is provided and on a side of the second conveyance path on which the intermediate recording sheet storage means is provided, the sensor serving for sensing that a recording sheet has passed, wherein the control means controls the driving of the first and second drive rollers in response to a turn-off of the sensor.

According to this aspect of the invention, the driving of the first and second drive rollers is controlled in response to a turn-off of the sensor, which is located on a side of the first conveyance path on which the recording-sheet storage means is provided and on a side of the second conveyance path on which the intermediate recording-sheet storage means is provided and which senses that a recording sheet has passed.

Therefore, the first drive roller is started to be driven at such a timing that the third drive roller can be driven at constant cycle time with respect to a plurality of recording sheets fed in a plurality of conveyance paths, respectively, and on condition that the recording sheet has been fed securely. As a result, reliable copying operation can be accomplished. This is the case also with recording sheets stored in the intermediate recording-sheet storage means.

In another aspect of the invention, the copying machine further comprises a sensor located on a side of the first conveyance path on which the recording-sheet storage means is provided and on a side of the second conveyance path on which the intermediate recording-sheet storage means is provided, the sensor serving for sensing that a recording sheet has passed, wherein the control means comprises:

a fourth timer for counting the lapse of time from a conveyance start of a recording sheet stored in the recording-sheet storage means to the first conveyance path or a conveyance start of a recording sheet stored in the intermediate recording-sheet storage means to the second conveyance path until the sensor turns on; and fourth correction means for correcting a time shift of the timing at which the first or second drive roller is next driven, when the counted value has a shift from a time interval from the conveyance start of a recording sheet stored in the recording-sheet storage means to the first conveyance path or the conveyance start of a recording sheet stored in the intermediate recording-sheet storage means to the second conveyance path until the sensor turns on, the time interval having been pre-selected so that the third drive roller can be driven at a constant cycle time with respect to a plurality of recording sheets fed in the first and second conveyance paths, respectively.

According to this aspect of the invention, the copying machine further comprises a sensor located on a side of the first conveyance path on which the recording-sheet storage means is provided and on a side of the second conveyance path on which the intermediate recording-sheet storage means is provided, the sensor serving for sensing that a recording sheet has passed, wherein the control means performs control processes of: counting the lapse of time from a conveyance start of a recording sheet stored in the recording-sheet storage means to the first conveyance path or a conveyance start of a recording sheet stored in the intermediate recording-sheet storage means to the second conveyance path until the sensor turns on; and correcting a time shift of the timing at which the first or second drive roller is next driven, when the counted value has a shift from a time interval from the conveyance start of a recording sheet stored in the recording-sheet storage means to the first conveyance path or the conveyance start of a recording sheet stored in the intermediate recording-sheet storage means to the second conveyance path until the sensor turns on, the time interval having been pre-selected so that the third drive roller can be driven at a constant cycle time with respect to a plurality of recording sheets fed in the first and second conveyance paths, respectively.

Therefore, for example when the actual time lapse from the conveyance start of a recording sheet stored in the recording-sheet storage means to the conveyance path until the sensor turns on is longer than the pre-selected time interval, the timing at which the first drive roller is next driven can be delayed to an extent of the time shift. Because this allows the start of feeding the next recording sheet to be delayed even if the actual conveyance of a recording sheet is delayed by some adverse effect such as a slip, copying operation can be achieved at high efficiency and with reliability by securely feeding recording sheets. This is the case also with recording sheets stored in the intermediate recording-sheet storage means.

In a further aspect, the invention provides a copying machine comprising:

document feed means for storing a plurality of document sheets on which an image has been drawn and continuously feeding the document sheets one by one to a predetermined image-reading position;

image-reading means for reading an image from a document sheet fed to the image-reading position;

at least one recording-sheet storage means for storing a plurality of recording sheets onto which an image is transferred;

specific-paper storage means for storing cover-paper sheets or laminated-paper sheets;

image transfer means for transferring onto a recording sheet an image read by the image-reading means;

a plurality of conveyance paths for conveying recording sheets and cover-paper sheets or laminated-paper sheets from the recording-sheet storage means and the specific-paper storage means to the image transfer means;

at least two fourth drive rollers for feeding the recording sheets stored in the recording-sheet storage means and the cover-paper sheets or laminated-paper sheets stored in the specific-paper storage means one by one to the conveyance paths;

a fifth drive roller for feeding to the image transfer means the recording sheet and the cover-paper sheet or laminated-paper sheet conveyed along the conveyance paths; and control means for controlling timing at which the fourth drive rollers are driven, so that the fifth drive roller can be driven at a constant cycle time with respect to a plurality of recording sheets that pass the conveyance paths.

According to this aspect of the invention, a plurality of document sheets stored in the document feed means are continuously fed one by one to a predetermined image-reading position, and an image drawn on a document sheet is read by the image-reading means. The recording sheets stored in the recording-sheet storage means and the cover-paper sheets or laminated-paper sheets, which are specific-paper sheets stored in the specific-paper storage means, are fed one by one to the plurality of conveyance paths by the at least two fourth drive rollers, respectively. The timing at which the fourth drive rollers are driven is controlled by the control means so that the fifth drive roller can be driven at a constant cycle time with respect to a plurality of recording sheets fed in the plurality of conveyance paths, respectively. The recording sheet or specific-paper sheet conveyed along the conveyance path is fed to the image transfer means by the fifth drive roller that is driven in synchronization with the image-reading timing. The image read by the image-reading means is transferred only to the recording sheet by the image transfer means, and not to the cover-paper sheet or laminated-paper sheet.

Therefore, since the timing at which the fourth drive rollers are driven is controlled so that the fifth drive roller can be driven at a constant cycle time with respect to a plurality of recording sheets that are fed in a plurality of conveyance paths, respectively, the fifth drive roller is driven always at the same cycle time even when the recording-sheet storage means and the specific-paper storage means is switched over. Thus, the image-forming operation can be executed by feeding recording sheets in synchronization with the image-reading timing, while the cover-paper sheets or laminated-paper sheets are conveyed, by which the copying efficiency can be enhanced.

In another aspect of the invention, the copying machine is characterized in that the control means controls operation of the fourth drive rollers so that a cover-paper sheet or laminated-paper sheet is started to be conveyed immediately after the one-preceding sheet has completely been conveyed.

According to this aspect of the invention, the control means for controlling the operation of the fourth drive rollers performs such a control process that a cover-paper sheet or laminated-paper sheet is started to be conveyed immediately after the one-preceding sheet has completely been conveyed.

Therefore, the cover-paper sheet or laminated-paper sheet onto which no image will be transferred is started to be conveyed immediately after the one-preceding sheet has completely been conveyed, so that copying operation including such conveyance of sheets can be carried out at high copying efficiency.

In a further aspect, the invention provides a copying machine comprising:

document feed means for storing a plurality of document sheets on which an image has been drawn and continuously feeding the document sheets one by one to a predetermined image-reading position;

image-reading means for reading an image from a document sheet fed to the image-reading position;

recording-sheet storage means for storing a plurality of kinds of recording sheets having different thicknesses onto which an image is transferred;

image transfer means for transferring onto a recording sheet an image read by the image-reading means;

a conveyance path for conveying a recording sheet from the recording-sheet storage means to the image transfer means;

a sixth drive roller for feeding the recording sheets stored in the recording-sheet storage means one by one to the conveyance path at a predetermined timing;

command means for selecting a recording sheet of a specified kind having a relatively large thickness from among the plurality of kinds of recording sheets having different thicknesses stored in the recording-sheet storage means and commanding conveyance to the conveyance path; and control means for delaying timing at which the sixth drive roller is driven, based on the command by the command means.

According to this aspect of the invention, a plurality of document sheets stored in the document feed means are continuously fed one by one to a predetermined image-reading position, and an image drawn on a document sheet is read by the image-reading means. The plurality of recording sheets having different thicknesses stored in the recording-sheet storage means are fed one by one to the plurality of conveyance paths, respectively, by the sixth drive roller. The recording sheets conveyed along the conveyance paths are fed to the image transfer means and the image read by the image-reading means is transferred thereto. The control means performs a control process of delaying the timing at which the sixth drive roller is driven, by a specified time lapse when a recording sheet of a specified kind having a relatively large thickness is selected and its conveyance is commanded by the command means.

Therefore, when a recording sheet having a relatively large thickness is conveyed, sufficient time can be ensured for securely conveying the recording sheet. Thus, a highly reliable copying operation can be executed by securely feeding recording sheets.

In another aspect of the invention, the copying machine further comprises a sensor located on a side of the conveyance path on which the recording-sheet storage means is provided, the sensor serving for sensing that a recording sheet has passed, wherein the control means comprises:

a fifth timer for counting the lapse of time from a conveyance start of a recording sheet stored in the recording-sheet storage means to the conveyance path until the sensor turns on, based on the command by the command means; and fifth correction means for advancing, by a time shift, the timing at which the sixth drive roller is next driven, when the counted value has a shortage of a time interval from the conveyance start of a recording sheet stored in the recording-sheet storage means to the conveyance path until the sensor turns on, the time interval having been pre-selected so that the turn-on of the sensor is delayed by a specified time period.

According to this aspect of the invention, the copying machine further comprises a sensor located on a side of the conveyance path on which the recording-sheet storage means is provided, the sensor serving for sensing that a recording sheet has passed, wherein the control means performs control processes of: counting the lapse of time from a conveyance start of a recording sheet stored in the recording-sheet storage means to the conveyance path until the sensor turns on, based on the command by the command means; and advancing, by a time shift, the timing at which the sixth drive roller is next driven, when the counted value has a shortage of a time interval from the conveyance start of a recording sheet stored in the recording-sheet storage means to the conveyance path until the sensor turns on, the time interval having been pre-selected so that the turn-on of the sensor is delayed by a specified time period.

Therefore, when a recording sheet having a relatively large thickness is conveyed and when the recording sheet has been conveyed relatively earlier, the conveyance of the next recording sheet can be advanced earlier. This allows sufficient time to be ensured for securely conveying the recording sheet, while the timing at which the next recording sheet is conveyed can be selected depending on the circumstances of conveyance. Thus, a high copying efficiency can be obtained by securely feeding recording sheets.

In a further aspect, the invention provides a copying machine comprising:

document feed means for storing a plurality of document sheets on which an image has been drawn and continuously feeding the document sheets one by one to a predetermined image-reading position, and further for re-storing the document sheets that have completely been read;

image-reading means for reading an image from a document sheet fed to the image-reading position;

first recording-sheet storage means for storing a plurality of recording sheets onto which an image is transferred;

second recording-sheet storage means for storing recording sheets onto one side of which an image has been transferred;

image transfer means for transferring onto a recording sheet an image read by the image-reading means;

a conveyance path for conveying recording sheets from the first and second recording-sheet storage means to the image transfer means;

a seventh drive roller for feeding the recording sheets stored in the first recording-sheet storage means one by one to the conveyance path;

an eighth drive roller for feeding the recording sheets stored in the second recording-sheet storage means one by one to the conveyance path;

a ninth drive roller for feeding a recording sheet conveyed along the conveyance path to the image transfer means; and control means for transferring an image onto both sides of a recording sheet from a document sheet on one side of which an image has been drawn, and for performing, in a process of transfer for a plurality of copies, control steps of:

at a first circulation of document sheets, driving the seventh drive roller so that the recording sheets stored in the first recording-sheet storage means are fed one by one to the conveyance path, driving the ninth drive roller so that the recording sheet fed to the conveyance path is fed to the image transfer means, transferring an image drawn on either one of odd page or even page of a fed document sheet, whichever it is, onto one side of the recording sheet, and storing to the second recording-sheet storage means the recording sheet onto one side of which the image has been transferred;

at second and following circulations of the document sheets, controlling timing at which the seventh and eighth drive rollers are driven, alternately, so that the ninth drive roller can be driven at a constant cycle time with respect to a plurality of recording sheets stored in the first and second recording-sheet storage means and passing along the conveyance path, and when the seventh and ninth drive rollers are driven in the same manner as in the first circulation of the document sheets, feeding a recording sheet stored in the first recording-sheet storage means and transferring an image drawn on either one of odd page or even page of a fed document sheet, whichever it is, onto one side of the recording sheet and storing to the second recording-sheet storage means the recording sheet onto one side of which the image has been transferred, and when the eighth and ninth drive rollers are driven, feeding the recording sheets stored in the second recording-sheet storage means one by one to the conveyance path, feeding to the image transfer means the recording sheet fed to the conveyance path, transferring the image drawn on the other one of odd page or even page of a fed document sheet, whichever it is, onto the other side of the recording sheet, and discharging the recording sheet on both sides of which the images have been transferred, through a specified port; and at a final circulation of the document sheets, driving the eighth drive roller so that the recording sheets stored in the second recording-sheet storage means are fed one by one to the conveyance path, driving the ninth drive roller so that the recording sheet fed to the conveyance path is fed to the image transfer means, transferring an image drawn on the other one of odd page or even page of a fed document sheet, whichever it is, onto the other side of the recording sheet, and discharging the recording sheet on both sides of which the images have been transferred, through a specified port.

According to this aspect of the invention, a plurality of document sheets stored in the document feed means are continuously fed one by one to a predetermined image-reading position, and an image drawn on a document sheet is read by the image-reading means. The document sheet from which the image has completely been read is re-stored in the document feed means. The recording sheets stored in the first recording-sheet storage means are fed one by one to the conveyance path by the seventh drive roller. The recording sheets on one side of which an image has been transferred are fed one by one to the conveyance path by the eighth drive roller. The timing at which the seventh and eighth drive rollers are driven is controlled by the control means. A recording sheet conveyed along the conveyance path is fed to the image transfer means by the ninth drive roller that is driven in synchronization with the image-reading timing, and the image read by the image-reading means is transferred thereto by the image transfer means.

The control means transfers an image onto both sides of a recording sheet from a document sheet on one side of which the image has been drawn, and in a process of transfer for a plurality of copies, at a first circulation of document sheets, drives the seventh drive roller so that the recording sheets stored in the first recording-sheet storage means are fed one by one to the conveyance path. The control means also drives the ninth drive roller so that the recording sheet fed to the conveyance path is fed to the image transfer means, transfers an image drawn on either one of odd page or even page of a fed document sheet, whichever it is, onto one side of the recording sheet, and stores to the second recording-sheet storage means the recording sheet onto one side of which the image has been transferred.

At second and following circulations of the document sheets, the control means controls the timing at which the seventh and eighth drive rollers are driven, alternately, so that the ninth drive roller can be driven at a constant cycle time with respect to a plurality of recording sheets stored in the first and second recording-sheet storage means and passing along the conveyance path. That is, when the seventh and ninth drive rollers are driven in the same manner as in the first circulation of the document sheets, the control means feeds the recording sheets stored in the first recording-sheet storage means, transfers the image drawn on either one of odd page or even page of the fed document sheet, whichever it is, onto one side of the recording sheet, and stores to the second recording-sheet storage means the recording sheet onto one side of which the image has been transferred. When the eighth and ninth drive rollers are driven, the control means feeds the recording sheets stored in the second recording-sheet storage means one by one to the conveyance path, feeds to the image transfer means the recording sheet fed to the conveyance path, transfers an image drawn on the other one of odd page or even page of a fed document sheet, whichever it is, onto the other side of the recording sheet, and discharges the recording sheet on both sides of which the images have been transferred, through a specified port.

At a final circulation of the document sheets, the control means drives the eighth drive roller so that the recording sheets stored in the second recording-sheet storage means are fed one by one to the conveyance path. The control means also drives the ninth drive roller so that the recording sheet fed to the conveyance path is fed to the image transfer means, transfers an image drawn on the other one of odd page or even page of the fed document sheet, whichever it is, onto the other side of the recording sheet, and discharges the recording sheet on both sides of which the images have been transferred, through a specified port.

Therefore, since the timing at which the seventh and eighth drive rollers are driven is controlled so that the ninth drive roller can be driven at a constant cycle time with respect to a plurality of recording sheets fed in a plurality of conveyance paths, respectively, the ninth drive roller is driven always at the same cycle time even in the second and following circulations during which the first and second recording-sheet storage means are switched over from one to the other and during which an image is transferred to both sides of the recording sheet from a document sheet on one side of which an image has been drawn, in a case of transfer for a plurality of copies. Thus, the image-forming operation can be executed by feeding recording sheets in synchronization with the image-reading timing, so that the copying efficiency can be enhanced.

As shown above, according to the invention, the timing at which the first and second drive rollers for feeding recording sheets one by one to a plurality of conveyance paths, respectively, is controlled so that the third drive roller can be driven at the same cycle time with respect to a plurality of recording sheets fed in a plurality of conveyance paths, respectively. As a result, even when a plurality of recording-sheet storage means are switched over from one to another, the third drive roller is driven always at constant cycle time. Thus, the image-forming operation can be executed by feeding recording sheets in synchronization with the image-reading timing, so that the copying efficiency can be enhanced.

Also according to the invention, in cases where the conveyance paths along which the recording sheets are conveyed are different in length from one another when the plurality of recording-sheet storage means are switched over from one to another, the third drive roller is driven always at a constant cycle time. Thus, the image-forming operation can be executed by feeding recording sheets in synchronization with the image-reading timing, so that the copying efficiency can be enhanced.

Also according to the invention, in cases where the recording sheets stored in the recording-sheet storage means and the recording sheets stored in the intermediate recording-sheet storage means are different in size from each other and where the conveyance paths along which the recording sheets are conveyed are different in length from one another when the plurality of recording-sheet storage means are switched over from one to another, the third drive roller is driven always at a constant cycle time. Thus, the image-forming operation can be executed by feeding recording sheets in synchronization with the image-reading timing, so that the copying efficiency can be enhanced.

Also according to the invention, when the actual time lapse from the conveyance start of a recording sheet stored in the recording-sheet storage means or in the intermediate recording-sheet storage means to the conveyance paths until the recording sheet reaches the third drive roller has a shift from a pre-selected time interval, the timing at which the first or second drive roller is next driven is corrected to an extent of the time shift. Because this allows the start of feeding the next recording sheet to be delayed even if the actual conveyance of a recording sheet is delayed by some adverse effect such as a slip, copying operation can be achieved at high efficiency and with reliability by securely feeding recording sheets.

Also according to the invention, when the actual time interval at which the recording sheets stored in the recording-sheet storage means and the intermediate recording-sheet storage means are fed to the conveyance paths has a shift from a pre-selected time interval, the timing at which the first or second drive roller is next driven is corrected to an extent of the time shift. Because this allows the start of feeding the next recording sheet to be delayed even if the actual conveyance of a recording sheet to be fed to the image transfer means by the third drive roller is delayed, the start of feeding the next recording sheet can be delayed, so that copying operation can be achieved at high efficiency and with reliability by securely feeding recording sheets.

Also according to the invention, when the standby time for which a recording sheet remains on standby at the third drive roller has a shift from a pre-selected standby time, the timing at which the first or second drive roller is next driven is delayed to an extent of the time shift. This allows the start of feeding the next recording sheet to be delayed even if the actual conveyance of a recording sheet fed to the image transfer means by the third drive roller is delayed by some shift of the synchronization timing of the third drive roller that is driven in synchronization with the image-reading timing. As a result, copying operation can be achieved at high efficiently and with reliability by securely feeding recording sheets.

Also according to the invention, the driving of the first and second drive rollers is controlled in response to a recording sheet in the conveyance paths and to a turn-off of the sensor, which is located on a side of the first conveyance path on which the intermediate recording-sheet storage means is provided. Moreover, the first and second drive rollers are started to be driven at such a timing that the third drive roller can be driven at a constant cycle time with respect to a plurality of recording sheets fed in a plurality of conveyance paths, respectively, and on condition that a recording sheet has securely been fed. Thus, more reliable copying operation can be achieved.

Also according to the invention, when the time elapse from the conveyance start of a recording sheet stored in the recording-sheet storage means or the intermediate recording-sheet storage means to the conveyance path until the sensor turns on has a shift from a pre-selected time interval, the timing at which the first or second drive roller is next driven is corrected to an extent of the time shift. Because this allows the start of feeding the next recording sheet to be delayed even if the actual conveyance of a recording sheet is delayed by some adverse effect such as a slip, copying operation can be achieved at high efficiency and with reliability by securely feeding recording sheets.

Also according to the invention, the driving timing of the fourth drive rollers for feeding the recording sheets and the cover-paper sheets or laminated-paper sheets one by one to the conveyance paths, respectively, is controlled so that the fifth drive roller can be driven at a constant cycle time with respect to a plurality of recording sheets fed in the plurality of conveyance paths, respectively. Thus, even when the recording-sheet storage means and the specific-paper storage means has been switched over from one to the other, the fifth drive roller is driven always at constant cycle time. As a result, in synchronization with the image-reading timing, the image-forming operation can be executed by feeding recording sheets, while cover-paper sheets or laminated-paper sheets can be conveyed, so that the copying efficiency can be enhanced.

Also according to the invention, the fourth drive rollers are controlled so that a cover-paper sheet or laminated-paper sheet is started to be conveyed immediately after the one-preceding sheet has completely been conveyed. Therefore, the cover-paper sheet or laminated-paper sheet onto which no image will be transferred is started to be conveyed immediately after the one-preceding sheet has completely been conveyed, so that copying operation including such conveyance of sheets can be carried out at high copying efficiency.

Also according to the invention, the timing at which the sixth drive roller for feeding a plurality of kinds of recording sheets having different thicknesses one by one to a plurality of conveyance paths is driven is delayed by a specified time lapse when a recording sheet of a specified kind having a relatively large thickness is selected and its conveyance is commanded by the command means. Therefore, when a recording sheet having a relatively large thickness is conveyed, sufficient time can be ensured for securely conveying the recording sheet. Thus, a highly reliable copying operation can be executed by securely feeding recording sheets.

Also according to the invention, when a recording sheet having a relatively large thickness is conveyed and when the recording sheet has been conveyed relatively earlier, the conveyance of the next recording sheet can be advanced earlier. This allows sufficient time to be ensured for securely conveying the recording sheet, while the timing at which the next recording sheet is conveyed can be selected depending on the circumstances of conveyance. Thus, a high copying efficiency can be obtained by securely feeding recording sheets.

Also according to the invention, since the timing at which the seventh and eighth drive rollers are driven is controlled so that the ninth drive roller can be driven at a constant cycle time with respect to a plurality of recording sheets fed in a plurality of conveyance paths, respectively, the ninth drive roller is driven always at the same cycle time even in the second and following circulations during which the first and second recording-sheet storage means are switched over from one to the other and during which an image is transferred to both sides of the recording sheet from a document sheet on one side of which an image has been drawn, in the case of transfer for a plurality of copies. Thus, the image-forming operation can be executed by feeding recording sheets in synchronization with the image-reading timing, so that the copying efficiency can be enhanced.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
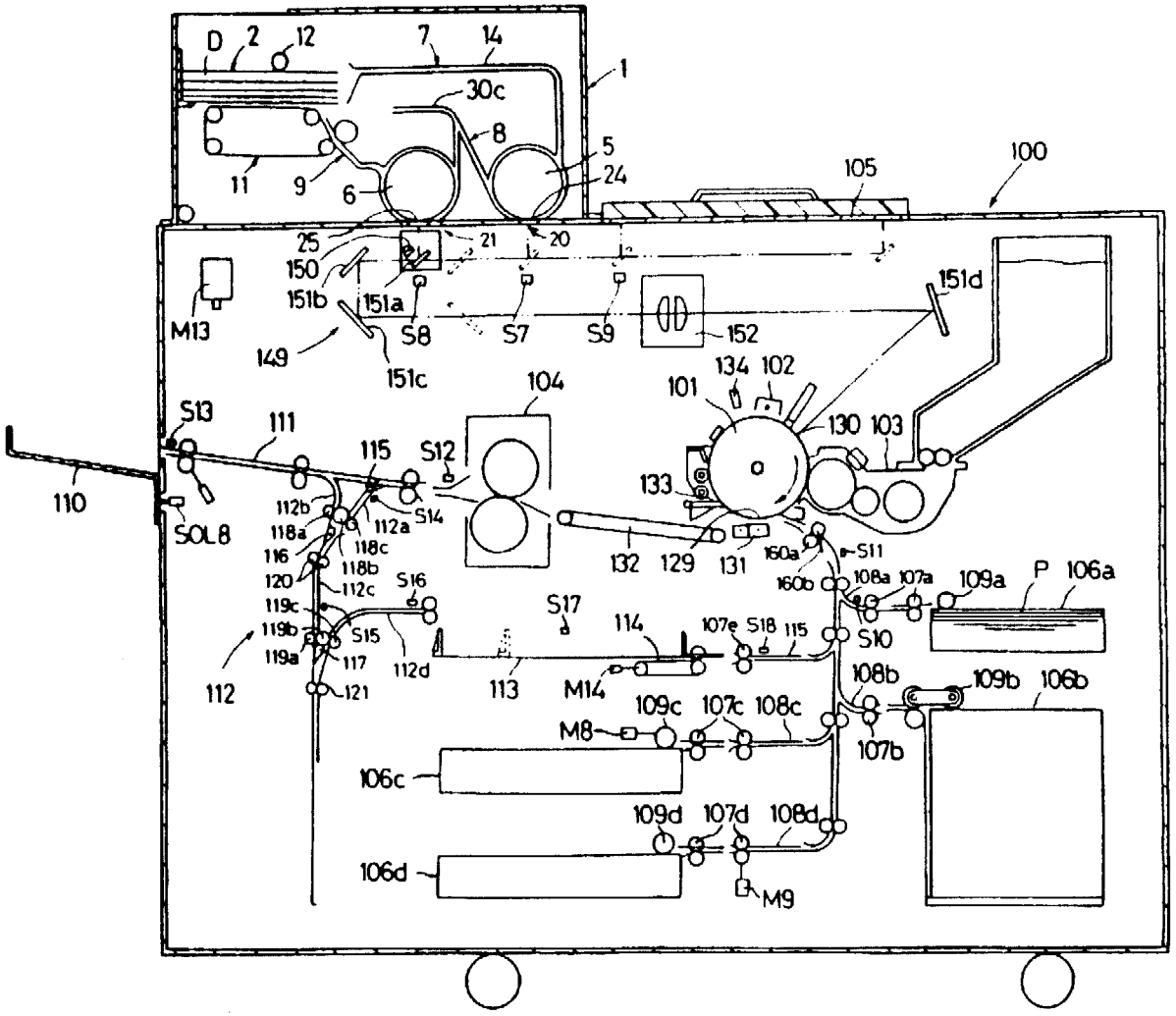
FIG. 1 is a schematic sectional view showing the basic configuration of a transfer-type electrostatic copying machine equipped with a recirculative document handler 1.

Now referring to the drawings, preferred embodiments of the invention are described below.

FIG. 1 is a schematic sectional view showing the basic configuration of a transfer-type electrostatic copying machine equipped with a recirculative document handler 1 which is so called RDH or the like. In the center inside a body 100 of the copying machine, a right-circular cylindrical photoconductor 101 is disposed so as to be rotatable at a constant speed. On the outer periphery of the photoconductor 101, are provided sections for various copying processes as well as a corona discharger 102 for the use of charging, a developing unit 103, and the like. A fixing unit 104 is disposed on the left side of the photoconductor 101 as viewed in the figure.

The recirculative document handler 1 is provided on the top surface of the body 100 of the copying machine. A first reading position 20 and a second reading position 21 located vertically below a first support cylinder 5 and a second support cylinder 6, respectively, are provided in parallel and generally on substantially the same plane on the top surface of the body 100. Also on the top surface of the body 100 of the copying machine, a third reading position 105 corresponding to a bound book or the like is provided, constituting exposure means 149 that is capable of a two-system reading exposure.

Figure 2:
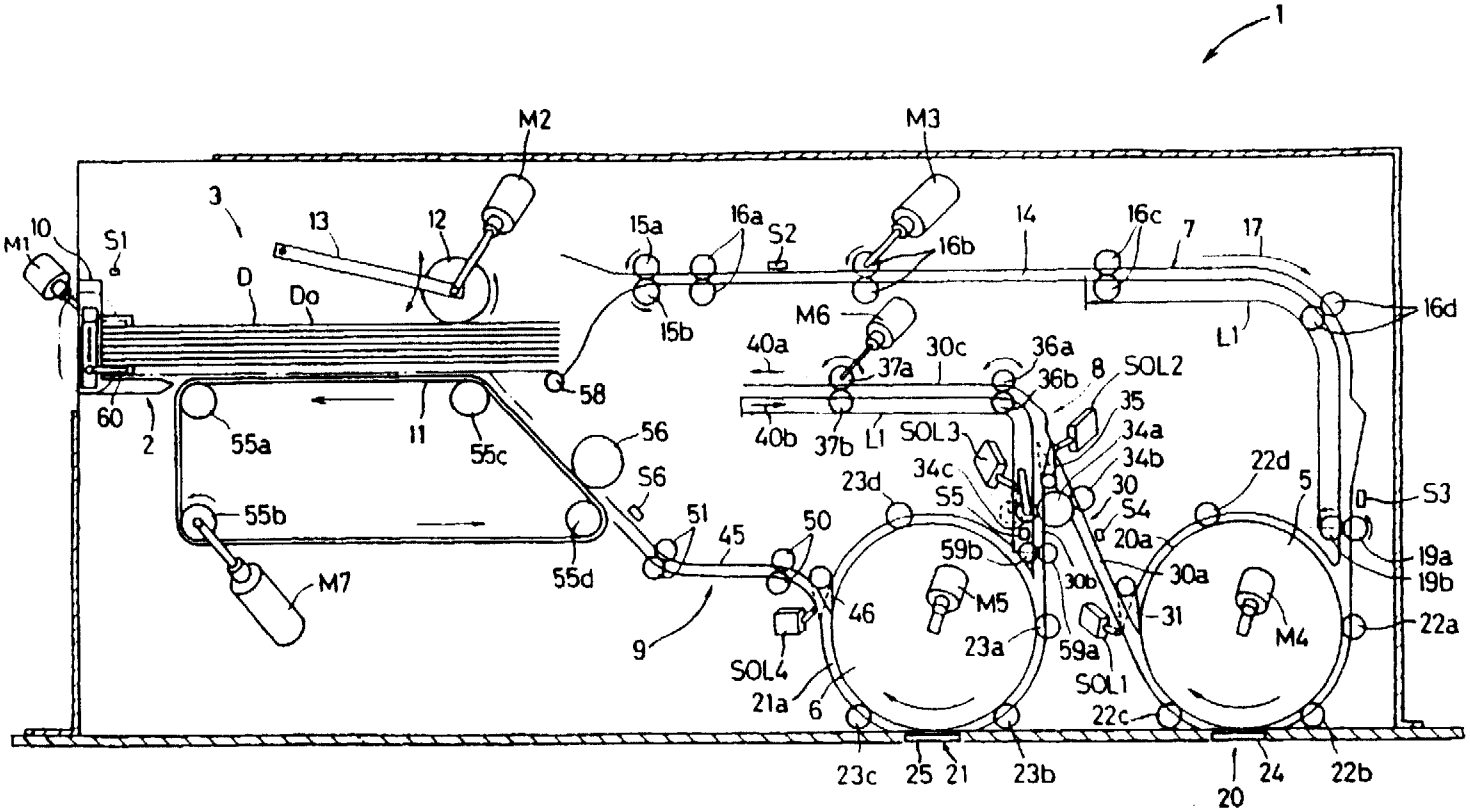
FIG. 2 is a schematic sectional view of the recirculative document handler 1.

FIG. 2 is a schematic sectional view of the recirculative document handler 1. The recirculative document handler 1 comprises: a document storage 2 which is storage means for storing document sheets; sheet feed means 3 for feeding the document sheets one by one from the document storage 2; the right-circular cylindrical first support cylinder 5 which conveys a document sheet along the outer peripheral surface so as to cause its one-side surface to confront the first reading position 20; the right-circular cylindrical second support cylinder 6 which causes the other-side surface of the conveyed document sheet to confront the second reading position 21; document feed means 7 for conveying a document sheet from the document storage 2 to the first support cylinder 5; document reversal means 8 which is intervened between the first support cylinder 5 and the second support cylinder 6 and which reverses the document sheet under conveyance so that, as one surface of the document sheet confronts the first reading position 20, the other surface thereof will confront the second reading position 21; and document storage means 9 for returning the document sheet from the second support cylinder 6 to the document storage 2.

The document storage 2 accepts a plurality of document sheets D put in order of their attached page numbers, in the state that one-end portions (left-side end portions in FIG. 1) of the document sheets D are aligned by an end-portion aligning member 10, for example, with a largest-page-numbered document sheet facing a document conveyor belt 11. In order to separately convey the document sheets D one by one in an order starting with the document sheet located uppermost, a sheet feed roller 12 which constitutes the sheet feed means 3 is provided in an upper portion of the document storage 2. The sheet feed roller 12 is driven by a document feed-out motor M2 to rotate in a direction indicated by an arrow at a predetermined timing, while the sheet feed roller 12 is pressed against a document sheet D0 that is located uppermost, via a lever 13 with force of a solenoid or the like during the rotation, so that document sheets are separately fed out to the document feed means 7 in order, starting with the document sheet D0.

The document feed means 7, into which the document sheets D are fed one by one from the document storage 2 by the sheet feed roller 12, has a conveyance path 14 bent from the horizontal to vertical direction downward as illustrated in the figure. At an inlet-side end of the conveyance path 14, separating rollers **15*a*, 15*b* are placed to prevent overlapped conveyance of the document sheets D. The upper roller 15*a* is driven to rotate in the document-forward direction, while the lower roller 15***b* is driven to rotate in the document-backward direction. By passing the document sheets D between these rollers 15*a*, 15*b*, the document sheets D are securely separated one by one and sent to the conveyance path 14. On the conveyance path 14, conveyor rollers 16*a*, 16*b*, 16*c*, 16*d* are provided each in a pair so as to be spaced from one another in the direction of conveyance.

Each pair of these conveyor rollers 16*a* to 16*d* rotatably contact both sides of a document sheet D, where the rollers 16*a* to 16*d* are forcedly rotated by a document conveyor motor M3, by which the document sheet D is conveyed along the conveyance path 14 in the direction of an arrow 17 while being guided by the rollers. A document feed sensor S2 is placed near the inlet-side end portion of the conveyance path 14, while a pre-first-reading-position sensor S3 is placed near the outlet-side end portion of the conveyance path 14.

Also, a pair of first register rollers 19*a*, 19*b* are placed at an outlet portion of the conveyance path 14 (near the first support cylinder 5). These first register rollers 19*a*, 19*b*, although not shown, are linked with a drive shaft via a clutch CLT1 so as to be stopped from rotating and re-rotated by on-off control of the clutch CLT1. The on-off control of the clutch CLT1 is controlled according to a copying mode desired by the operator.

More specifically, when the document sheet D needs to be read, the rollers 19*a*, 19*b* are stopped from rotating so that the document sheet D is put into standby state, for synchronization with the conveyance of a recording sheet in the body 100 of the copying machine and, after synchronized, re-rotated so that the document sheet D is conveyed to the first support cylinder 5. On the other hand, without the need of reading the document sheet D, the first rollers 19*a*, 19*b* are normally rotated simply as conveyor rollers, like the other conveyor rollers, allowing the document sheet D to pass therethrough.

In addition, while the first register rollers 19*a*, 19*b* operate simply as conveyor rollers, the conveyor rollers 16*c*, 16*d*, which are located upstream of the first register rollers 19*a*, 19*b* by a length less than a permissible maximum length L1 of the document sheet D under conveyance, will not be stopped from rotating until the conveyance of the document sheet D is completed. On the other hand, while the first register rollers 19*a*, 19*b* operate as register rollers that keep the document sheet D on standby to adjust the timing at which the document sheet D is conveyed to the first support cylinder 5, the conveyor rollers 16*c*, 16*d* located as described above are also controlled in rotation.

More specifically, when the conveyance-forwarded front end of the document sheet D conveyed along the conveyance path 14 has reached between the first register rollers 19*a*, 19*b*, the conveyor rollers 16*c*, 16*d* are temporarily stopped from rotating, causing the conveyance of the document sheet D to be stopped. Thereafter, simultaneously when the first register rollers 19*a*, 19*b* are started to rotate, the conveyor rollers 16*c*, 16*d* are also re-started to rotate, causing the conveyance of the document sheet D to be re-started.

The position where the document image of the document sheet D is read comprises the first reading position 20 and the second reading position 21 that are provided in correspondence to vertical lower end portions of the first support cylinder 5 and the second support cylinder 6, respectively, which are juxtaposed so as to be spaced horizontally. These first reading position 20 and second reading position 21 are on the same plane as illustrated in the figure.

The support cylinders 5, 6 are driven by document conveyor motors M4, M5, respectively, to rotate clockwise (see FIG. 2) in synchronization with the conveyance speed at which the document sheet should be conveyed to the reading positions 20, 21 according to a copying speed to the recording sheet, i.e., according to a set scaling factor of copying. The support cylinders 5, 6 are also provided with subordinate rollers 22*a* to 22*d*, 23*a* to 23*d*, respectively, which are spaced from one another along their outer peripheral surfaces. These subordinate rollers serve to press the document sheet D against the outer peripheral surfaces of the support cylinders 5, 6, making the document sheet D wound around the cylinders, so that the document sheet D is conveyed along circulating conveyance paths 20*a*, 21*a* formed on the outer peripheral surfaces of the support cylinders 5, 6.

Vertically below these circulating conveyance paths 20*a*, 21*a*, hard transparent glass plates 24, 25 are placed to constitute the first and second reading positions 20, 21. When the document sheet D passes between the first support cylinder 5 and the first transparent glass plate 24 at a speed based on a set scaling factor of copying, one surface of the document sheet D (top surface of the document sheets D stacked in the document storage 2) is exposed to light and read so that the document image corresponding to the one surface is read. When the document sheet D passes between the second reading position 21 and the second transparent glass plate 25, the other surface of the document sheet D (bottom surface of the document sheet D in the document storage 2) is exposed to light and read, as described later, so that the document image corresponding to the other surface is read.

In some cases of conveyance where a copying mode desired by the operator and a document-counting operation are involved, the document sheet D will pass the first reading position 20 and the second reading position 21 as it is, without executing the reading exposure operation at those reading positions.

To the first reading position 20, the document sheet D is conveyed as it is wound around the first support cylinder 5 by the rotational force of the first register rollers 19*a*, 19*b* via the conveyance path 14 of the document feed means 7. Between the first support cylinder 5 and the second support cylinder 6, is placed the document reversal means 8 equipped with a front-rear reversal path 30 for switching over the surface that confronts the reading position, as shown in the figure. The front-rear reversal path 30 comprises a first path 30*a* and a second path 30*b* extending upward on a slant from opposite sites of the circulating conveyance paths 20*a*, 21*a* of the first support cylinder 5 and the second support cylinder 6, and a third path 30C extending horizontally leftward from the junction point of these paths 30*a*, 30*b*.

At the inlet portion of the first path 30*a* adjoining the circulating conveyance paths 20*a* of the first support cylinder 5, a direction switching claw 31 is placed. The direction switching claw 31 is actuated by a solenoid SOL1 so that the document sheet D is conveyed selectively either to the first path 30*a* or to the circulating conveyance path 20*a* of the first support cylinder 5. That is, according to the copying mode desired by the operator, in which one-time exposure will do, the direction switching claw 31 is actuated to the solid-line position of FIG. 1, by which the document sheet D that has passed the first reading position 20 is conveyed to the first path 30*a*. On the other hand, in the case where a plurality of times of reading exposure are needed, the direction switching claw 31 is actuated to the two-dot-chain-line position, by which the document sheet D is conveyed along the circulating conveyance path 20*a* of the first support cylinder 5 to a plurality of times.

After the completion of the reading-exposure operation, the direction switching claw 31 is actuated to the solid-line position, by which the document sheet D is conveyed to the first path 30*a*. On the first path 30*a*, there are placed a post-first-reading-position sensor S4 for sensing a conveyance-rear end portion of the document sheet D, a pair of rollers 34*a*, 34*b*, and a direction switching claw 35, in this order starting with the upstream side in the direction of conveyance of the document sheet D. Based on a sensing signal of the sensor S4, the following front-rear reversal operation is controlled.

By the rollers 34*a*, 34*b* being driven into rotation, the document sheet D is conveyed through the direction switching claw 35 to the third path 30C. On the third path 30C, there are disposed conveyor rollers 36*a*, 36*b* and 37*a*, 37*b* each in a pair. The rollers 36*a*, 37*a* are rotated forward and reverse by a document reversal motor M6. These conveyor rollers 36, 37 convey the document sheet D derived from the direction switching claw 35 in the direction of an arrow 40*a* within the third path 30C, and thereafter convey the document sheet D in the direction of an arrow 40*b* by the rotation of the document reversal motor M6 being reversed at a time point when the conveyance-rear end portion of the document sheet D has passed the direction switching claw 35.

The direction switching claw 35 is put into the solid-line state of FIG. 1 by a solenoid SOL2, closing the first path 30*a* for the third path 30C, while the second path 30*b* is opened so that the document sheet D is conveyed to the second path 30*b*. On the second path 30*b*, is disposed a roller 34*c*, which is put into press contact with the roller 34*a* by a solenoid SOL3 while the document sheet D is sandwiched between the rollers and conveyed. The front-rear reversal operation of the document sheet described above has been implemented by using the forward/reverse rollers 36, 37. However, the operation may be done also by using belt conveyor equipment, air conveyor equipment, or the like.

The rotational force of the rollers 34*a*, 34*c* aids the second support cylinder 6 in the operation of conveying the document sheet D to the second reading position 21 with the document sheet D wound around the outer peripheral surface. At a position on the downstream side of conveyance with respect to the roller 34*c*, is placed a pre-second-reading-position sensor S5 for sensing passage of the conveyance-forwarded front end portion of the document sheet D.

Further at a position on the downstream side of the sensor S5, a plurality of second register rollers 59*a*, 59*b* are disposed. These second register rollers 59*a*, 59*b*, although not shown, are linked with a drive shaft via a clutch CLT2 so as to be stopped from rotating and re-rotated by on-off control of a clutch CLT2. The on-off control of the clutch CLT2 is controlled according to a copying mode desired by the operator.

More specifically, when the document sheet D needs to be read, the rollers 59*a*, 59*b* are stopped from rotating so that the document sheet D is put into standby state, for synchronization with a recording sheet and, after synchronized, re-rotated so that the document sheet D is conveyed to the second support cylinder 6. On the other hand, without the need of reading the document sheet D, the rollers 59*a*, 59*b* are normally rotated simply as conveyor rollers, allowing the document sheet D to pass therethrough without being stopped. The operation of the solenoid SOL3 is controlled according to the rotational operation of the rollers 59*a*, 59*b*.

In addition, the conveyor rollers 36, 37, which are located upstream of the second register rollers 59*a*, 59*b* by a length less than the permissible maximum length L1 of the document sheet D under conveyance, will operate in the same relationship between the first register rollers 19*a*, 19*b* and the conveyor rollers 16*c*, 16*d*.

More specifically, while the second register rollers 59*a*, 59*b* operate simply as conveyor rollers, the conveyor rollers 36, 37, which serve to convey the document sheet D to the second support cylinder 6, will not be stopped from rotating until the conveyance of the document sheet D is completed. On the other hand, while the second register rollers 59*a*, 59*b* operate as register rollers, the conveyor rollers 36, 37 are temporarily stopped from rotating when the front end portion of the document sheet D in the direction of its conveyance has reached between the rollers 59*a*, 59*b*. Thereafter, simultaneously when the second register rollers 59*a*, 59*b* are started to rotate, the conveyor rollers 36, 37 are also re-started to rotate, causing the conveyance of the document sheet D to be re-started.

As described before, by the document sheet D being reversed in its conveyance direction at the front-rear reversal path 30, one-side surface of the document sheet D that has already confronted the first reading position 20, upon confronting the outer peripheral surface of the second support cylinder 6, is wound therearound, so that the document sheet D is conveyed by the second support cylinder 6 as the other surface of the document sheet D that has not confronted the reading position is taken as the outer surface. Accordingly, at the second reading position 21, the other surface of the document sheet D that is conveyed at a conveyance speed based on a set scaling factor for copying is exposed to light and read, by which the document image corresponding to the other surface is read.

With regard to the second support cylinder 6, a direction switching claw 46 is placed at a site where the document sheet D that has passed the second reading position 21 is branched from the circulating conveyance path 21*a* to a conveyance path 45 of the document storage means 9. This direction switching claw 46, which is actuated by a solenoid SOL4, selectively opens and closes the circulating conveyance path 21*a* for the conveyance path 45.

More specifically, when the reading exposure at the second reading position 21 is done only once according to the copying mode desired by the operator, the circulating conveyance path 21*a* is opened so that the document sheet D is conveyed to the conveyance path 45. On the other hand, when the reading exposure is done to a plurality of times, the conveyance path 45 is closed while the document sheet D is conveyed to a necessary number of times in the circulating conveyance path 21*a* and thereafter conveyed to the conveyance path 45.

As described before, one-side surface of the document sheet D is exposed to light and read at the first reading position, and the other surface is exposed to light and read at the second reading position 21, by which images on both front and rear surfaces of the document sheet D can be read. Also, since the reading exposure can be effected to necessary numbers of times at these first reading position 20 and second reading position 21, respectively, a necessary number of copies can be achieved with respect to a plurality of document sheets D.

In the document storage means 9 that returns the document sheet D from the second reading position 21 to the document storage 2, the conveyance path 45 connects with the lower end portion of the conveyor belt 11 so that the document sheet D is conveyed to the conveyor belt 11. That is, the conveyance path 45 has conveyor rollers 50, 51, each in a pair, provided for conveying the document sheet D. Also near the outlet of the conveyance path 45, a pre-storage document sensor S6 for sensing passage of the document sheet D is disposed. Based on a sensing signal derived from the sensor S6, the operation control of the conveyor belt 11 and the document storage means 9 is executed.

The endless conveyor belt 11 is wound on and stretched over rollers 55*a*, 55*b*, 55*c*, 55*d*, which are spaced from one another vertically and horizontally as shown in the figure. The drive roller 55*b* is driven to rotate in a direction of an arrow by a return conveyor motor M7 based on the sensing signal from the sensor S6, by which the conveyor belt 11 is driven to rotate counterclockwise (see FIG. 2). The upper stretched portion of the conveyor belt 11 serves also as a portion on which the document sheet D is placed. Further, a document-introducing roller 56 is placed in proximity to the conveyance path 45, so that the document sheet D is fed in between the upper stretched portion of the conveyor belt 11 and the lowermost portion of the document sheet D placed thereon, by the conveying force in cooperation of the conveyor belt 11 to the roller 56.

In connection to this, for more smooth feed-in operation, a document kick-up roller 58 is disposed below a document-feed downstream-side end portion of the document sheets D placed in the document storage 2. This arrangement makes a right-side end portion, as viewed in the figure, of the stacked document sheets D temporarily floated off the conveyor belt 11, thus positively widening the opening for feeding each document sheet to the lowermost end position. At a time point when the conveyance-forwarded front end portion of the document sheet D has reached the end-portion aligning member 10, the return conveyor motor M7 of the conveyor belt 11 is stopped from being driven, by which the returning operation of the document sheet D, which has been fed to the lowermost end position, is completed.

Further, in the document storage 2, a detective actuator member 60 made of, for example, a mirror-finished stainless steel plate or the like is provided to detect one circulation of the placed document sheets D, as shown in the figure. The actuator member 60 is in a lower end position indicated by solid line in FIG. 1 before the operator places the document sheets D, and then the document sheets D are placed on the actuator member 60. The document sheets D are fed out from the document storage 2 one by one, and as the document sheets D are returned again, the actuator member 60 is displaced gradually upward, intervening between un-fed document sheets and re-stored document sheets to thereby distinguish between the two. Upon one circulation of all the document sheets D, the actuator member 60 reaches the top position indicated by two-dot chain line.

The actuator member 60 that has reached the top position is subject to a detection of exposed state by a document one-circulation detector S1 comprising, for example, a light-emitting device or a combination of light-emitting devices within the document storage 2, where the actuator member 60 generates a detection signal showing that one circulation has been completed. With this detection signal, the operation on the copying machine body 100 side such as effecting copying operation to a number of copies desired by the operator is controlled. Thereafter, the actuator member 60 is driven to rotate 180° by an actuator-member drive motor M1, thus being returned to the lower-side position with respect to the document sheets D (original position).

Referring again to FIG. 1, in an upper portion inside the body 100 of the copying machine, there is provided exposure means 149 for exposing to light the surface of a document sheet through a slit, including a light source 150, reflectors 151*a*, 151*b*, 151*c*, 151*d*, and a zoom lens 152. In this exposure means 149, when a light-source beam of light from the light source 150 is applied to the document surface of a document sheet D, its reflected light showing a document image passes through the reflectors 151*a* to 151*d* and the lens 152, forming an image at an exposure region 130 of the photoconductor 101.

The exposure means 149 performs the reading exposure process in a stopped state at the first reading position 20 just below the first support cylinder 5 and the second reading position 21 just below the second support cylinder 6, responsive to the conveyance of the document sheet D at a conveyance speed based on the copying scaling factor in the document handler 1. Also, in a case where a book or the like is placed at the third reading position 105, a first mobile member 71 having the light source 150 and the reflector 151*a* performs the reading exposure process while scanning the third reading position 105. These two processes of read exposure are accomplished by driving the exposure means 149 with a drive motor M13. The position of the exposure means 149 can be detected by sensors S8, S7, and S9.

As the photoconductor 101 is driven into clockwise rotation at a constant speed, the photoconductor 101 is electrically charged first by a corona discharger 102 for charging. The reflected light that has passed through the exposure means 149 at the exposure region 130 forms an image on the charged photoconductor 101, where an electrostatic latent image corresponding to the read document image is formed. The resulting electrostatic latent image is developed into a toner image by the developing unit 103. This toner image is transferred to a recording sheet P fed to the photoconductor 101 as described later, in a transfer region 129 by a corona discharger 131 serving for transfer. The recording sheet P after the transfer is conveyed to the fixing unit 104 by conveyor means 132, where the recording sheet P is subject to a fixing process.

In addition, after the transfer process in the transfer region 129, the toner remaining on the photoconductor 101 is removed by a cleaning unit 133 placed downstream of the transfer region 129 in the direction of rotation of the photoconductor 101. Thereafter, residual charges on the photoconductor 101 are dissipated by an eraser 134, and subsequently the surface of the photoconductor 101 is charged by the charging-use corona discharger 102 to form an electrostatic latent image.

Sheet feeder cassettes 106*a*, 106*b* in which recording sheets P are stored are loaded on one side of the body 100 of the copying machine, while sheet feeder cassettes 106*c*, 106*d* are also loaded in a lower portion of the body 100. The recording sheets P stacked in the sheet feeder cassettes 106*a* to 106*d* are picked up one by one in an order starting with the one located uppermost, and then fed to sheet feed paths 108*a* to 108*d*. This sheet-feeding operation is carried out by sheet feed rollers 109*a* to 109*d*, which are disposed at the top surfaces of the sheet feeder cassettes 106*a* to 106*d*, being rotationally driven by a sheet-feed drive motor M8. On the sheet feed paths 108*a* to 108*d* and a sheet feed path 115 derived from a later-described intermediate tray 113, are provided sheet conveyor rollers 107*a* to 107*e*, which are rotationally driven by a drive motor M9 so that the recording sheets P are fed to the copying-process sections described above.

The recording sheets P fed and conveyed from the sheet feeder cassettes 106*a*, 106*b* and the intermediate tray 113 are controlled in the timing of their conveyance to the photoconductor 101 by third register rollers 160*a*, 160*b* (hereinafter, indicated by reference numeral 160 for generic reference), which are located on the way of conveyance paths to the photoconductor 101. That is, when the conveyance-front end portion of the recording sheet P conveyed to the photoconductor 101 has reached between the third register rollers 160*a*, 160*b*, the recording sheet P is temporarily stopped from conveyance.

In the case where the reading exposure of one surface of the document sheet D is done at the first reading position 20, the first register rollers 19*a*, 19*b* within the document handler 1 operate as register rollers that control the conveyance of the document sheet D, while the second register rollers 59*a*, 59*b* operate simply as conveyor rollers. After a temporary stop of the document sheet D at the first register rollers 19*a*, 19*b* or a temporary stop of the recording sheet P at the third register rollers 160*a*, 160*b*, for example, the first register rollers 19*a*, 19*b* are driven to rotate so that the document sheet D is started to be conveyed and then, after the lapse of a predetermined set time period, the third register rollers 160*a*, 160*b* are driven to rotate so that the recording sheet P is started to be conveyed.

This set time is set to a time period that results from subtracting the time which elapses since the recording sheet P is started to be conveyed from the third register rollers 160*a*, 160*b* until its conveyance-front end portion reaches the transfer region 129, from the time which elapses since the document sheet D is started to be conveyed by the first register rollers 19*a*, 19*b* and then exposed and read at the first reading position 20 as described before until the travel-downstream-side end portion of the toner image formed on the photoconductor 101 in correspondence to the document image reaches the transfer region 129. The resulting set time is counted, for example, by a timer or the like in the control unit. Therefore, alignment of the transferred image with respect to the recording sheet P can be reliably accomplished by attaining synchronization as described above.

Also, in the case where the reading exposure of the other surface of the document sheet D is done at the second reading position 21, the first register rollers 19*a*, 19*b* operate simply as register rollers, while the second register rollers 59*a*, 59*b* operate as register rollers. The relationship between the timing at which the document sheet D is conveyed by the second register rollers 59*a*, 59*b* and the timing at which the recording sheet P is conveyed by the third register rollers 160*a*, 160*b* is set in the same manner as the relationship of synchronization between the first register rollers 19*a*, 19*b* and the third register rollers 160*a*, 160*b*. In addition, the rotation/stop control of the third register rollers 160*a*, 160*b* as described above is implemented by the on/off control of a recording-sheet conveyance clutch intervened against drive motors.

On the other side face of the body 100 of the copying machine, is disposed an ejection tray 110. This ejection tray 110 is equipped with a solenoid SOL8. When the solenoid SOL8 is energized for a specified time period, the ejection tray 110 is operated to shift forward of the drawing sheet of FIG. 1. When the solenoid SOL8 is de-energized for a specified time period, the ejection tray 110 is operated to shift rearward of the drawing sheet. As a result, the ejection tray 110 is enabled to receive a plurality of sets of recording sheets to which a plurality of document sheets have been copied, as the sets of recording sheets have been grouped.

In the body 100, are provided an ejection path 111 for ejecting to the ejection tray 110 the recording sheet P that has passed the fixing unit 104 over the copying process, and a recording-sheet front-rear reversal path 112 that has been branched from the ejection path 111. The recording sheet P, which has passed the copying process and the fixing unit 104 and one surface of which has undergone a copying corresponding to the document image, is ejected to the ejection tray 110 according to a copying mode desired by the operator and in the following three modes of (1) to (3):

(1) The recording sheet P passes through the ejection path 111 as it is, and is ejected to the ejection path 111.

(2) After directed toward the ejection path 111, the recording sheet P is switched back at the recording-sheet front-rear reversal path 112 for a copying process on the other surface of the recording sheet P, and then temporarily stored in the intermediate tray 113 for the conveyance to the copying process once again. Recording sheets P stacked on the intermediate tray 113 are fed, in an order starting with the lowermost-located one, to the copying process section via the conveyance path 115 by a sheet feed means 114 rotationally driven by a motor M14, passing through the fixing unit 104, and through the ejection path 111, being ejected to the election tray 110.

(3) After directed toward the ejection path 111, the recording sheet P is reversed in the recording-sheet front-rear reversal path 112 and then ejected to the ejection tray 110 through the ejection path 111.

In order to enable the above three kinds of conveying operation of recording sheets P, the recording-sheet front-rear reversal path 112 comprises paths 112*a*, 112*b* branched from two positions of the ejection path 111, a path 112*c* at which these paths 112*a*, 112*b* join together, and a path 112*d* branched from the path 112*c* and directed toward the intermediate tray 113. A first direction-switching claw 115 is disposed at the site where the path 112*a* is branched from the ejection path 111, a second direction-switching claw 116 is disposed at the site where the path 112*a* and the path 112*b* join together, and a third direction-switching claw 117 is disposed at the site where the path 112*c* and the path 112*d* are branched from each other. These first to third direction-switching claws 115 to 117 are actuated by solenoids by which a conveyance path for recording sheets P is selected according to a copying mode desired by the operator.

Rollers 118*a*, 118*b*, 118*c* are disposed in proximity to the site where the path 112*a* and the path 112*b* join together, and rollers 119*a*, 119*b*, 119*c* are disposed in proximity to the site where the path 112*c* and the path 112*d* are branched from each other, the rollers each serving to convey the recording sheet P. Also, a reversal roller 120 is disposed on the path 112*c* in proximity to the site where the path 112*a* and the path 112*b* join together, the reversal roller 120 being rotated forward and reverse by an unshown drive motor M11 so as to reverse the direction in which the recording sheet P is conveyed. A reversal roller 121 is disposed below the site where the path 112*c* and the path 112*d* are branched from each other, the reversal roller 121 being rotated forward and reverse by an unshown drive motor M12. Further, an ejection sensor S13 is disposed in proximity to the outlet of the ejection path 111, recording-sheet reversal sensors S14, S15 are disposed in proximity to the inlet of the path 112*a* and on the path 112*c*, and besides an intermediate-tray inlet sensor S is disposed in proximity to the outlet of the path 112*d*.

With the above configuration of the recording-sheet front-rear reversal path 112, in the case of the ejection mode (1), the path 112*a* is closed for the ejection path 111 by the first direction-switching claw 115, so that the recording sheet P is ejected along the ejection path 111. In the case of mode (2), the ejection path 111 is closed by the first direction-switching claw 115 so that the recording sheet P is led into the path 112*a*, the path 112*c* is opened by the second direction-switching claw 116, and the direction of conveyance is reversed by the reversal roller 121 on the path 112*c*. Thereafter, the path 112*d* is opened by the third direction-switching claw 117, so that the recording sheet P is led out to the intermediate tray 113. In the case of mode (3), after the recording sheet P is led into the path 112*c* as described above, the direction of conveyance is reversed by the reversal roller 120, the path 112*a* is closed by the second direction-switching claw 116, while the path 112*b* is opened so that the recording sheet P is led out from the path 112*b* to the ejection path 111.

In the present copying machine, in order to detect the conveyance state of the recording sheet P at the individual sites shown in FIG. 1, there are provided a recording-sheet feed sensor S10, a recording-sheet pre-transfer sensor S11, a post-fixing sensor S12, an in-intermediate-tray sheet's presence/absence sensor S17, an intermediate-tray sheet feed sensor S18, and the like.

The copying machine equipped with the above-described recirculative automatic document handler 1 is enabled to freely carry out a copying process by circulating the document sheet to any plurality of times in any of the modes including: (A) one-sided document to one-sided copy with the result of a plurality of grouped sets; (B) one-sided document to double-sided copy with the result of a plurality of grouped sets; (C) double-sided document to one-sided copy with the result of a plurality of grouped sets; and (D) double-sided document to double-sided copy with the result of a plurality of grouped sets, whichever it is depending on the copying mode desired by the operator.

Also, depending on the copying mode desired by the operator, the copying of a plurality of sheets may be done during one circulation of a document sheet by effecting the reading and exposure process with the document sheet kept wound around the support cylinder to a plurality of times.

Further, the register rollers 19*a*, 19*b*, 59*a*, 59*b*, the individual conveyor rollers and the like provided at the support cylinders 5, 6 and on the way of conveyance before and after the support cylinders 5, 6, respectively, are controlled in their rotational speed based on a set scaling factor for copying, by which the scaling factor of the document image to be read onto the photoconductor 101 that is rotationally driven at a constant speed is restricted. Thus, it is enabled to copy the document image to the recording sheet at a desired size out of the real-size mode, the scale-down mode, and the scale-up mode. In more detail, with the conveyance speed of the document sheet D to the reading positions 20, 21 in the real-size mode used as the reference, in the scale-down mode, the support cylinders 5, 6 and the register rollers and the like are controlled so that their rotational speed is sped up responsive to the scaling-down factor, where the conveyance speed at which the document sheet D is conveyed through the reading positions 20, 21 is sped up. By contrast, in the scale-up mode, the support cylinders 5, 6 and the register rollers and the like are controlled so that their rotational speed is slowed down responsive to the scaling-up factor, where the conveyance speed at which the document sheet D is conveyed through the reading positions 20, 21 is slowed down.

Out of the various copying modes, in the copying mode of (B) one-sided document to double-sided copy, since the control method differs depending on whether the number of document sheets is odd or even, the operation of counting the document sheets D is effected beforehand prior to the copying operation in the copying mode, where it is determined whether the number of document sheets is odd or even. In this embodiment, the counting operation is automatically carried out by the recirculative document handler 1.

More specifically, document sheets D that have previously been stacked and placed for copying in the document storage 2 are fed successively to the conveyance paths. Then, the register rollers 19*a*, 19*b*, 59*a*, 59*b* are made to serve simply as conveyor rollers, and the document sheets D, passing through the first support cylinder 5, the document reversal means 8, and further the second support cylinder 6, are thus re-stored in the document storage 2 by the conveyor belt 11. In this way, all the document sheets D that had been placed on the document storage 2 are circulated to one cycle along the conveyance paths, where the number of conveyed document sheets D can be counted by either one of the optical sensors S2 to S6 disposed in proximity to the conveyance paths. The one circulation of all the document sheets is detected by the document one-circulation detector S1.

Figure 3:
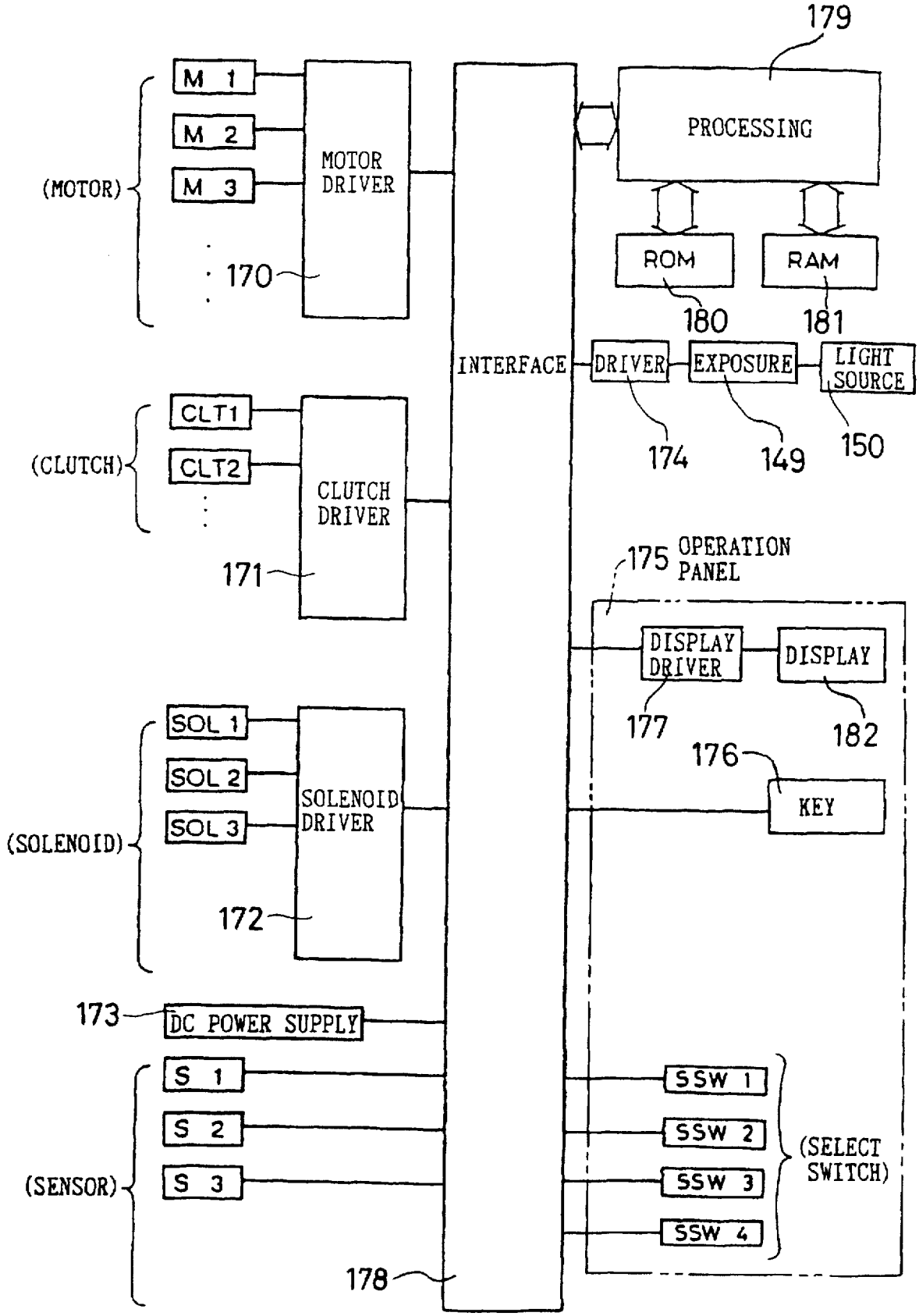
FIG. 3 is a block diagram showing the electrical configuration of a control unit that controls a copying machine 100 and the recirculative document handler 1.

FIG. 3 is a block diagram showing the electrical configuration of a control unit that controls the copying machine 100 and the document handler 1. The motors M1, M2, M3, . . . etc. that operate the conveyor rollers, the support cylinders and the like are connected to a motor drive circuit 170. The clutches CLT1, CLT2, CLT3, . . . etc. that are used for synchronization between a document sheet D conveyed within the document handler 1 and a recording sheet P conveyed within the body 100 of the copying machine are connected to a clutch drive circuit 171. The solenoids SOL1, SOL2, . . . etc. that actuate the direction switching claw 31, 35 and the like on the conveyance paths are connected to a solenoid drive circuit 172.

These drive circuits 170 to 172 are connected to an interface circuit 178 together with DC power supply 173, the sensors S1, S2, S3, . . . etc. for detecting the conveyance state of document sheets D and recording sheets P, an optical-system drive circuit 174, the input operation key 176 on the operation panel 175 provided on the body 100 of the copying machine, a display drive circuit 177 for driving the display unit on the operation panel 175, and the like.

The interface circuit 178 is connected to a processing circuit 179 implemented by a microcomputer or the like, and serves for transmitting sensing signals from the sensors to the processing circuit 179 and for feeding control signals derived from the processing circuit 179 to the various motor drive circuits 170, 171, 172, 174, 177. To the processing circuit 179, are connected a read-only memory (ROM) 180 and a random-access memory (RAM) 181. The processing circuit 179 performs the control of copying operation according to control programs that have previously been stored in the memory 180. The memory 181 is used, for example, as computing areas for counters, timers, flags, and others required for the control of copying operation.

The interface circuit 178 moves the exposure means 149 via the optical-system drive circuit 174 to control the turn-on/off and lighting level of the light source 150 at the individual reading positions 20, 21, 105. Further, the interface circuit 178 transmits the signal derived from the input operation key 176 on the operation panel 175 to the processing circuit 179, and makes information on the progress of the copying operation and the like displayed by the display means 182 provided on the operation panel 175 via the display drive circuit 177. Part of the input operation key 176 allows the operator to set a scaling factor and the like.

Furthermore, to the interface circuit 178, are connected selector switches SSW1 to SSW4 for selecting a copying mode, as part of the operation panel 175. Available copying modes include the modes of one-sided document to one-sided copy, one-sided document to double-sided copy, double-sided document to one-sided copy, double-sided document to double-sided copy, and the like.

The processing circuit 179, which is control means, controls the rotational speeds of the support cylinders 5, 6 for conveying the document sheets D in the recirculative document handler 1 and of the motors M3 to M6 for driving the conveyor rollers, based on the scaling factor for copying set by the input operation key 176. Also, from the copying mode selected by the selector switches SSW1 to SSW4, the processing circuit 179 decides whether or not the counting operation is necessary, and performs a control process during the counting operation so that the motors M3 to M6 come to a rotational speed based on the maximum conveyance speed, thus reducing the time spent for idle conveyance of the document sheet D during the counting operation.

The conveyance speed control of the document sheet during the counting operation may be rough, compared with the conveyance speed control of the document sheet during the copying operation. Thus, high speed conveyance is enabled without any new speed control circuit.

Figure 4:
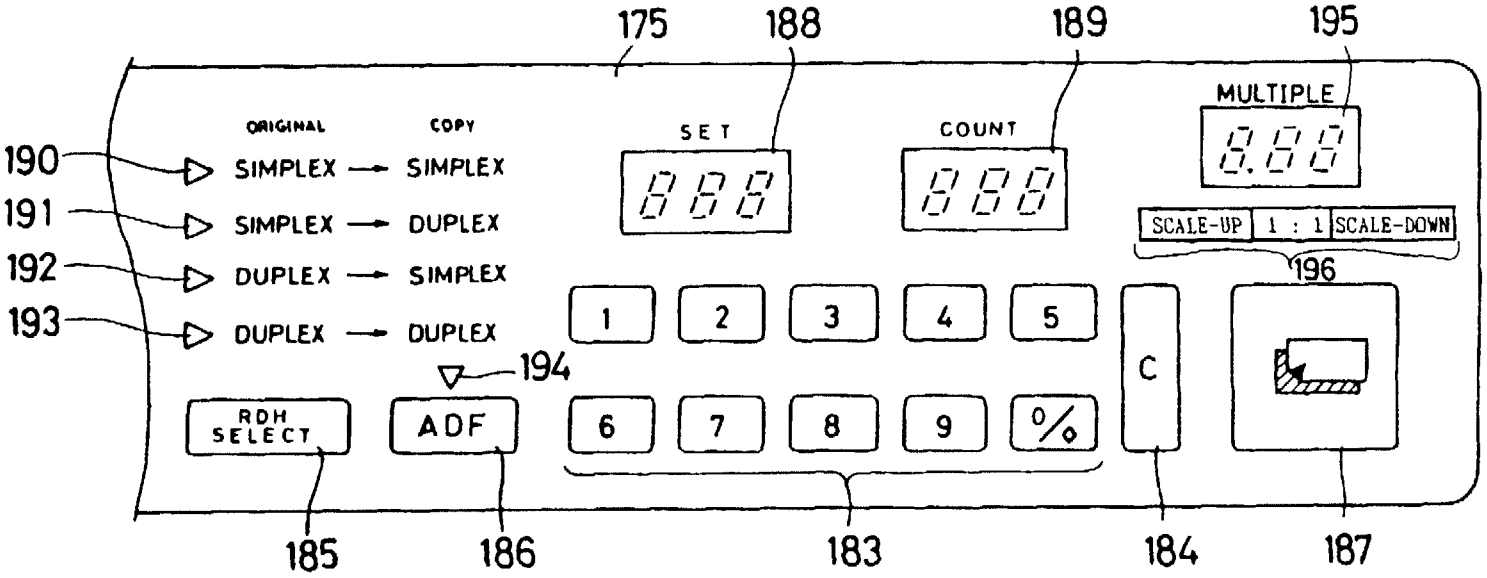
FIG. 4 is a plan view showing part of the configuration of an operation panel 175 such as an input operation key 176 and display means 182.

FIG. 4 is a plan view showing part of the arrangement of the operation panel 175 such as the input operation key 176 and the display means 182. The operation panel 175 has a number-setting key 183 for setting a number of copies or the like, a clear key 184, a select key 185 for setting a copying mode, an ADF key 186 to be operated when the copying is carried out with the document sheet fixed and by moving and scanning the optical system, a print switch 187 for instructing a start of copying operation, a set number-of-copies display 188, a copy-count display 189, copying-mode displays 190 to 193 with the use of the document handler 1, an ADF display 194 for showing the reading-exposure operation state with the optical system driven into travel, a scaling-factor display 195, and a scaling-factor setting key 196 for setting a copying scaling factor.

The copying-mode displays 190 to 193 showing four kinds of copying modes: one-sided document to one-sided copy (simplex-simplex), one-sided document to double-sided copy (simplex-duplex), double-sided document to one-sided copy (duplex-simplex), and double-sided document to double-sided copy (duplex-duplex), respectively. Each time the select key 185 is pressed once, one light-emitting device will light by turns, for example starting with the uppermost, by which a corresponding copying mode is selected. The lowermost position turns back to the uppermost position again, and the initial state returns to the uppermost position, where their corresponding copying modes are selected, respectively. The set number of copies is set by pressing the number-setting key 183 and displayed by the set number-of-copies display 188, which is implemented, for example, by a plurality of 7-segment displays.

In the case of copying in which the document handler 1 is not used, for example, in the case of copying of a bound book or the like, the light-emitting device of the ADF display 194 is lit by pressing the ADF key 186, where a copying mode in which the reading-exposure operation is executed on the original document placed still at the third reading position 105 by driving the exposure means 149 into transverse is selected. In a copying mode selected by the operator, the scaling factor is set to a desired one in the real-size mode, the scale-up mode and the scale-down mode by operating the scaling-factor setting key 196. The set scaling factor is displayed by the scaling-factor display 195.

When the copying operation is started by the print switch 187 being pressed, the number of copies achieved is displayed by turns in the copy-count display 189. Upon coincidence of the set number of copies displayed in the set number-of-copies display 188 with the copy count, the copying operation stops, where the display of the set number of copies automatically returns to a "0" display. The display of the copy count is maintained, for example, until the print switch 187 is pressed next.

FIGS. 5 to 8 are schematic sectional views for explaining a double-side copying operation of a double-sided document sheet, showing an operation in which two document sheets Da, Db are copied on their double sides. Hereinafter, for the description of the front surface of a document sheet D, a subscript "a" represents the first document sheet, and a subscript "b" represents the second document sheet. Also the subscripts of numerals 1 to 4 represent page numbers of the stacked document sheets D; for example, the first page of the first document is designated Da1. Similarly, also for the description of the front surface of the recording sheet P, subscripts "a", "b" and subscripts 1 to 4 are used. Those having the same subscript in the reference numerals of the document sheet D and the recording sheet P have a relationship between a front surface of the document sheet D to be read and a front surface of the recording sheet P onto which the front surface of the document sheet D to be read has been copied.

For convenience's sake, in the drawings, a numeral representing the page number is given to the surface of each document sheet D, and in particular, a whitened triangular symbol is given to the surface of an odd page. Also, in each recording sheet P, a numeral representing the surface of the read document sheet is given to the surface that is over the copying, and in particular, a blackened triangular symbol is given to the surface of an odd page. Further, for a generic description of the document sheet D and the recording sheet P, the subscripts are omitted.

Figure 5A:
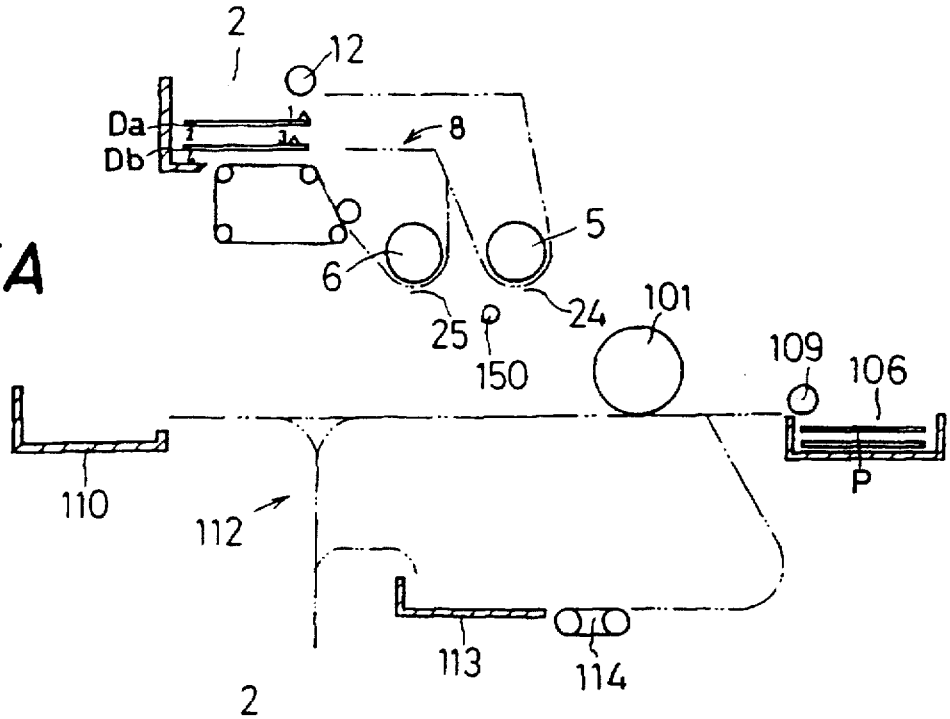
FIG. 5A, 5B are schematic sectional views for explaining a double-side copying operation of a double-sided document sheet.

Document sheets D are stacked in the document storage 2 for double-side copying, in such an order that the page number increases sequentially from top to bottom, as shown in FIG. 5 (A). Also, recording sheets P are stacked and stored in the cassette 106.

Figure 5B:
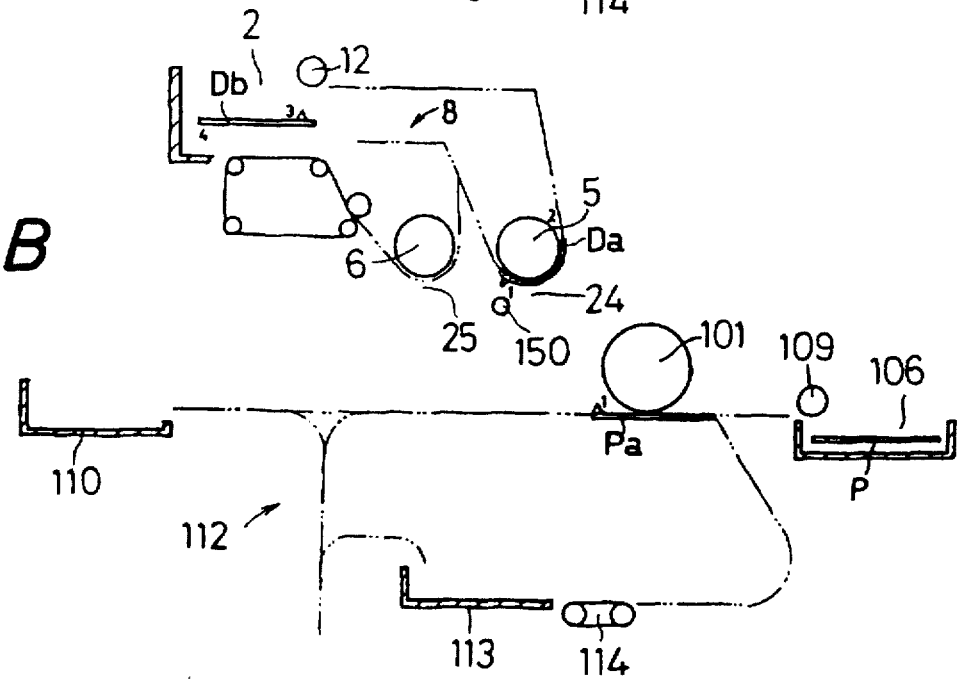

When the double-sided copying process is started, the document sheet Da located uppermost of the document sheets D stacked in the document storage 2 is conveyed to a first reading region 24, as shown in FIG. 5(B), where the first page Da1 is read and copied to one surface Pa1 of the first recording sheet Pa.

Figure 6A:
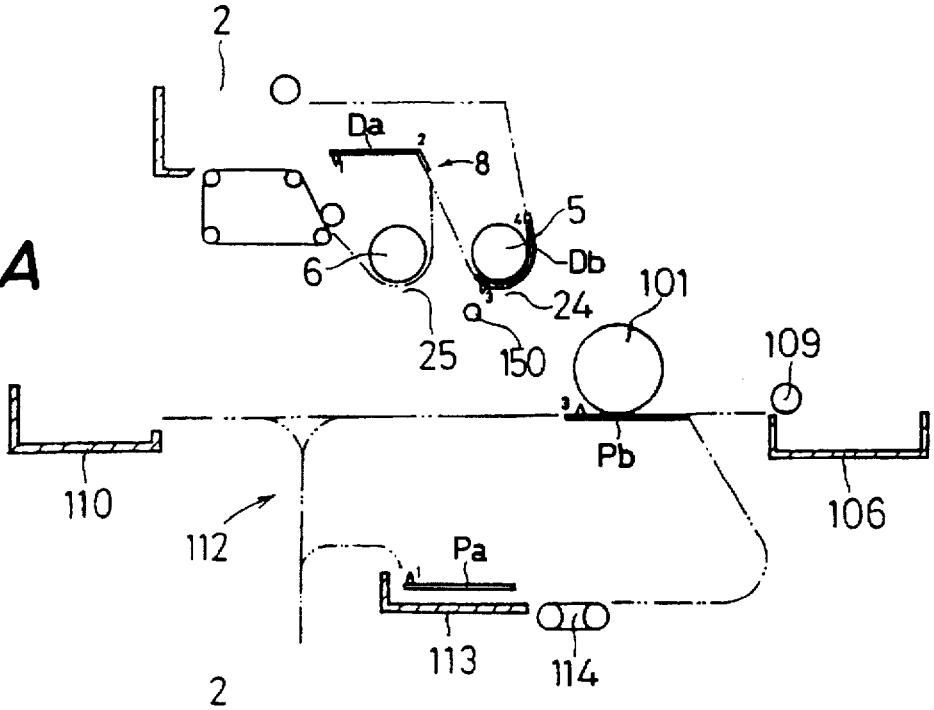
FIGS. 6A, 6B are schematic sectional views for explaining a double-side copying operation of a double-sided document sheet.

The first document sheet Da, whose first page Da1 has been read in the first reading region 24, is conveyed to the document reversal means 8, as shown in FIG. 6(A). Subsequently, the second document sheet Db is conveyed to the first reading region 24, where a copying operation to one surface Pb3 of the second recording sheet Pb is executed.

Figure 6B:
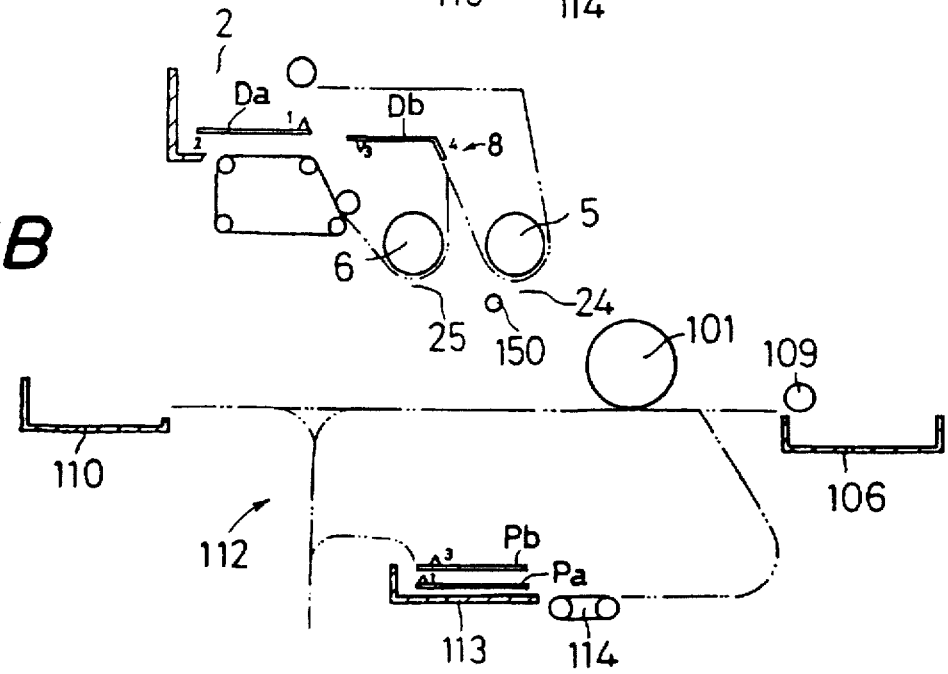

The document sheets Da, Db, one-side surfaces of which have been read in the first reading region 24, pass through a second reading region 25 via the document reversal means 8 without being read, as shown in FIG. 6 (B), thus being temporarily returned to the document storage 2. The recording sheets Pa, Pb, which are over the copying onto their one-side surfaces, are conveyed to and stacked on the intermediate tray 113 via the recording-sheet reversal means 112. The operations mentioned up to this point complete the one-side copying of the document sheets Da, Db.

Figure 7A:
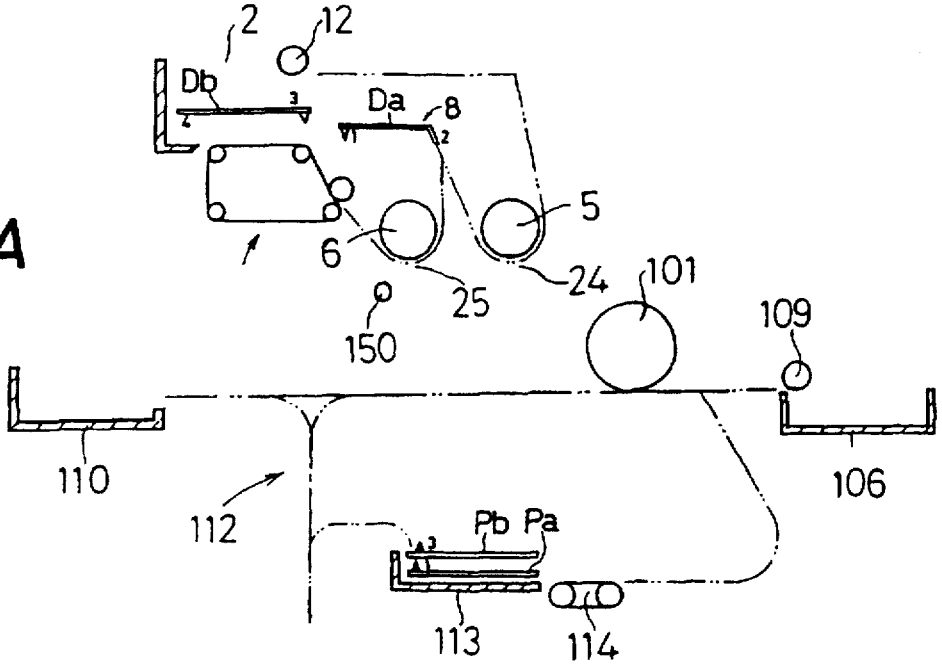
FIGS. 7A, 7B are schematic sectional views for explaining a double-side copying operation of a double-sided document sheet.
Figure 7B:
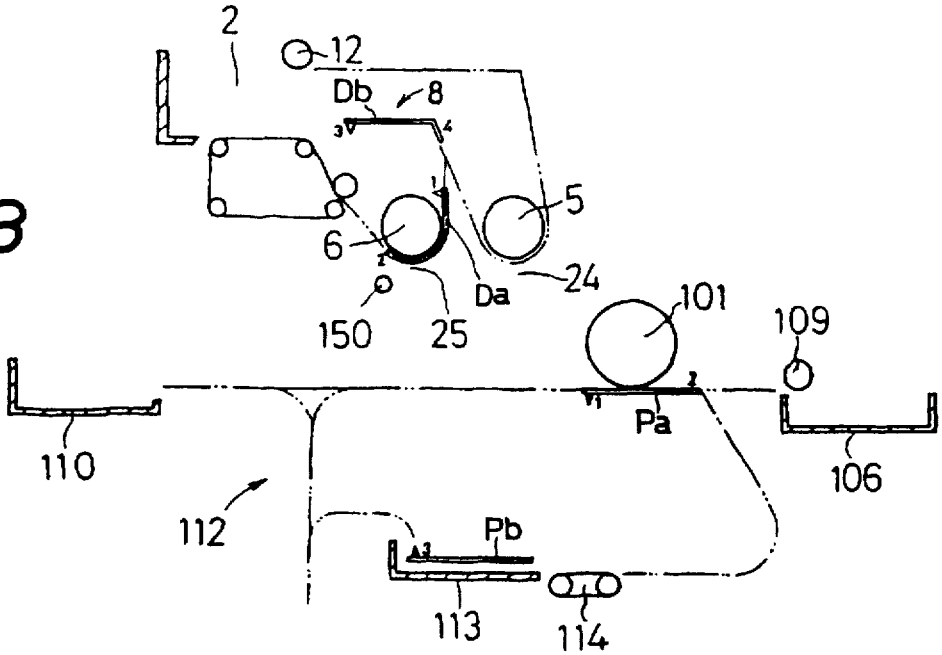

Subsequently, for the copying of the other surface that has not been copied yet, the document sheets Da, Db are conveyed to the reading regions once more. The first document sheet Da re-fed from the document storage 2 passes through the first reading region 24 without being read, as shown in FIG. 7(A), and is conveyed to the document reversal means 8. Thereafter, as shown in FIG. 7(B), the second page Da2 of the first document sheet Da that has not been read yet is read at the second reading region 25, and copied to the uncopied other surface Pa2 of the first recording sheet Pa, which has been fed from the lowermost position out of the recording sheets P stacked on the intermediate tray 113.

Figure 8A:
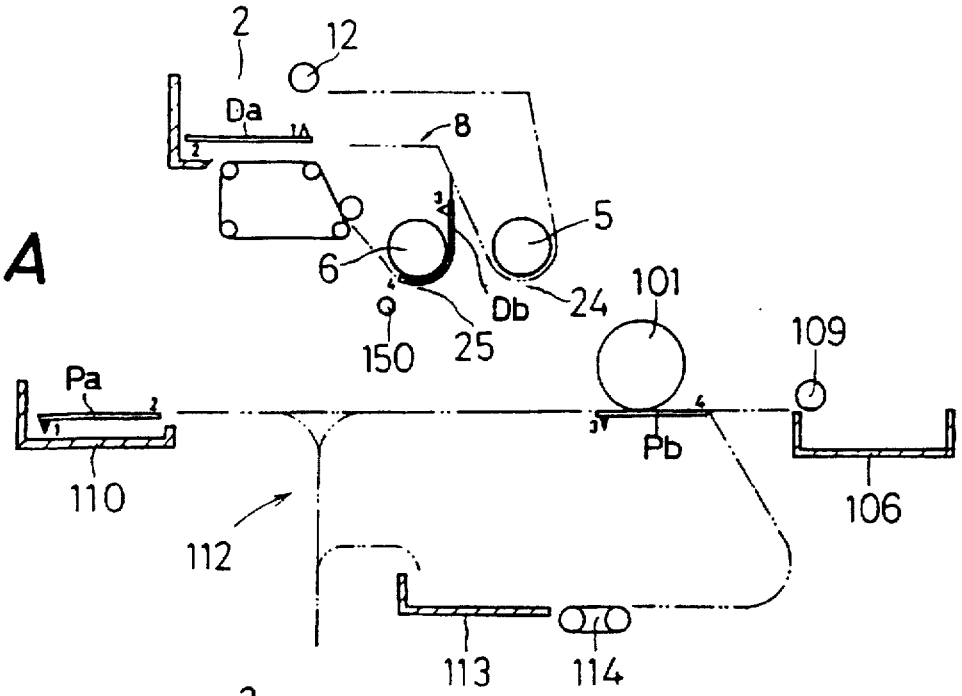
FIGS. 8A, 8B are schematic sectional views for explaining a double-side copying operation of a double-sided document sheet.
Figure 8B:
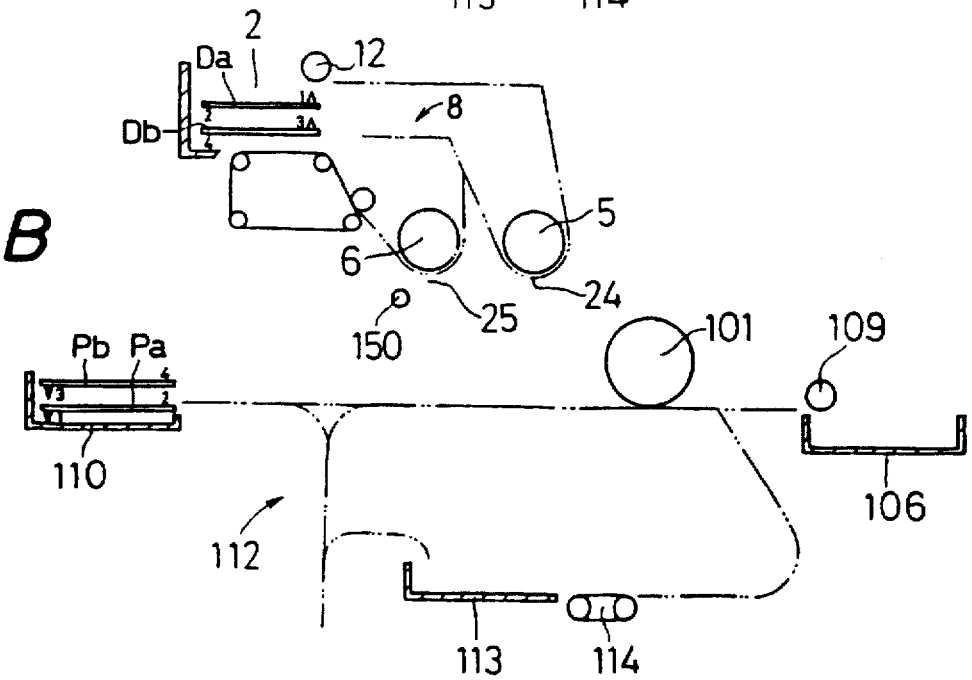

Also, as to the second document sheet Db, as shown in FIGS. 8(A) and 8(B), its fourth page Db4 that has not been read yet is read at the second reading region 25, and copied to the uncopied other surface Pb4 of the second recording sheet Pb fed from the intermediate tray 113. Thereafter, the document sheets Da, Db are returned to and stored in the document storage 2, while the recording sheets Pa, Pb are ejected to the ejection tray 110.

Figure 9:
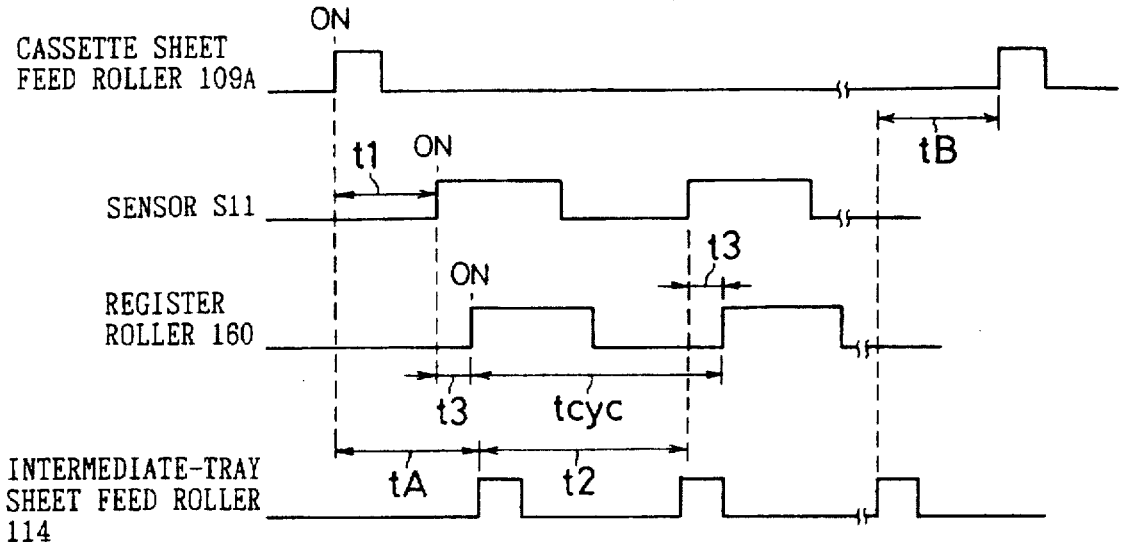
FIG. 9 is a timing chart for a switching of a recording-sheet storage means which is a first embodiment of the invention.

FIG. 9 is a timing chart for a switching of the recording-sheet storage means which is a first embodiment of the invention. In this case, as an example, a switching between the cassette 106*a* and the intermediate tray 113. The timing at which the sheet feed roller 109*a* is driven to feed to the conveyance path the recording sheet P stored in the cassette 106*a* as well as the timing at which the sheet feed roller 114 is driven to feed to the conveyance path the recording sheet held in the intermediate tray 113 are so selected that the register roller 160 driven in synchronization with the image-reading timing can be driven at a constant cycle time, i.e., driven at the same cycle time as a rotational cycle "tcyc" of the photoconductor 101, which is the copying cycle in the case of continuous copying. The cycle "tcyc" is, for example, 1 sec for equipment capable of 60 cpm (60 copies per minute).

More specifically, if the time from when the sheet feed roller 109*a* has turned on until when the sensor S11 turns on is t1, if the time from when the sensor S11 has turned on until when the register roller 160 turns on is t3, and if the time from when the sheet feed roller 114 has turned on until when the sensor S11 turns on is t2, then the set value tA for switching over from the cassette 106*a* to the intermediate tray 113, i.e., the time from when the sheet feed roller 109*a* has turned on until when the sheet feed roller 114 turns on, and the time from when the set value tB for switching over from the intermediate tray 113 to the cassette 106*a*, i.e., the time when the sheet feed roller 114 has turned on until when the sheet feed roller 109*a* turns on can be expressed as:

$$tA=(t1+tcyc)-t2$$

$$tB=(t2+tcyc)-t1$$

where the times t1, t2 are of values that depend on the distance from the cassette 106*a* to the sensor S11 and the distance from the intermediate tray 113 to the sensor S11, respectively. Also, the time t3 is of a value that depends on the distance from the sensor S11 to the register roller 160.

Figure 10:
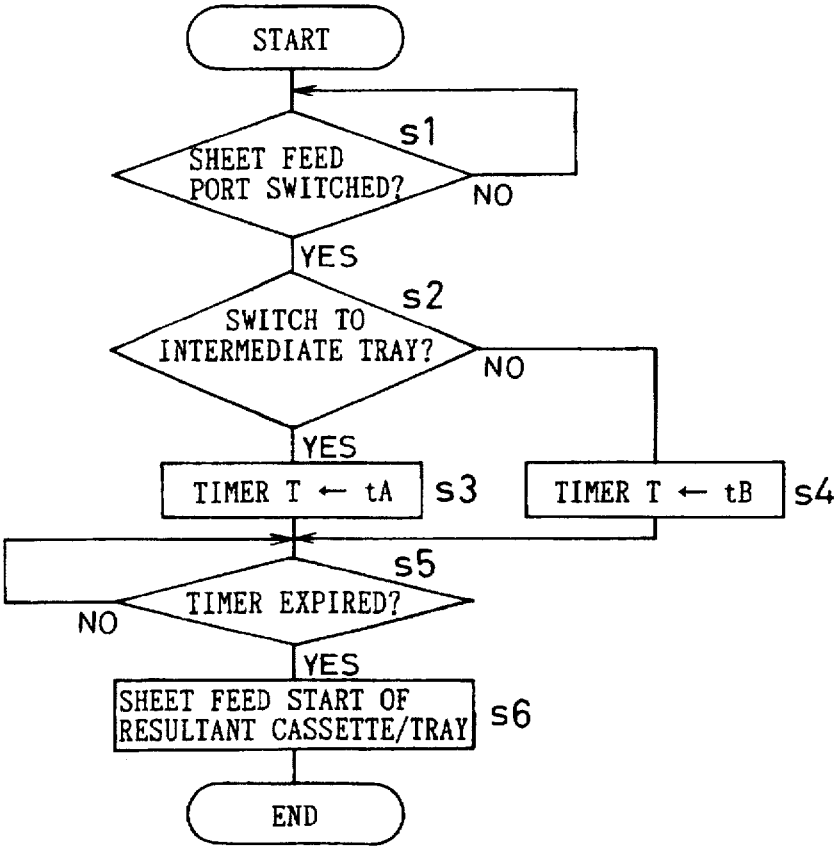
FIG. 10 is a flow chart showing the operation of the first embodiment.

FIG. 10 is a flow chart showing the operation of the first embodiment. At step s1, it is determined whether or not there has arisen a need for switching the sheet feed port. For example, whereas the recording sheet P has been fed from the cassette 106*a*, it is determined whether or not there has arisen a need for switching to the intermediate tray 113 or any of the other cassettes 106*b* to 106*d*. At step s2 after it has been determined that the need of switching has arisen, it is determined whether or not the switching is to the intermediate tray 113. If the switching is to the intermediate tray 113, then the program goes to step s3, where the set value tA is set to a timer T. At step s4 after the switching has been determined to be from the intermediate tray 113 to the cassette 106*a*, other than the switching to the intermediate tray 113, the set value tB is set to the timer T. At step s5 after the operations of steps s3 and s4 have been completed, it is determined whether or not the counting of the set value tA or tB has expired. At step s6 after it has been determined that the counting has expired, the sheet feed roller for the resultant cassette or tray is started to be driven. For example, in a switching from the cassette 106*a* to the intermediate tray 113, the sheet feed roller 114 is started to be driven.

As shown above, according to this embodiment, even when the sheet feed port has been changed over, the timing at which the register roller 160 turns on is maintained constant. More specifically, at a change-over from the cassette 106*a* to the intermediate tray 113, since $$(tA+t2+t3)-(t1+t3)=((t1+tcyc)-t2)+t2+t3-t1-t3=tcyc,$$

the cycle at which the register roller 160 is driven is "tcyc". Likewise, also at a change-over from the intermediate tray 113 to the cassette 106*a*, the cycle at which the register roller 160 is driven results in "tcyc".

In the prior art, it has been practiced that the timing at which the cassette or tray serving as a sheet feeder is switched over is selected at such a timing that sheets in different devices will not interfere with one another, and that the sheet feed roller is turned on with sufficient time intervals. For example, after the register roller 160 has turned on, the sheet feed roller would be turned on after a time lapse of 300 ms. According to this embodiment, even at a switching of the sheet feeder, because the cycle of driving the register roller 160 is held tcyc, the time required for copying can be reduced by about 30%, by which the copying efficiency can be improved to a great extent.

Figure 11:
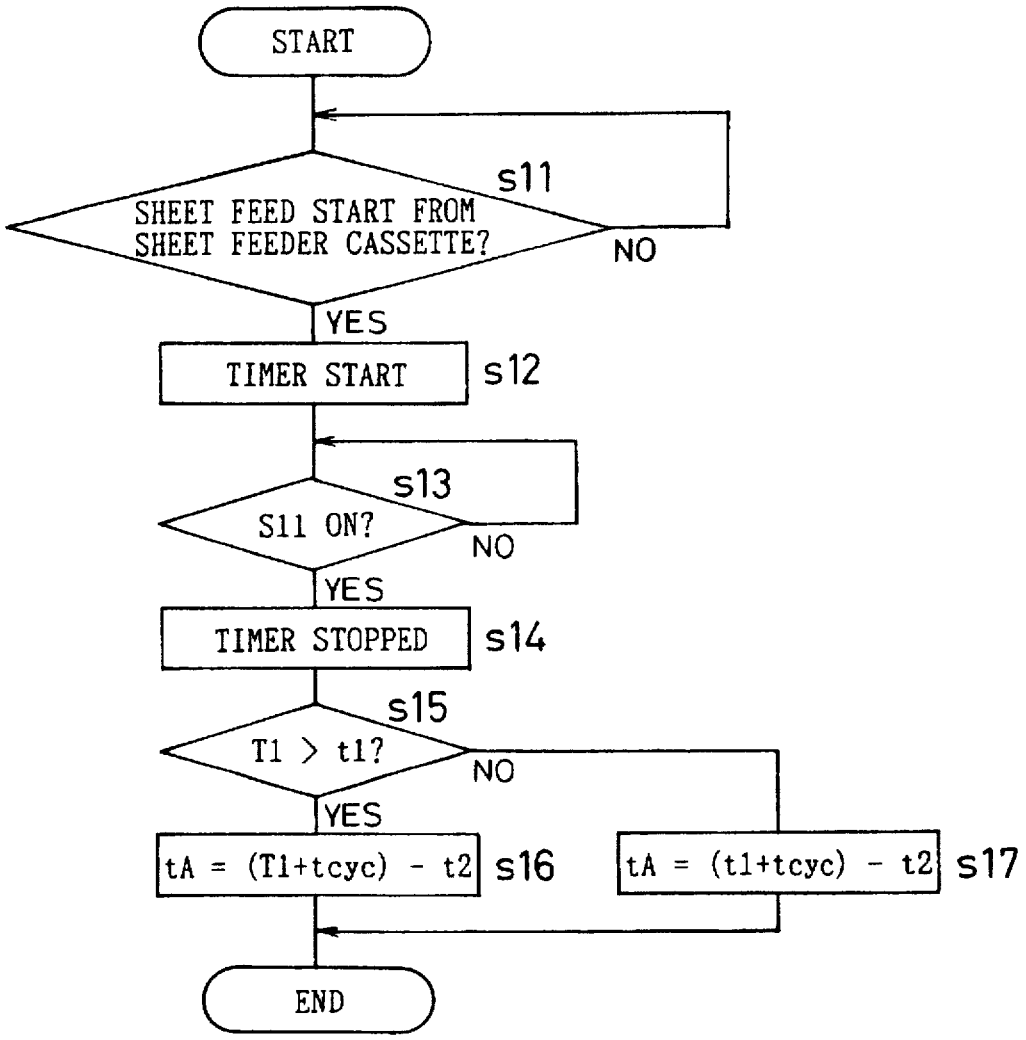
FIG. 11 is a flow chart showing the operation for a switching which is a second embodiment of the invention.

FIG. 11 is a flow chart showing the operation for a switching which is a second embodiment of the invention. The second embodiment is to correct the set values tA, tB set in the first embodiment. Whereas the timing of driving the sheet feed rollers 109*a*, 114 has been controlled with the set values tA, tB, there is a possibility that the conveyance of recording sheets may be delayed to some extent when a slip occurs due to surface characteristics of a fed recording sheet or when the air sheet feeder commonly used for sheet feeding lacks in air pressure or for other reasons. With the conveyance delayed due to such reasons, a shorter gap between sheets would result under the control of the timing of driving the sheet feed rollers that depends only on the set values tA, tB, such that paper jam may occur due to the interference between one recording sheet and another or that there may arise a shift between recording sheet and document sheet at their downstream side end portions in the direction of conveyance due to a mis-detection of the sensor. With a view to solving these disadvantages, in the second embodiment, the time from a time point when a recording sheet has been started to be fed until a time point when the recording sheet arrives at the sensor S11 is monitored, and compared with the time required for conveyance from a predetermined cassette or tray to the sensor S11, where if there has arisen a time shift, the set values tA, tB are corrected.

At step s11, it is determined whether or not a recording sheet has been started to be fed from a selected cassette or tray. At step s12 after it has been determined that the sheet feed has been started from, for example, the cassette 106*a*, the timer T is started to count. At step s13, it is determined whether or not the sensor S11 has turned on. At step s14 after it has been determined that the sensor S11 has turned on, the timer T is stopped from counting. At step s15, a timer count T1 counted by the timer T is compared with the aforementioned time t1. Then, it is determined whether or not T1>t1. If the determination is affirmative, the program goes to step s16, where the set value tA set in the first embodiment is corrected to "tA=(T1+tcyc)−t2". If the determination at step s15 is negative, the program goes to step s17. That is, if it has been determined at step s15 that T1≦t1, then the set value tA is set as "tA=(t1+tcyc)−t2" at step s17, in which case it remains unchanged as set in the first embodiment.

As shown above, according to the second embodiment, paper jam or positional shift caused by retardation of recording sheets due to slips in the actual conveyance of recording sheets, lack of air pressure, and the like can be prevented by correcting the set value tA based on the actual time measurement that has been required for conveyance. Although this embodiment has been described on a case where the set value tA is corrected, the set value tB for the intermediate tray 113 can also be corrected in a similar manner. Furthermore, such an operation will be executed each time a recording sheet is fed. By correcting the set values tA, tB in this way, recording sheets can reliably be fed so that the job efficiency is improved while the copying reliability is improved.

Figure 12:
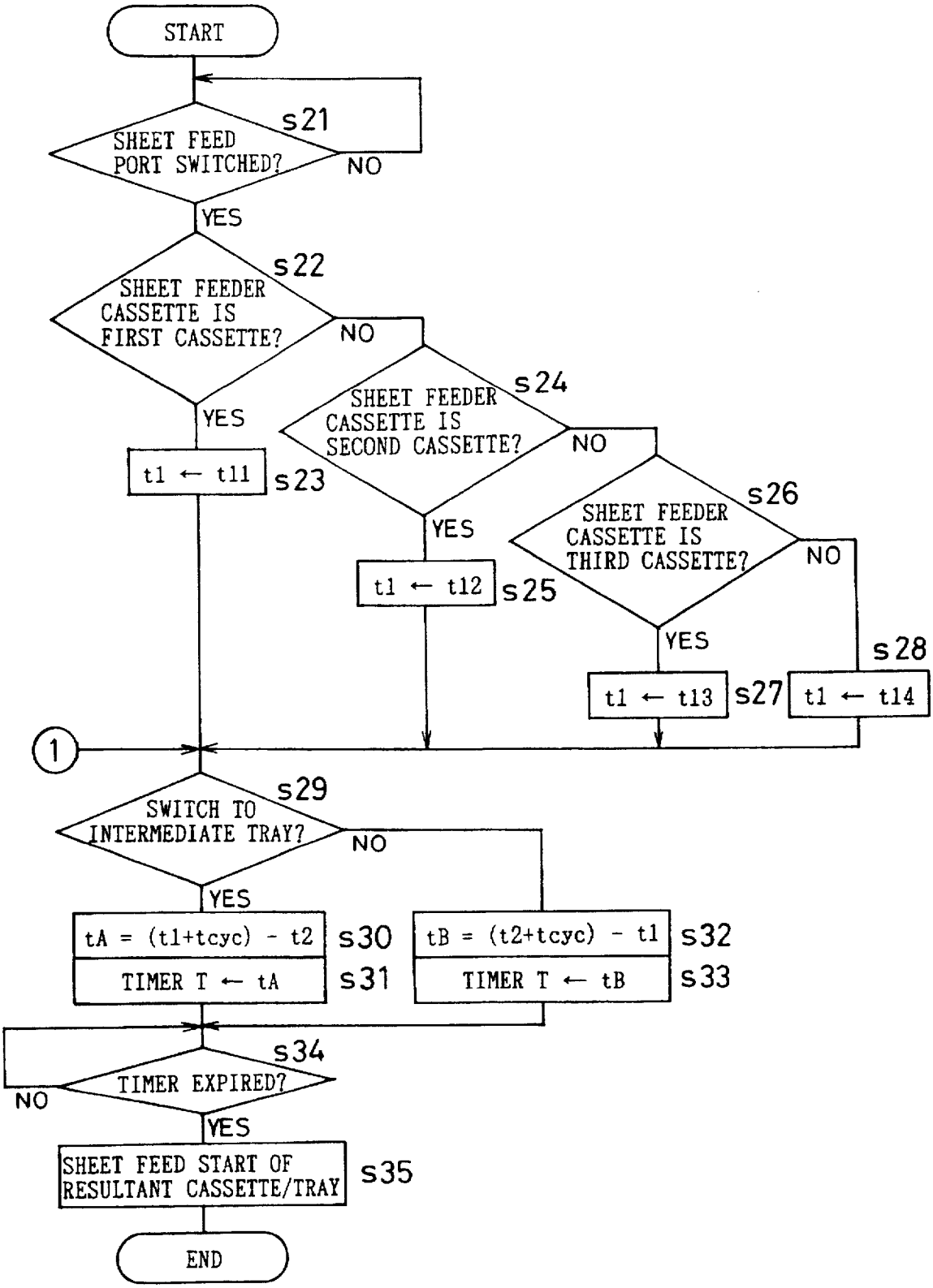
FIG. 12 is a flow chart showing the operation for a switching which is a third embodiment of the invention.

FIG. 12 is a flow chart showing the operation for a switching which is a third embodiment of the invention. The third embodiment, like the second embodiment, is to correct the set values tA, tB set in the first embodiment. More specifically, since the positions of the sheet feeders, i.e., the positions of the cassettes 106*a* to 106*d* and the intermediate tray 113 are set at different positions, respectively, the distance from each cassette or tray to the register roller 160 differs among the sheet feeders so that the time required for recording sheets fed from the respective cassettes and tray to arrive at the register roller 160 also differs among the recording sheets. For this reason, there is a need for changing the aforementioned time t1 for each of the cassettes and tray. In this embodiment, the set values tA, tB are corrected by changing the time t1 for each of the cassettes and tray. With this arrangement, the conveyance of a recording sheet can be started at an optimum timing for each of the cassettes and tray.

At step s21, it is determined whether or not there has arisen a need of switching the sheet feed port. At step s22 after it has been determined that the need of switching has arisen, it is determined whether or not the sheet feed port has been switched to the cassette 106*a*, which is the first cassette. If the sheet feed port has been switched to the cassette 106*a*, then the program goes to step s23, where the time t1 is changed to a time t11. At step s24 after the sheet feed port has been switched to any other than the cassette 106*a*, it is determined whether or not the sheet feed port has been switched to the cassette 106*b*. If the sheet feed port has been switched to the cassette 106*b*, the program goes to step s25, where the time t1 is changed to a time t12. At step s26 after the sheet feed port has been switched to any other than the cassette 106*b*, it is determined whether or not the sheet feed port has been switched to the cassette 106*c*, which is the third cassette. At step s27 after the sheet feed port has been switched to the cassette 106*c*, the time t1 is changed to a time t13. At step s28 after the sheet feed port has been switched to any other than the cassette 106*c*, the sheet feed port has been switched to the cassette 106*d*, which is the fourth cassette, where the time t1 is changed to a time t14.

It is noted that the times t11 through t14 each represent the time required for a recording sheet to be conveyed from the cassettes 106*a* through 106*d* to the sensor S11.

At step s29 after the operations of steps s23, s25, s27 and s28 have been completed, it is determined whether or not the sheet feed port has been switched to the intermediate tray 113. If the change is to the intermediate tray, the program goes to step s30, where the set value tA is set as "tA=(t1+tcyc)−t2 and, at step s31, the set value tA is set to the timer T. If it has been determined at step s29 that the change is other than to the intermediate tray 113, the program goes to step s32, where the set value tB is set as "tB=(t2+tcyc)−t1 and, at step s33, the set value tB is set to the timer T.

At step s34 after the operations of steps s31 and s33 have been completed, it is determined whether or not the counting of the set value tA or tB set to the timer T has expired. At step s35 after it has been determined that the counting has expired, the feeding of a recording sheet from the resultant cassette or tray is started. It is noted that the time t1 used in the steps s30 and s32 is the value changed at the steps s23, s25, s27 and s28.

As shown above, according to this embodiment, optimum set values tA, tB can be determined for each of the cassettes 106*a* through 106*d* and the intermediate tray 113 each serving as a sheet feeder. Therefore, recording sheets can be fed with reliability while a recording sheet can be fed at an optimum timing for any sheet feed port, whichever it is, thus enabling a reliable copying operation to be executed.

Figure 13:
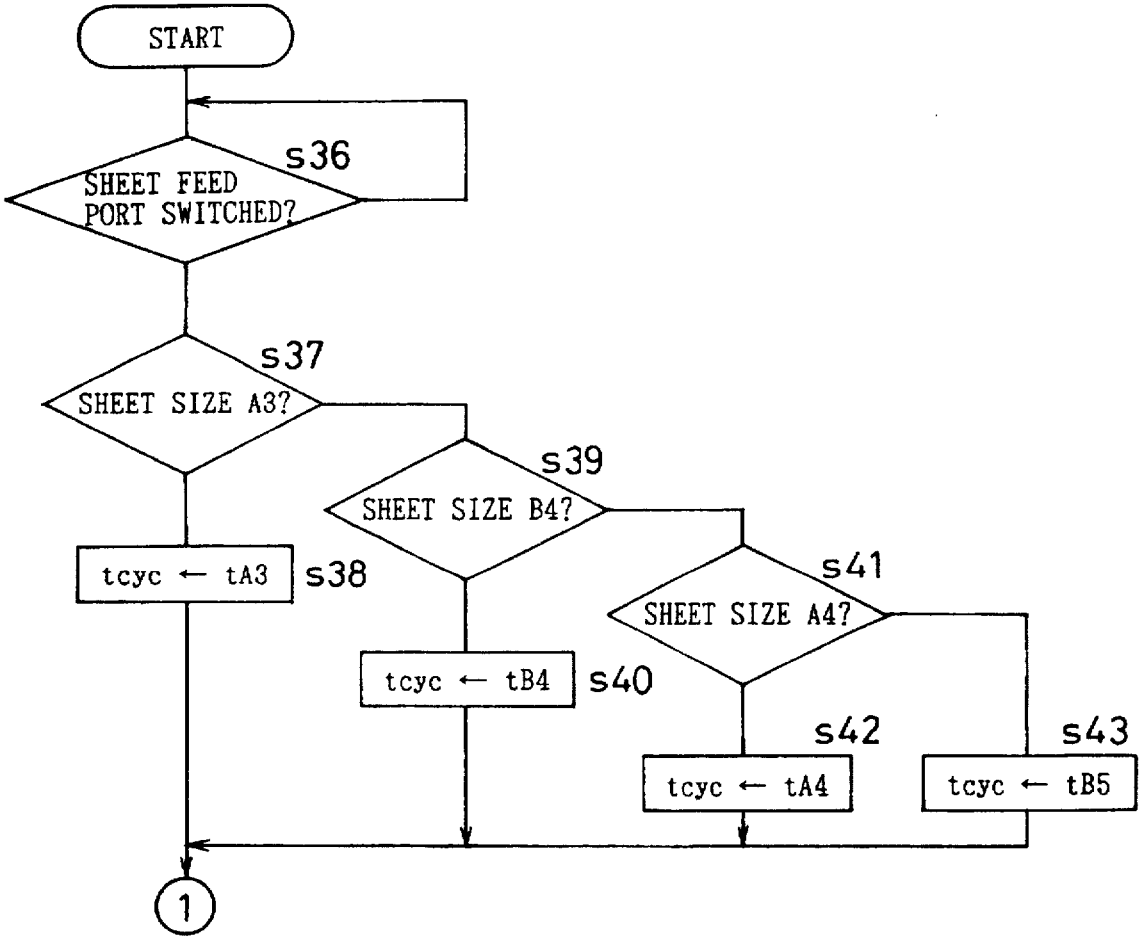
FIG. 13 is a flow chart showing the operation for a switching which is a fourth embodiment of the invention.

FIG. 13 is a flow chart showing the operation for a switching which is a fourth embodiment of the invention. The fourth embodiment, like the second and third embodiments, is to correct the set values tA, tB set in the first embodiment. More specifically, a recording sheet conveyed along a conveyance path is temporarily stopped before the register roller 160. In this state, according to the first embodiment, with different sizes of recording sheets stored in the various cassettes, the position of the conveyance-upstream-side end portion of the recording sheet stopped before the register roller 160 would vary from size to size. Accordingly, when the set values tA, tB have been selected to constant values for all the different sizes of recording sheets, there would arise interference between one recording sheet and another or a shortened gap between recording sheets, posing possibilities of a positional shift of the conveyance-downstream-side end portions between recording sheet and document sheet as well as of paper jam and the like. In this embodiment, these disadvantages are prevented by correcting the set values tA, tB for each of the cassettes and tray.

At step s36, it is determined whether or not there has arisen a need for switching the sheet feed port. At step s37 after it has been determined that the need for switching has arisen, it is determined whether or not the size of the fed recording sheet is, for example, A3 size. At step s38 after the size has been determined to be A3 size, the cycle tcyc is changed to tA3. At step s39 after the size has been determined to be other than A3 size, it is determined whether or not the size of the fed recording sheet is B4 size. At step s40 after the size has been determined to be B4 size, the cycle tcyc is changed to tB4. At step s41 after the size has been determined to be other than B4 size, it is determined whether or not the size of the fed recording sheet is A4 size. At step s42 after the size has been determined to be A4 size, the cycle tcyc is changed to tA4. If the size has been determined to be other than A4 size, the program goes to step s43. This is the case where the size of the fed recording sheet has been determined to be B5 size, and the cycle tcyc is changed to tB5.

It is noted that tA3, tB4, tA4 and tB5 referred to above are predetermined copying cycles for copying to their responsive sizes of recording sheets. Although four sizes of recording sheets are described here as an example, increased numbers of recording sheet sizes, if involved, would be accompanied by setting additional values corresponding to the individual sizes. For example, in the case of a copying of A4 size recording sheets at 60 cpm, the set value tA4 is 1 sec. When the operations of the steps s38, s40, s42 and s43 are completed, the program goes to step s29 already described in the third embodiment, followed by similar operations.

As shown above, according to the fourth embodiment, by correcting the set values tA, tB responsive to each size of fed recording sheets, a recording sheet can be fed at an optimum timing responsive to each size, so that a reliable copying operation can be executed.

Figure 14:
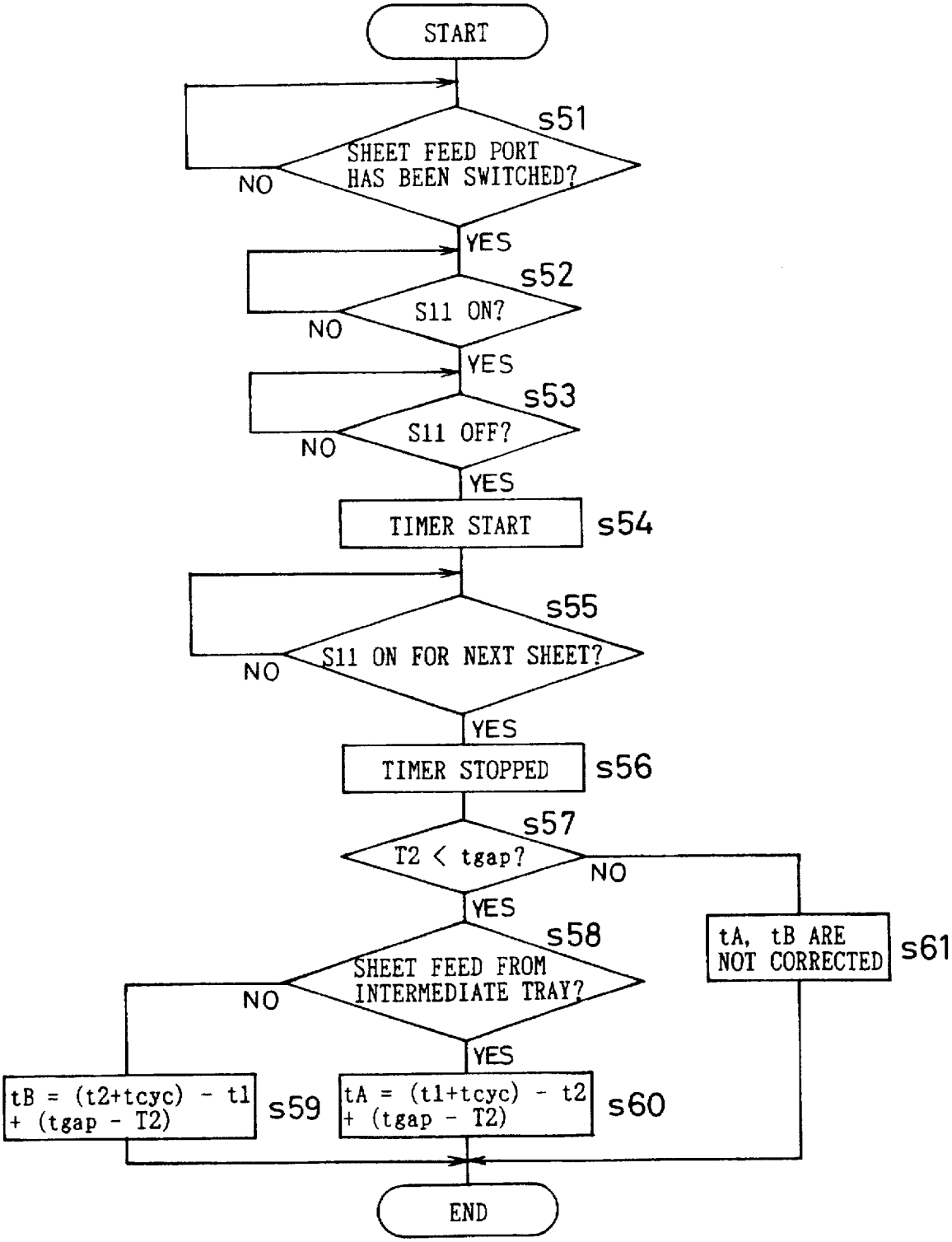
FIG. 14 is a flow chart showing the operation for a switching which is a fifth embodiment of the invention.

FIG. 14 is a flow chart showing the operation for a switching which is a fifth embodiment of the invention. In the foregoing first embodiment, it has been arranged that, for a change of the sheet feeder, sheet feeding is started at a timing at which the counting of the set values tA, tB has expired. In this case, however, there is a possibility that the timing of synchronization between a fed document sheet and the register roller 160 is shifted such that the start to drive the register roller 160 is shifted. When this occurs, the sheet gap between a recording sheet fed after the counting of the set values has expired and a recording sheet fed next would be narrowed such that paper jam may occur due to the interference between one recording sheet and another or that there may arise a shift of the conveyance-downstream-side end portions of recording sheet and document sheet due to a mis-detection of the sensor. In order to eliminate these disadvantages, in the fifth embodiment, the intervals between conveyed recording sheets are measured. That is, the time from a timing when the sensor S11 has turned off until another timing when the sensor S11 turns on next is monitored, and when a shift from a predetermined sheet gap has occurred, the set values tA, tB are corrected.

At step s51, it is determined whether or not the sheet feed port has been switched. At step s52 after it has been determined that the sheet feed port has been switched, it is determined whether or not the sensor S11 has turned on. At step s53 after it has been determined that the sensor S11 has turned on, it is determined whether or not the sensor S11 has turned off. At step s54 after it has been determined that the sensor S11 has turned off, the counting of the timer T is started. At step s55, with the next sheet conveyed, it is determined whether or not the sensor S11 has turned on. At step s56 after it has been determined that the sensor S11 has turned on, the counting of the timer T started at step s54 is stopped. At step s57, it is determined whether or not the counted time T2 is smaller than a predetermined sheet gap tgap. At step s58 after it has been determined that T2<tgap, it is determined whether or not a recording sheet has been fed from the intermediate tray 113. At step s60 after it has been determined so, the set value tA is corrected to "tA=(t1+tcyc)−t2+(tgap−T2)".

At step s59 after it has been determined at step s58 that a recording sheet has not been fed from the intermediate tray 113, the set value tB is corrected to "tB=(t2+tcyc)−t1+(tgap−T2)". At step s61 after it has been determined at step s57 not that T2<tgap, the set values tA, tB are used as they are without being corrected.

In addition, in the case of a copying at 60 cpm and with a sheet feeding speed of 400 mm/s, from a calculation of (400−210)/0.4=475 ms for A4 size recording sheets, the tgap is set by assuming 475 ms as a minimum value.

Through operations of steps s52 and s53, a sheet gap during actual conveyance of recording sheets is obtained. If it has been determined at step s57 that T2<tgap, which means that the sheet gap has been narrowed, (tgap−T2) is added to the tA set in the first embodiment, at step s60, so that the timing of switching to the intermediate tray 113 is delayed. At step s59, (tgap−T2) is added to the tB set in the first embodiment, by which tB is corrected so that the sheet feed from the cassette 106*a* is delayed.

As shown above, according to the fifth embodiment, the set values tA, tB are corrected based on the time actually required for the conveyance of recording sheets. With this arrangement, the possibilities that paper jam occurs due to a narrowed sheet gap to the next fed sheet or that some shift between document sheet and recording sheet is generated can be reduced, so that the recording sheet can reliably be fed and that the reliability of copying is improved.

Figure 15:
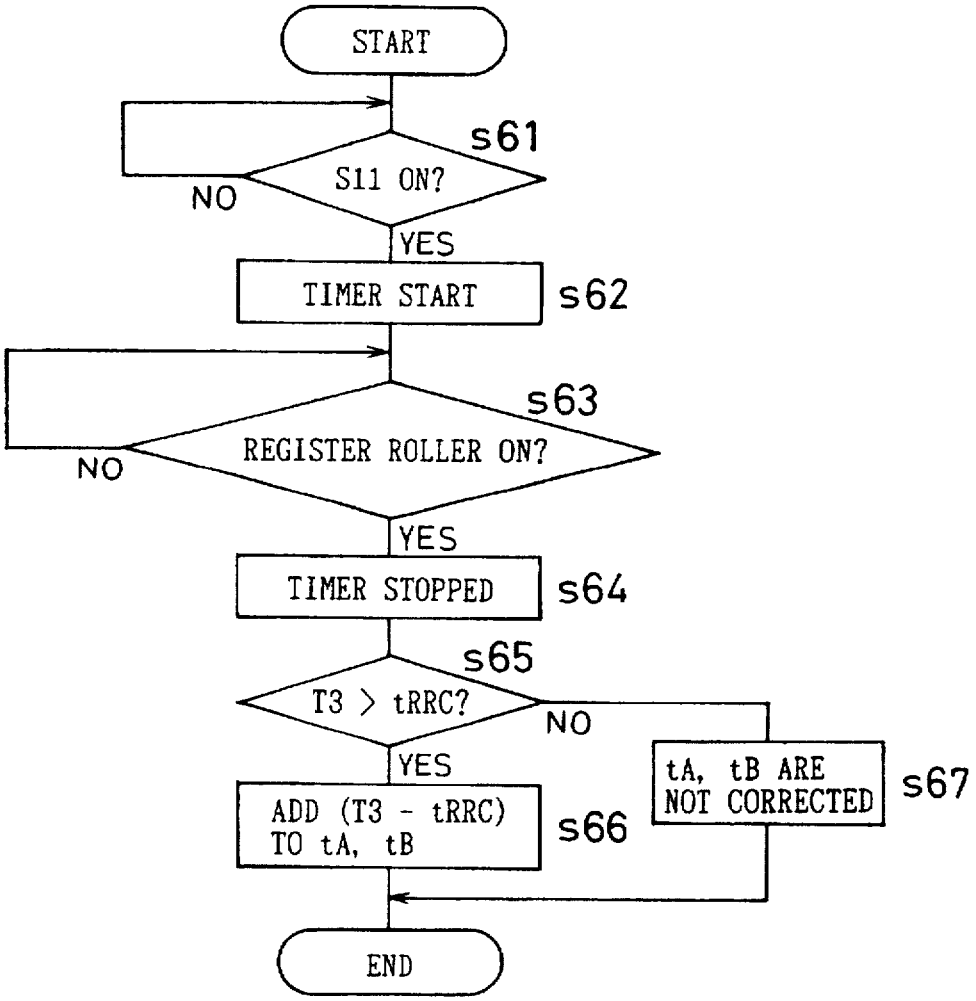
FIG. 15 is a flow chart showing the operation for a switching which is a sixth embodiment of the invention.

FIG. 15 is a flow chart showing the operation for a switching which is a sixth embodiment of the invention. In the sixth embodiment, which is to solve disadvantages similar to those in the fifth embodiment, the time for which the recording sheet is kept on standby at the register roller 160 is monitored and, when the standby time has shifted from a predetermined time, the set values tA, tB are corrected.

At step s61, it is determined whether or not the sensor S11 has turned on. If the sensor S11 has turned on, the program goes to step s62, where the counting of the timer T is started. At step s63, it is determined whether or not the register roller 160 has turned on. At step s64 after it has been determined that the register roller 160 has turned on, the counting of the timer T started at step s62 is stopped.

At step s65, it is determined whether or not the counted time T3 is larger than a predetermined standby time tRRC. At step s66 after it has been determined that the time T3 is larger, (T3−tRRC) is added to the set values tA, tB set in the first embodiment. If it has been determined that T3 is not larger, the program goes to s67, where the set values tA, tB set in the first embodiment are used as they are.

As shown above, according to the sixth embodiment, the standby time during which a recording sheet actually conveyed remains kept on standby at the register roller 160 is measured and, when the measured standby time has a shift from a predetermined standby time, the set values tA, tB are corrected so that the timing for the next sheet feeding is shifted to an extent of the shift. Accordingly, for example, even when the timing of synchronization in the optical system, or when the conveyance of a document sheet by the recirculative document handler 1 is delayed, the timing of feeding a recording sheet can be shifted to an extent of the retardation, so that the recording sheet can be fed securely and that the reliability of copying operation is improved.

Figure 16:
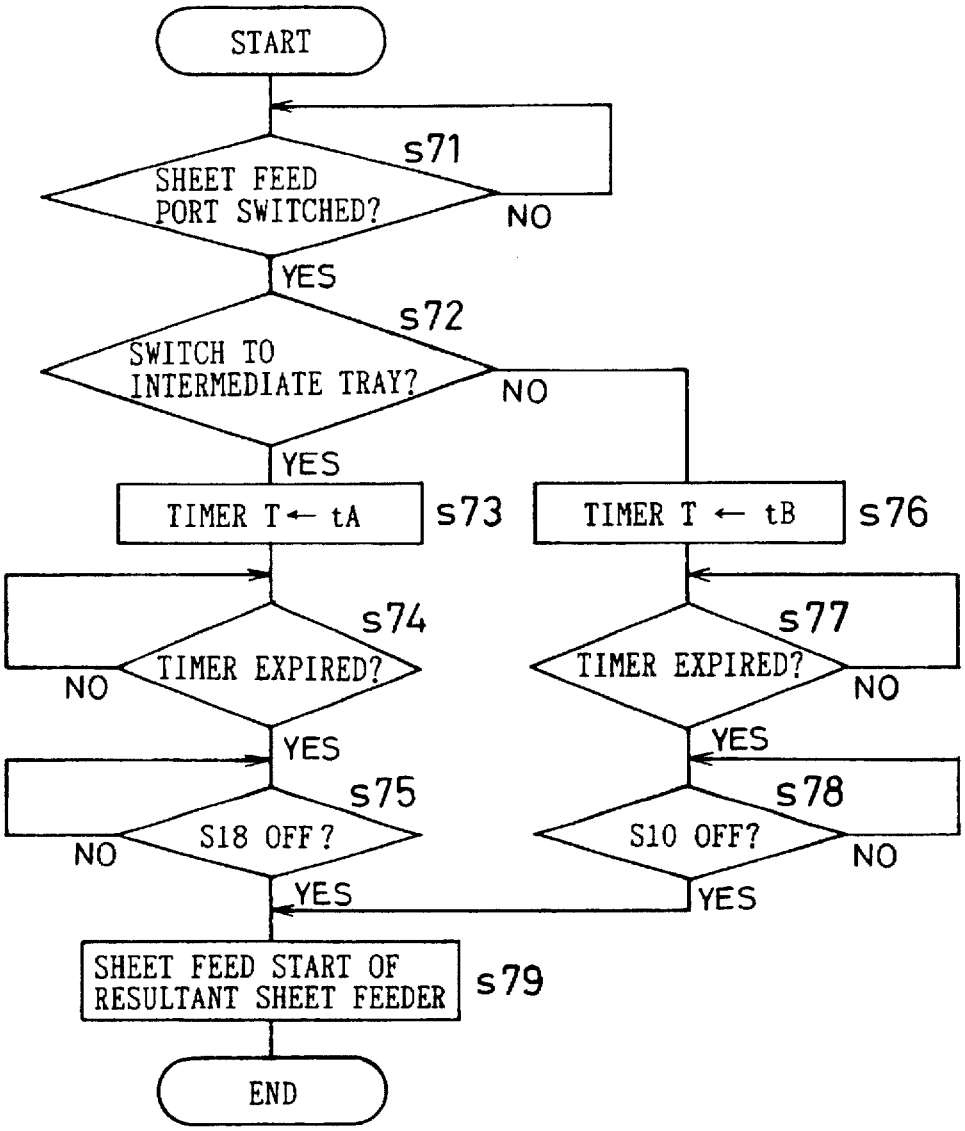
FIG. 16 is a flow chart showing the operation for a switching which is a seventh embodiment of the invention.

FIG. 16 is a flow chart showing the operation for a switching which is a seventh embodiment of the invention. In the foregoing first embodiment, it has been arranged that, for a change of the sheet feeder, sheet feeding is effected at a timing at which the counting of the set values tA, tB has expired. However, there is a possibility that the timing at which the conveyance of a recording sheet is started may be delayed due to slips of the recording sheet with the feed rollers, lack of air pressure for air sheet feeding, or the like. In such a case, the sheet gap between a recording sheet fed at the timing at which the counting of the set values has expired, as in the first embodiment, and a recording sheet fed next would be narrowed such that paper jam may occur due to the interference between one recording sheet and another or that there may arise a positional shift between a recording sheet and an image to be transferred to the recording sheet. In order to reduce such disadvantages, in the seventh embodiment, for a change of the sheet feeder, the feeding of the next recording sheet is started on condition that the counting of the set values has expired and that the one-preceding recording sheet has securely passed along the conveyance path.

At step s71, it is determined whether or not the sheet feeder has been switched. At step s72 after it has been determined that the sheet feeder has been switched, it is determined whether or not the sheet feeder has been switched, for example, from the cassette 106*a* to the intermediate tray 113. At step s73 after it has been so determined, the set value tA set in the first embodiment is set. At step s74, it is determined whether or not the counting of the set value tA has expired. At step s75 after it has been determined that the counting has expired, it is determined whether or not the sensor S18 has turned off. At step s79 after it has been determined that the sensor S18 has turned off, the next recording sheet is started to be fed from the resultant sheet feeder.

If it has been determined at step s72 that the switching is other than to the intermediate tray 113, the program goes to step s76. For example, if the sheet feeder has been changed from the intermediate tray 113 to the cassette 106*a*, the set value tB set in the first embodiment is set. At step s77, it is determined whether or not the counting of the set value tB has expired. At step s78 after it has been determined that the counting has expired, it is determined whether or not the sensor S10 has turned off. If the sensor S10 has turned off, the program goes to the aforementioned step s79, the next recording sheet is started to be fed from the resultant sheet feeder.

As shown above, according to the seventh embodiment, when the sheet feeder has been switched over, the feeding of the next recording sheet is started on condition that the counting of the set values tA, tB has expired and that the one-preceding recording sheet has securely been conveyed. Thus, the copying operation can be executed with reliability.

Figure 17:
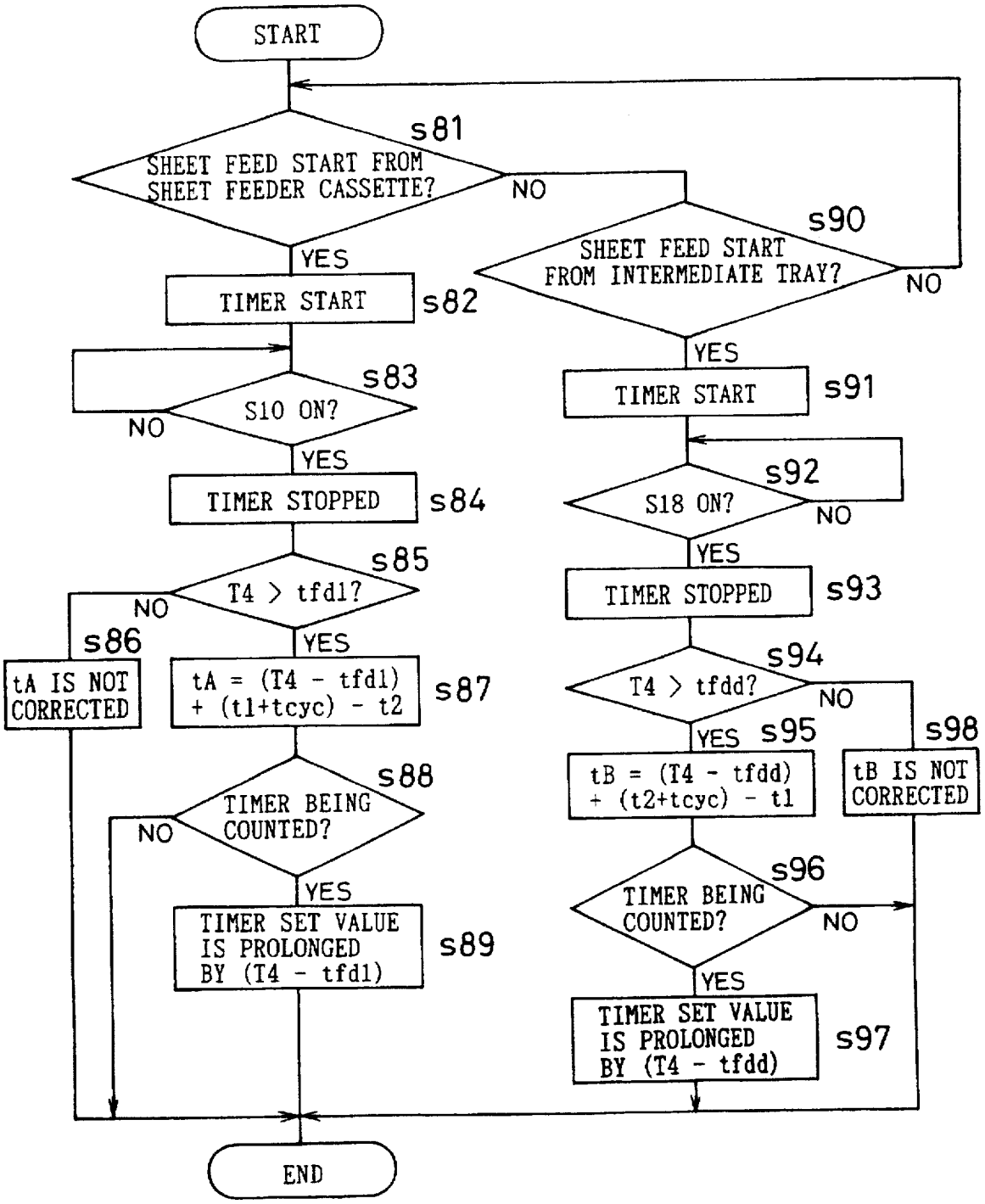
FIG. 17 is a flow chart showing the operation for a switching of the sheet feeder which is an eighth embodiment of the invention.

FIG. 17 is a flow chart showing the operation for a switching of the sheet feeder which is an eighth embodiment of the invention. In the eighth embodiment, which is to reduce disadvantages similar to those in the seventh embodiment, the time elapsing from when the sheet feeding of a recording sheet from a cassette or tray is started until when the recording sheet arrives at specified sensors, for example, the sensors S10, S18 is monitored and, when the time has shifted from a predetermined set value, the set values tA, tB are corrected. Generally, for the feeding of recording sheets, the time from the start of sheet feed to the sheet feed sensor is set to a relatively long one, taking into consideration some delay of the timing at which the sheet feed is started, due to slips of rollers, lack of air pressure in the case of air sheet feed. However, more appropriate values are set in this embodiment.

At step s81, it is determined whether or not the sheet feed of a recording sheet from the cassette 106*a* has been started. At step s82 after it has been determined that e sheet feed has been started, the counting of the timer T is started. At step s83, it is determined whether or not the sensor S10 has turned on. At step s84 after it has been determined that sensor S10 has turned on, the counting of the timer T is stopped.

At step s85, it is determined whether or not a counted time T4 is larger than a predetermined time tfd1 required for the recording sheet to be conveyed from the cassette 106*a* to the sensor S10. At step s87 after it has been determined that T4 is larger, the set value tA set in the first embodiment is corrected to "tA=(T4–tfd1)+(t1+tcyc)–t2. As a result, the sheet feed of the recording sheet from the intermediate tray 113 is delayed to an extent of (T4–tfd1). At step s88, it is determined whether or not the set value tA set in the first embodiment is being counted. At step s89 after it has been determined that the set value tA is being counted, (T4–tfd1) is added to the tA under counting so that the counting is prolonged to an extent of this value.

At step s86 after it has been determined at step s85 that T4 is not larger, the set value tA set in the first embodiment is used as it is, without being corrected.

At step s90 after it has been determined at step s81 that the sheet feed has not been started to be fed from the cassette 106*a*, it is determined whether or not a recording sheet has been started to be fed from the intermediate tray 113. If it has been so determined, the program goes to step s91; if it has been determined not, the program returns to step s81. At step s91, the counting of the timer T is started. At step s92, it is determined whether or not the sensor S18 has turned on. At step s93 after it has been determined that the sensor S18 has turned on, the counting of the timer T is stopped.

At step s94, it is determined whether or not the counted time T4 is larger than a predetermined time tfdd required for a recording sheet to be conveyed from the intermediate tray 113 to the sensor S18. At step s95 after it has been determined that T4 is larger, the tB set in the first embodiment is corrected to "tB=(T4–tfdd)+(t2+tcyc)–t1". At step s96, it is determined whether or not the tB set in the first embodiment is being counted. At step s97 after it has been determined that tB is being counted, (T4–tfdd) is added to the tB under the counting, so that the counting is prolonged by an extent of this value.

At step s98 after it has been determined that T4 is not larger, the set value tB set in the first embodiment is used as it is, without being corrected.

As shown above, according to the eighth embodiment, with the sheet feeder switched over, even when the conveyance of a recording sheet into a conveyance path is delayed by slips, lack of air pressure, or the like, the timing of starting the register roller 160 can be shifted to an extent of the delay, so that the copying operation can be executed reliably.

Figure 18:
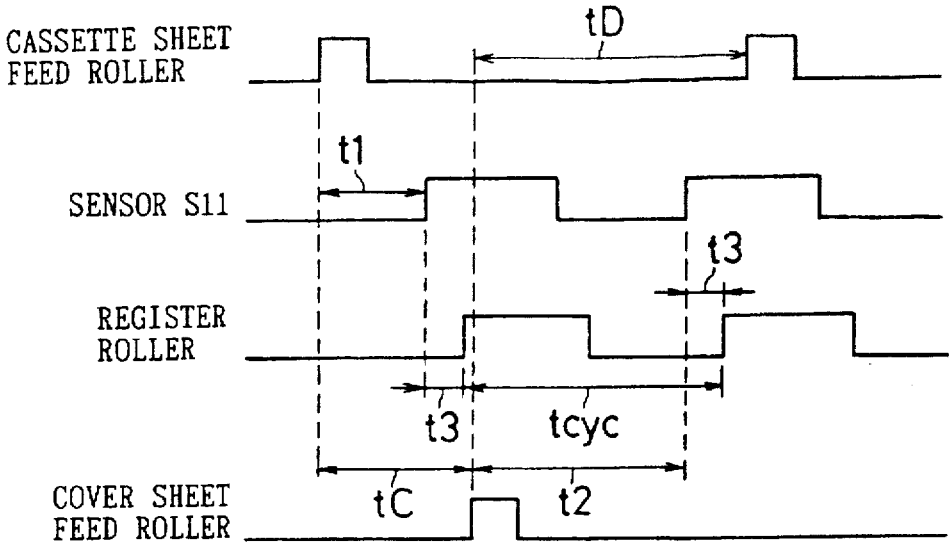
FIG. 18 is a timing chart showing the timing of a switching which is a ninth embodiment of the invention.

FIG. 18 is a timing chart showing the timing of a switching which is a ninth embodiment of the invention. This embodiment is to switch between general recording sheets and cover-paper sheets or laminated-paper sheets. The cover-paper sheets or laminated-paper sheets may be inserted arbitrarily into pages set by the operator, where it is allowed not to copy the image drawn on the document sheet. Such cover-paper sheets or laminated-paper sheets are also stored in any one of a plurality of cassettes.

As shown in FIG. 18(A), with a recording sheet fed from any one of the cassettes 106*a* to 106*d* and the tray 113, any one sheet is fed from a sheet feeder in which the cover-paper sheets or the laminated-paper sheets are stored, a time tC after the sheet feed roller has turned on. Any one sheet is started to be fed from another cassette or tray a time tD after the start of the feeding of the cover-paper sheet or laminated-paper sheet. Also in this case, like the first embodiment, if the drive cycle of the register roller 160 is controlled so as to be equal to the cycle tcyc, then wasteful time can be reduced in a switch between ordinary recording sheets and cover-paper sheets or laminated-paper sheets can be reduced so that the copying efficiency is improved.

More specifically, if the time from a timing when the cassette sheet feed roller has turned on until when the sensor S11 turns on is t1, if the time from when the sensor S11 has turned on until when the register roller 160 turns on is t3, and if the time from when the sheet feed roller for the cassette with cover-paper sheet or laminated-paper sheets stored therein has turned on until when the sensor S11 turns on is t2, then the set values tC, tD are selected as:

$$tC=(t1+tcyc)-t2$$

$$tD=(t2+tcyc)-t1.$$

Figure 19:
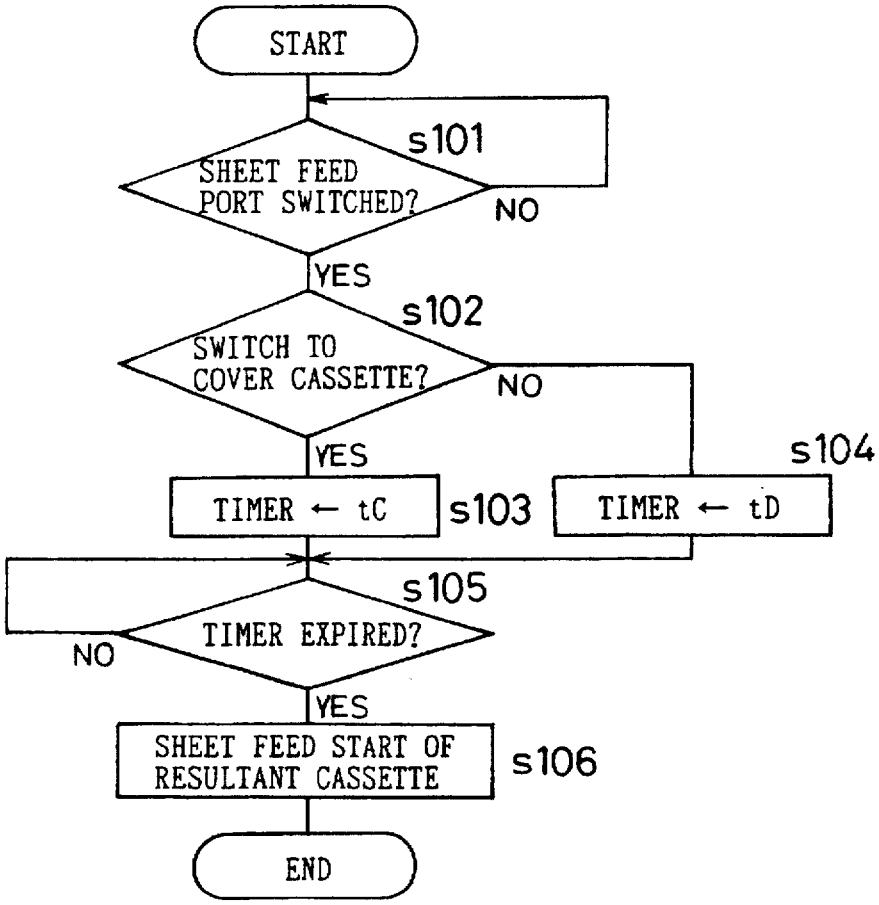
FIG. 19 is a flow chart showing the operation for a switching which is the ninth embodiment of the invention.

FIG. 19 is a flow chart showing the operation for a switching which is the ninth embodiment of the invention. At step s101, it is determined whether or not there has arisen a need for switching the sheet feeder. At step s102 after it has been determined that the need for switching has arisen, it is determined whether or not the switching is to a cassette in which, for example, cover-paper sheets are stored. At step s103 after it has been so determined, the set value tC is set to the timer T and the timer T is started to count. If it has been determined that the sheet feeder is changed to any other than the cassette for cover-paper sheet, i.e., if the sheet feeder is changed from the cassette for cover-paper sheets to another cassette, the program goes to step s104. At step s104, the set value tD is set to the timer T and the timer T is started to count.

At step s105 after the operations of steps s103 and s104 have been completed, it is determined whether or not the counting of the timer T has expired. At step s106 after it has been determined that the counting has expired, the feeding of a recording sheet or a cover-paper sheet from the resultant cassette is started.

As shown above, according to the ninth embodiment, even when the sheet to be fed is switched to cover-paper sheets, the cycle of driving the register roller 106 is maintained at tcyc constant at all times. Therefore, as in the first embodiment, wasteful time can be reduced at a change of the sheet feeder so that the copying can be executed efficiently. In addition, the present embodiment has been described on a case of cover-paper sheets, the case is the same also with laminated-paper sheets. Furthermore, specific paper sheets other than cover-paper sheets and laminated-paper sheets can also be fed with a switching in a similar manner.

Figure 20:
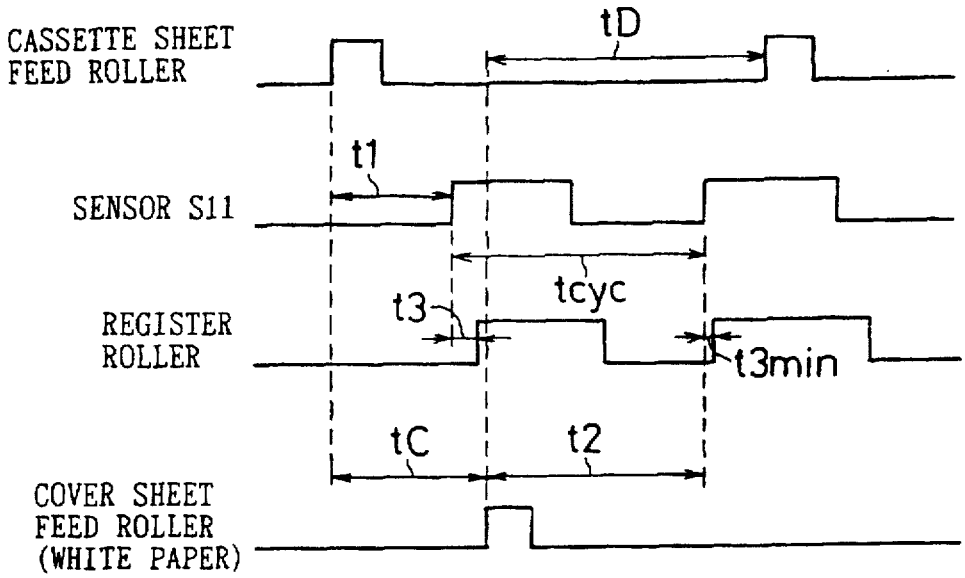
FIG. 20 is a timing chart showing the timing of a switching which is a tenth embodiment of the invention.

FIG. 20 is a timing chart showing the timing of a switching which is a tenth embodiment of the invention. The tenth embodiment relates to a case where in the feeding of cover-paper sheets or laminated-paper sheets as in the ninth embodiment, the image will not be transferred to these specific sheets, and where the timing of feeding these specific sheets is controlled.

When the image is not transferred, the standby time for which the sheet is halted at the register roller 160 may be set to a minimum because synchronization with the document sheet is unnecessary. Accordingly, the timing of feeding a specific sheet to which the image will not be transferred can be advanced earlier than that of a recording sheet to which the image will be transferred. With respect to a time t3 which elapses, after the sheet feed roller for the cassette that stores recording sheets to which an image will be transferred has turned on, from when the sensor S11 has turned on until when the register roller 160 turns on, a time t3mim (t3>t3mim) is set which elapses, after the sheet feed roller for the cassette that stores cover-paper sheets or laminated-paper sheets to which an image will not be transferred has turned on, from when the sensor S11 has turned on until when the register roller 160 turns on. As a result, the aforementioned set value tD is set as "tD=(t2+tcyc)−t1−(t3−t3mim)". Thus, the cycle of driving the register roller 160 can be maintained constant, while the timing of feeding a specific sheet to which an image will not be transferred can be advanced earlier than that of a recording sheet to which the image will be transferred.

As shown above, according to the tenth embodiment, in a case where recording sheets to which an image will be transferred and specific sheets to which an image will not be transferred are continuously fed, the time required for feeding specific sheets such as cover-paper sheets or laminated-paper sheets can be reduced to a minimum, so that the copying operation can be executed efficiently.

Figure 21:
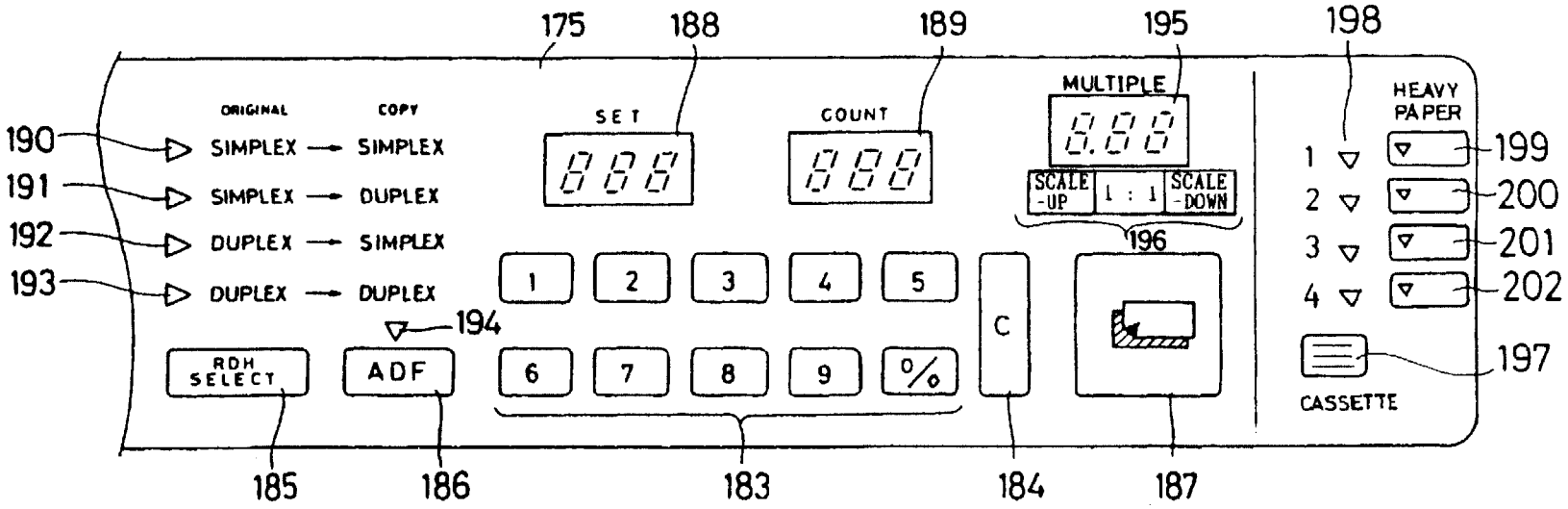
FIG. 21 is a plan view showing an operation panel equipped to a copying machine which is an eleventh embodiment of the invention.

FIG. 21 is a plan view showing an operation panel equipped to a copying machine which is an eleventh embodiment of the invention. The operation panel shown in FIG. 21 is implemented by the operation panel as shown in FIG. 4, which further comprises a sheet-feeder select key 197, selector display LEDs 198, a first-cassette heavy-paper select key 199, a second-cassette heavy-paper select key 200, a third-cassette heavy-paper select key 201 and a fourth-cassette heavy-paper select key 202. A sheet feeder to be used can be selected by designating the sheet-feeder select key 197. The selected sheet feeder can be reconfirmed with the selector display LEDs 198 lit. The selector display LEDs 198 are provided for the individual sheet feeders, respectively. When heavy-paper sheets of relatively large thickness are stored in the cassettes 106*a* to 106*d* instead of commonly used recording sheets, any one of the heavy-paper select keys 199 to 202 corresponding to the cassettes in which such heavy-paper sheets are stored, respectively, is designated. As a result, the sheet feeder in which heavy-paper sheets are stored feeds heavy-paper sheets under the conditions which will be described later.

Figure 22:
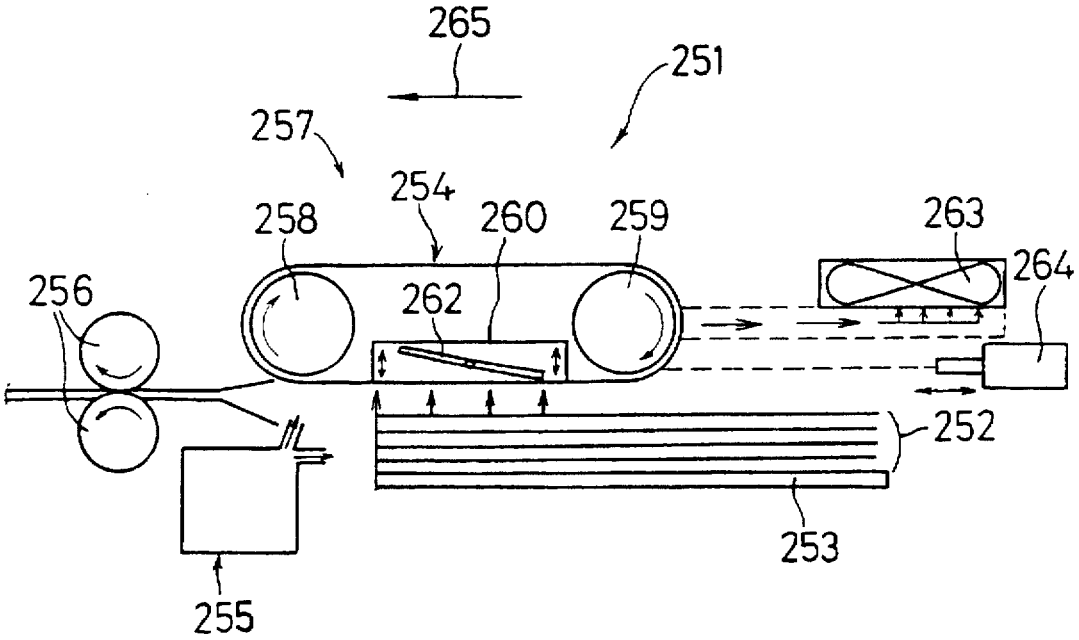
FIG. 22 is a sectional view of a sheet feeder 251.
Figure 23:
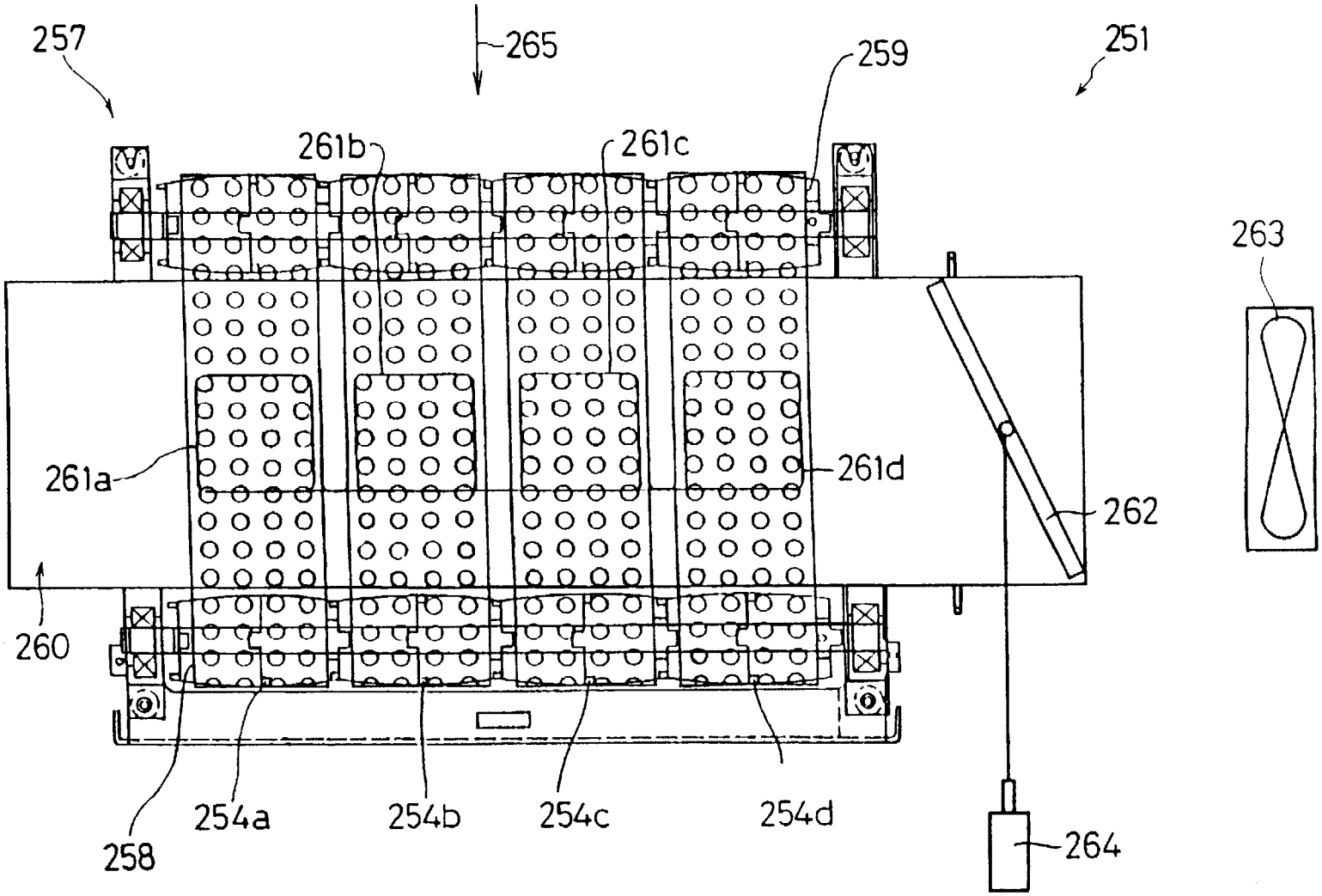
FIG. 23 is a plan view of the sheet feeder 251.

FIG. 22 is a sectional view of a sheet feeder 251 which can be used instead of the sheet feed rollers 109*a* to 109*d*, 114, and which is used in this embodiment. FIG. 23 is a plan view of the sheet feeder 251. The sheet feeder 251 comprises a support tray 253 on which recording sheets 252 are stacked and stored, a conveyor unit 257 for conveying the recording sheets 252 by separating the recording sheets 252, one by one, stacked and stored in the support tray 253, a nozzle member 255 provided on the downstream side of a conveyance direction 265 and below a conveyor belt 254, and conveyor rollers 256. The conveyor unit 257 has, for example, four conveyor belts 254*a* to 254*d* provided at predetermined positions relative to the support tray 253. These conveyor belts 254*a* to 254*d* are stretched over between rollers 258, 259 secured to two rotating shafts. A vacuum suction box 260 is accommodated between the rollers 258, 259, and suction holes 261*a* to 261*d* confronting conveyor belts 257*a* to 257*d*, respectively, are defined. In the vacuum suction box 260, a damper 262 is accommodated to communicate a suction fan 263 and the vacuum suction box 260 with each other or to disconnect them from each other through expansion or contraction of a plunger 264.

As to the operational sequence for feeding the recording sheets 252, first, an air stream is blown from the nozzle member 255 to the conveyance-downstream-side end portion of the stacked recording sheets 252, so that the recording sheet 252 are flown upward so as to be separated, while the suction fan 263 is normally driven to rotate so that the vacuum suction box 260 internally has a negative pressure. Within the vacuum suction box 260, the damper 262 is provided to communicate the suction fan 263 and the vacuum suction box 260 with each other or to disconnect them from each other. At a blow of the air stream to the end portion of the stacked recording sheets 252, the damper 262 is driven by the plunger 264, causing the suction fan 263 and the vacuum suction box 260 to communicate with each other, with a recording sheet 252 sucked up to the conveyor belt 254. At this point, the blowing of the air stream is stopped, and thereafter the rollers 258, 259 are driven to rotate, causing the conveyor belt 254 to run, by which the recording sheet 252 is conveyed along the conveyance direction 265. The conveyed recording sheet 252 is sandwiched between a pair of conveyor rollers 256 and conveyed toward the photoconductor drum. With the recording sheet 252 sandwiched between the conveyor rollers 256, the damper 262 is actuated by operation of the plunger 264, so that the suction fan 263 and the vacuum suction box 260 are disconnected from each other.

For the feeding of heavy paper, a relatively high sheet feed performance is required. That is, sufficient air pressure is required such that slip tends to occur between the heavy paper and the sheet feed rollers during the sheet feed. To solve such disadvantages, sufficient time for sheet feed is required for the feeding of heavy paper. In the eleventh embodiment, longer time is taken for the feeding of heavy paper than for the feeding of commonly used recording sheets having relatively small thickness. Accordingly, it is preferable to lengthen the set value tD that has been described in the ninth embodiment. Therefore, in place of the set value tD, tDmax is set as:

$$tDmax=(t2max+tcyc)-t1$$

where the set value tC is a set value for a case where the cassette in which commonly used recording sheets are stored has been switched to a cassette in which heavy-paper sheets are stored, while the set value tDmax is a set value for a case where the cassette in which heavy-paper sheets are stored has been switched to a cassette in which commonly used recording sheets are stored. Also, t2max is a predetermined time which elapses from the feed start of a heavy-paper sheet fed from the cassette in which heavy-paper sheets are stored until the heavy-paper sheet arrives at the sensor S11.

Figure 24:
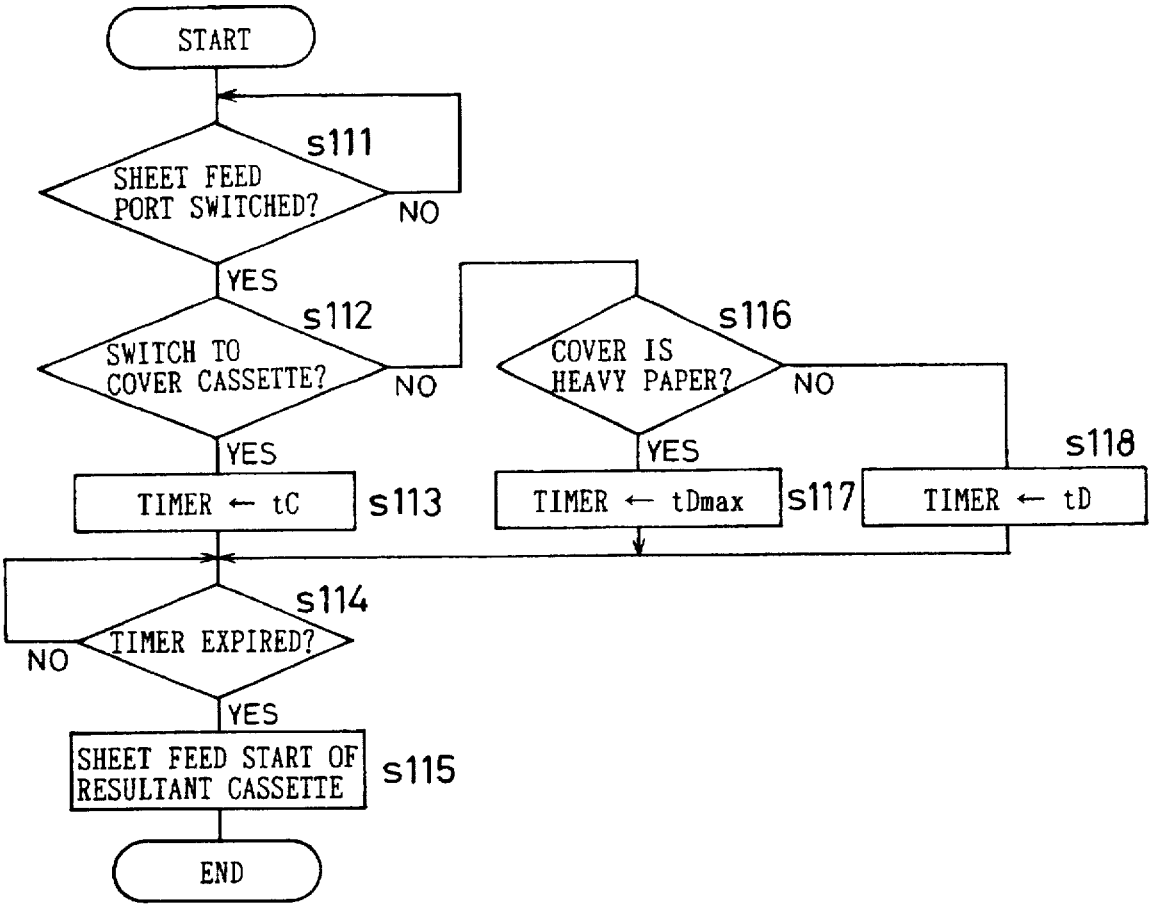
FIG. 24 is a flow chart showing the operation in the eleventh embodiment.

FIG. 24 is a flow chart showing the operation according the eleventh embodiment. This flow chart exemplifies a case where a relatively thick sheet is used as a cover-paper sheet. At step s111, it is determined whether or not there has arisen a need for switching the sheet feeder. At step s112 after it has been determined that the need for switching has arisen, it is determined whether or not the sheet feeder has been switched to a cassette in which cover-paper sheets are stored. At step s113 after it has been so determined, the set value tC is set to the timer T, and the counting of the set value is started. At step s114, it is determined whether or not the counting of the set value tC has expired. At step s115 after it has been determined that the counting has expired, the feeding of a sheet stored in the resultant cassette is started.

If it has been determined at step s112 that the sheet feeder has not been switched to a cassette in which cover-paper sheet are stored, i.e., if the sheet feeder has been switched from a cassette in which cover-paper sheet are stored to a cassette in which recording sheets are stored, then the program goes to step s116. At step s116, it is determined whether or not the cover-paper sheet is a heavy-paper sheet. At step s117 after it has been determined that the cover-paper sheet is a heavy-paper sheet, the set value tDmax is set to the timer T, and the counting of the set value tDmax is started. At step s118 after it has been determined that the cover-paper sheet is not a heavy-paper sheet, the set value tD is set to the timer T, and the counting of the set value tD is started. After the operations of steps s117 and s118 are completed, the program goes to step s114. Then, it is determined whether or not the counting of the set value set to the timer T has expired, followed by similar operations.

As shown above, according to the eleventh embodiment, when the sheet to be fed is switched to heavy-paper sheets, any lack in the air pressure can be compensated while sufficient time for sheet feeding can be ensured so as to reduce the possibilities of slips during the sheet feed. Therefore, the sheet feed performance is improved and the copying operation can be executed reliably.

Figure 25:
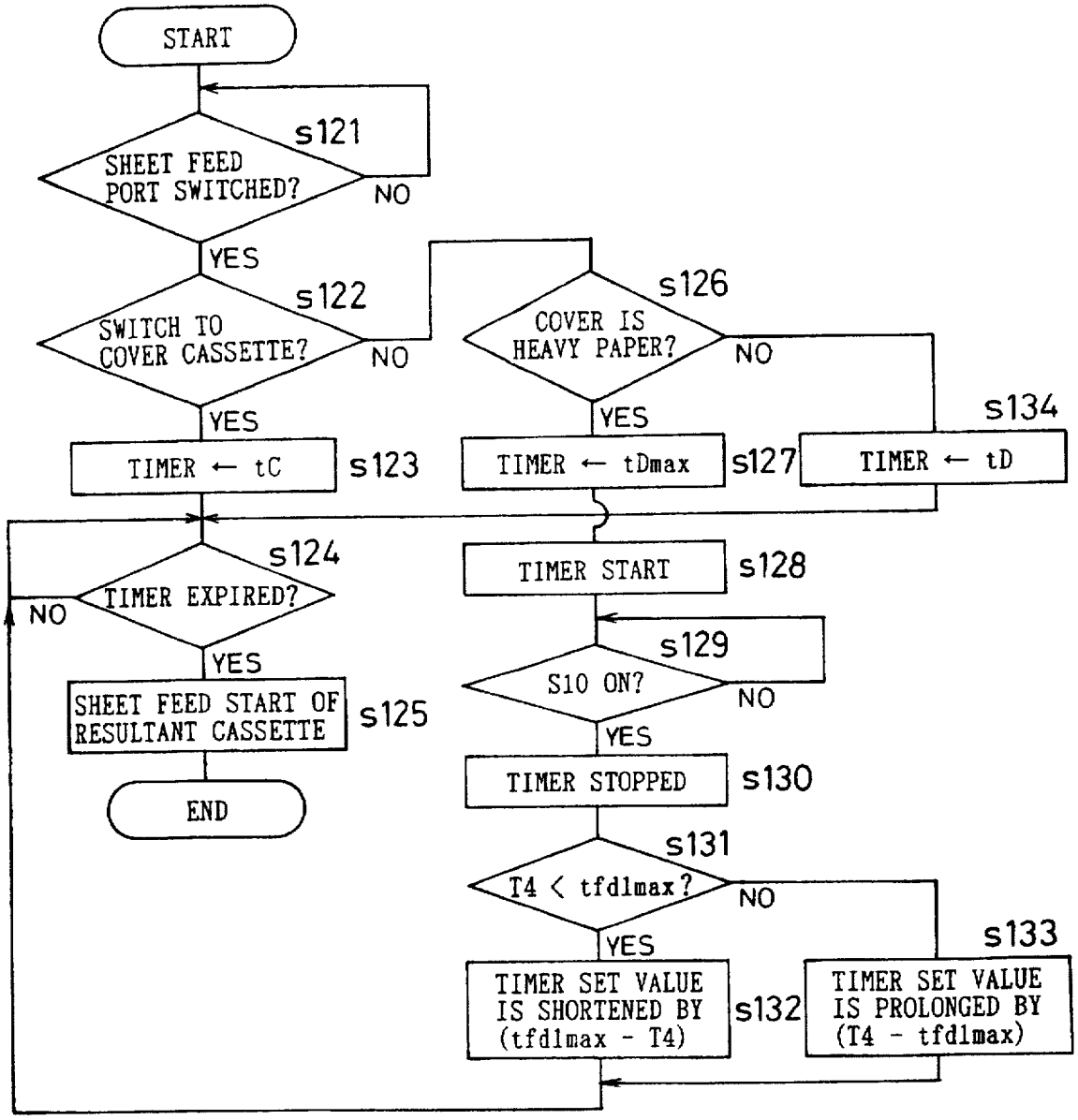
FIG. 25 is a flow chart showing the operation for a switching which is a twelfth embodiment of the invention.

FIG. 25 is a flow chart showing the operation which is a twelfth embodiment of the invention. The twelfth embodiment is intended to achieve an efficient sheet feed in the eleventh embodiment, with an arrangement that when a good sheet feed performance of heavy-paper sheets has been exhibited, i.e. when the sheet feed sensor has turned on earlier than expected, the sheet to be next fed is fed earlier.

At step s121, it is determined whether or not there has arisen a need for switching the sheet feeder. At step s122 after it has been determined that the need for switching has arisen, it is determined whether or not the sheet feeder has been switched to a cassette in which cover-paper sheets are stored. At step s123 after it has been so determined, the set value tC is set to the timer T, and the counting is started. At step s124, it is determined whether or not the counting of the set value set to the timer T has expired. At step s125 after it has been determined that the counting has expired, the feeding of a recording sheet stored in the resultant cassette is started.

At step s126 after it has been determined at step s122 that the sheet feeder has not been switched to a cassette in which cover-paper sheet are stored, it is determined whether or not the cover-paper sheet is a heavy-paper sheet. At step s127 after it has been determined that the cover-paper sheet is a heavy-paper sheet, the set value tDmax is set to the timer T, and the counting of the set value is started. At step s128, the time is started to be counted by the timer T. At step s129, it is determined whether or not the sensor S10 has turned on. At step s130 after it has been determined that the sensor S10 has turned on, the counting of the timer T started at step s128 is stopped. At step s131, a measured time T4 is compared with a predetermined set value tfd1max, where it is determined whether or not T4 is smaller. At step s132 after it has been determined that T4 is smaller, the set value tDmax is shortened to an extent of (tfd1max−T4). At step s133 after it has been determined at step s131 that T4 is not smaller, the set value tDmax is prolonged to an extent of (T4−tfd1max). When the operations of steps s132 and s133 are completed, the program goes to the foregoing step s124.

At step s134 after it has been determined at step s126 that the cover-paper sheet is not a heavy-paper sheet, the set value tD is set to the timer T, and the counting of the set value is started, followed by step s124.

As shown above, according to the twelfth embodiment, in the case of feeding heavy-paper sheets, it can be controlled that, when a relatively good sheet feed performance has been exhibited so that the sheet is fed earlier than expected, the feeding of the next sheet is advanced earlier, and that, when a relatively bad sheet feed performance has been exhibited so that the sheet feed takes time, the feeding of the next sheet is delayed. Therefore, sheets can be fed appropriately responsive to the actual sheet feed conditions, so that the copying operation can be executed reliably. Also, when a good sheet feed performance has been exhibited, the next sheet can be fed at an earlier timing, so that the time required for copying can be shortened.

Figure 26:
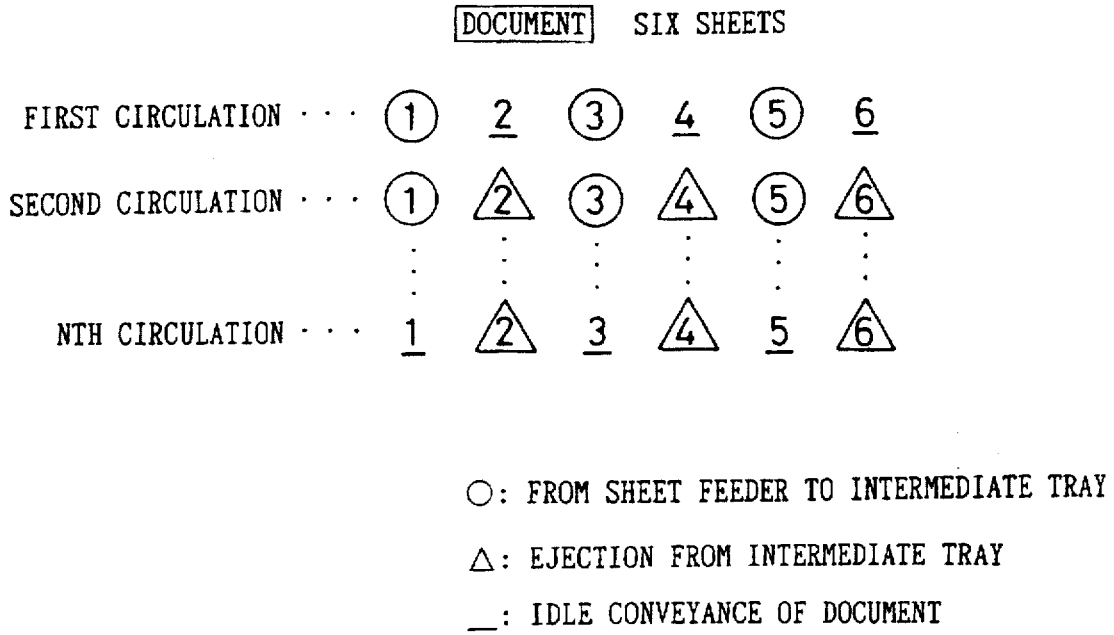
FIG. 26 is a view for explaining a conveyance operation of a copying machine which is a thirteenth embodiment of the invention.

FIG. 26 is a view for explaining a conveyance operation of a copying machine which is a thirteenth embodiment of the invention. The document handler 1 as shown in FIGS. 1 and 2 feeds stored document sheets one by one to a predetermined image-reading position in a continuous fashion, and besides re-store the document sheets over the reading. Using such a document handler 1 makes it possible that an image is transferred onto both sides of a recording sheet from a document sheet on one-side surface of which the image is drawn, and that such a transfer process is executed for a plurality of copies. In this embodiment, the operation for executing such a transfer process is explained.

As an example, taking a case where recording sheets P stored in the cassette 106*a* are used and where six original document sheets are copied, in the first circulation of document sheets, the sheet feed roller 109*a* is driven so that the recording sheets stored in the cassette 106*a* are fed one by one. The register roller 160 is driven so that a fed recording sheet is given to the photoconductor 101. An image drawn on either one of odd page or even page of the six document sheets fed by the document handler 1, for example, on an odd page is transferred to one-side surface of the fed recording sheet, and then the recording sheet on one-side surface of which the image has been transferred is stored in the intermediate tray 113. Meanwhile, the document sheet of an even page is idly transferred without its image being transferred.

In the second and following circulations of the document sheets, the image drawn on the first-page document sheet is transferred to one-side surface of the recording sheet P fed from the cassette 106*a*, while the image drawn on the second-page document sheet is transferred to the other-side surface of the recording sheet which is fed from the intermediate tray 113 and on one-side surface of which an image has already been transferred. By repeating such a transfer operation, the images of up to the sixth page are transferred. Recording sheets on one-side surface of which images have been transferred are stored in the intermediate tray 113, while recording sheets on both-side surfaces of which images have been transferred are ejected to the ejection tray 110.

In the final circulation of the document sheets, the sheet feed roller 114 is driven so that the recording sheets stored in the intermediate tray 113 are fed one by one. The register roller 160 is driven so that a fed recording sheet is given to the photoconductor 101. An image drawn on either the other one of odd page or even page of the document sheets fed by the document handler 1, for example, on an even page is transferred to the other-side surface of the recording sheet. Then, the recording sheet on both-side surfaces of which images have been transferred is ejected to the ejection tray 110. Meanwhile, the document sheet of an even page is idly transferred. In this way, images are transferred from a document sheet on one-side surface of which an image has been drawn, to both-side surfaces of a recording sheet, and besides such a transfer process can be executed for apparatus of copies.

Figure 27:
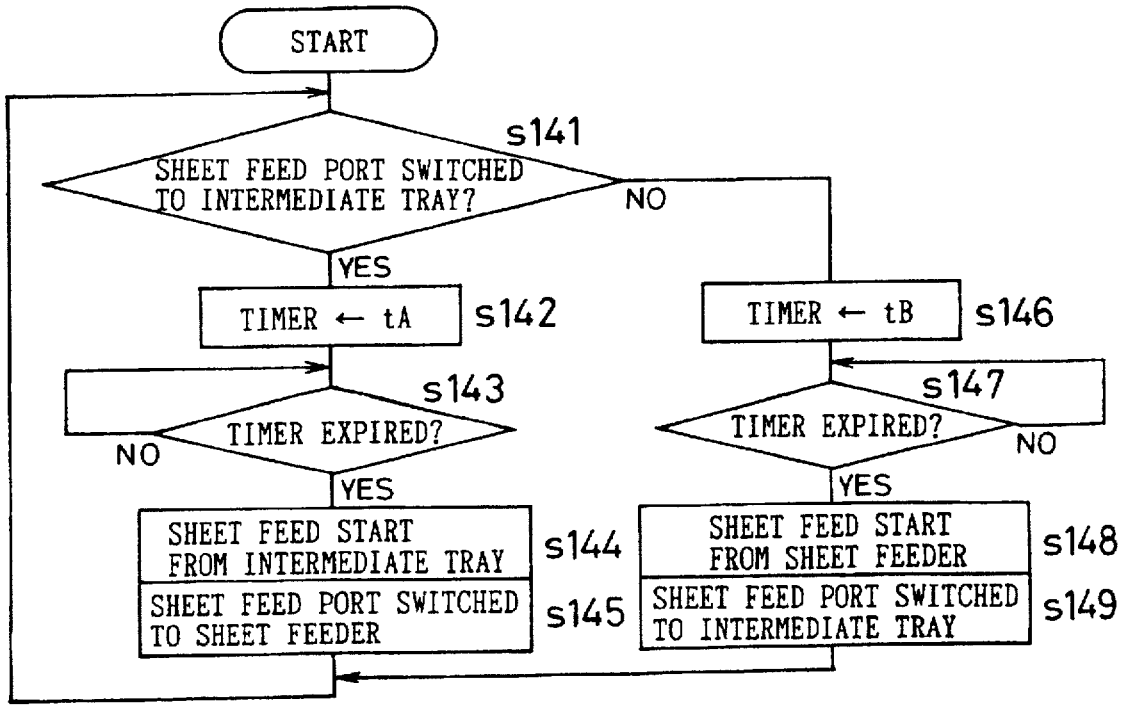
FIG. 27 is a flow chart showing the operation in the thirteenth embodiment.

FIG. 27 is a flow chart showing the operation in the thirteenth embodiment. At step s141, it is determined whether or not the sheet feeder has been changed to the intermediate tray 113, which is a sheet feeder. At step s142 after it has been determined that the sheet feeder has been changed, the set value tA described in the first embodiment is set to the timer T, and the counting of the set value tA is started. At step s143, it is determined whether or not the counting of the timer T has expired. At step s144 after it has been determined that the counting has expired, a recording sheet stored in the tray from the intermediate tray 113 is started to be conveyed. At step s145, the sheet feeder is changed to the register roller 106, which is a sheet feeder, where the program returns to step s141.

At step s146 after it has been determined at step s141 that the sheet feeder has not been changed to the intermediate tray 113, the set value tB described in the first embodiment is set to the timer T, and the counting of the set value tB is started. At step s147, it is determined whether or not the counting of the set value has expired. At step s148 after it has been determined that the counting has expired, the feeding of a recording sheet from the cassette 106*a* is started. At step s149, the sheet feeder is changed to the intermediate tray 113, where the program returns to step s141.

As shown above, in the second and following circulations of document sheets, the timings at which the sheet feed roller 109*a* and the sheet feed roller 114 are driven are alternately controlled so that the register roller 160 can be driven at a constant cycle time relative to a plurality of recording sheets stored in the cassette 106*a* and the intermediate tray 113 and passing along the conveyance paths. Therefore, in cases where images are transferred from a document sheet on one-side surface of which an image is drawn, onto both-side surfaces of a recording sheet, and where such a transfer process is executed for a plurality of copies, the same effects as described in the first embodiment can be obtained, so that wasteful time can be reduced during a switching of the cassettes and tray and that the copying efficiency can be improved.

Figure 28:
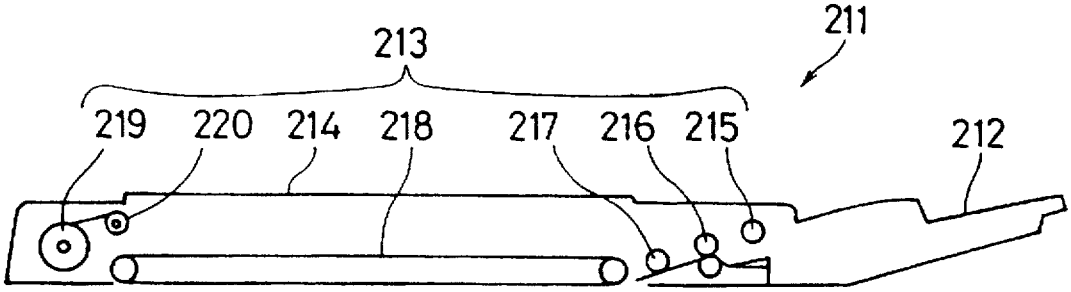
FIG. 28 is a schematic sectional view of an automatic document feeder 211.

FIG. 28 is a schematic sectional view of an automatic document feeder (ADF), which can be used instead of the recirculative document handler 1 that have been used in the first to twelfth embodiments. The automatic document feeder 211 comprises a document storage 212, which is first storage means for storing document sheets, sheet feed means 213 for feeding the document sheets one by one from the document storage 212, and second storage means 214 for storing a document sheet fed by the sheet feed means 213 and ejected. The sheet feed means 213 comprises an introductory roller 215, a sheet feed roller 216, a register roller 217, a belt 218, a turn roller 219, and a sheet ejection roller 220. The belt 218 is placed opposite to the image-reading surface of the body 100 of the copying machine.

The document sheet stored in the document storage 212 is conveyed in contact with the belt 218 by the introductory roller 215, the sheet feed roller 216, and the register roller 217. The document sheet in contact with the belt 218 has its image read at a specified image-reading position, and then further conveyed toward the turn roller 219 along the belt 218. The conveyed document sheet is turned in direction by the turn roller 219, and ejected to the second storage means 214 via the sheet ejection roller 220.

Figure 29:
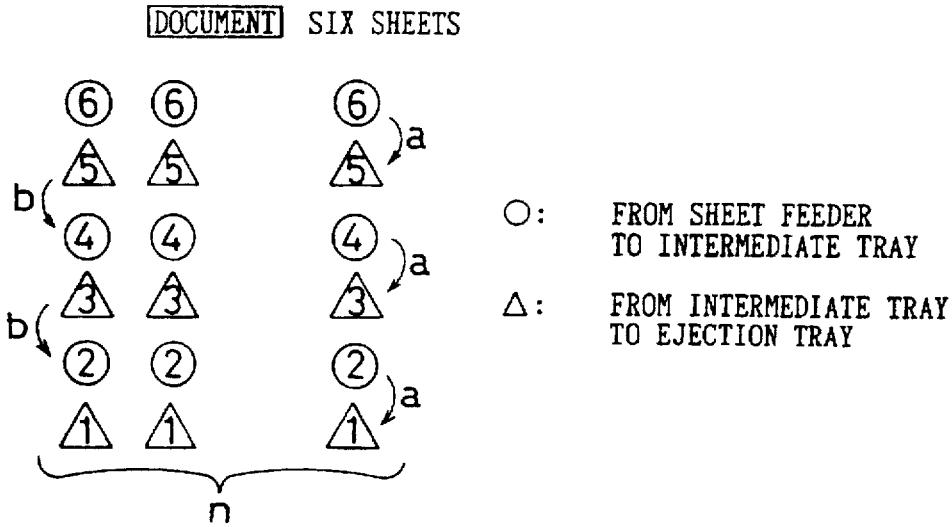
FIG. 29 is a view for explaining the operation in the case where an image is transferred onto both sides of a recording sheet from a document sheet on one side of which the image has been drawn, by using the automatic document feeder 211.
Figure 30:
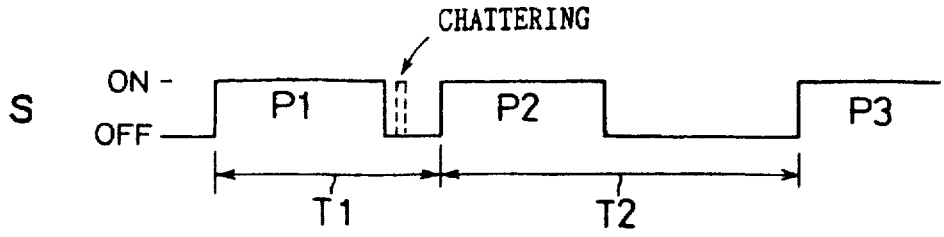
FIG. 30 is a timing chart for explaining disadvantages due to an improper sheet interval between recording sheets P1 and P2 that are fed in succession.
Figure 31:
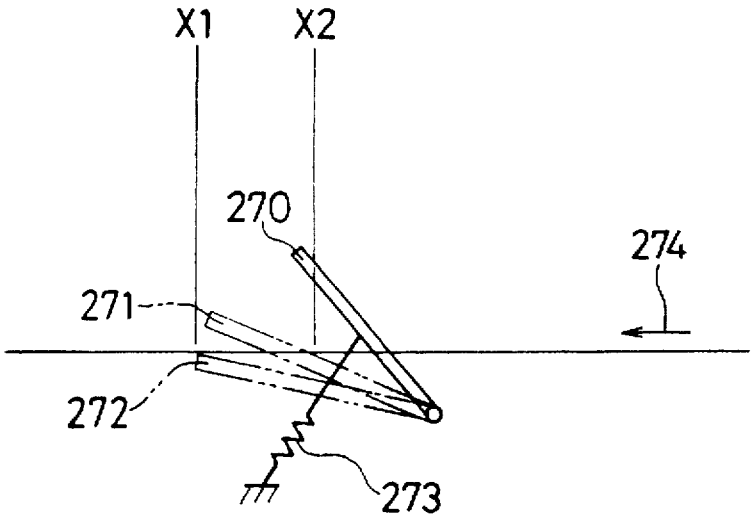
FIG. 31 is a view showing a detection piece 270 of a sensor provided on a conveyance path along which a recording sheet is conveyed.

FIG. 29 is a view for explaining the operation in the case where an image is transferred onto both sides of a recording sheet from a document sheet on one side of which the image has been drawn, by using the automatic document feeder 211. Here is explained a case where such an operation is repeated so that a transfer process is executed for a plurality of copies. Six document sheets are stored in the document storage 212 of the automatic document feeder 211. First, the sixth document sheet is copied to six sheets. In this process, a recording sheet to one-side surface of which the image has been transferred is retained in the intermediate tray 113. Next, the fifth document sheet is copied to the other surface of the recording sheet on which the sixth document sheet has been copied and which is stored in the intermediate tray 113. In this way, the recording sheet on both-side surfaces of which images have been transferred is ejected to the ejection tray 110. Next, the fourth document sheet is copied to n sheets, and the recording sheets are stored in the intermediate tray 113, and the third document sheet is transferred to the other surface of the recording sheets stored in the intermediate tray 113, and then ejected to the ejection tray. Such an operation is repeatedly effected on the sixth through first document sheets. In this case, at a switch from the sixth to the fifth document sheet, at a switch from the fourth to the third document sheet, and at a switch from the second to the first document sheet, sheet feed is switched, for example, from the cassette 106*a* to the intermediate tray 113. At a switch from the fifth to the fourth document sheet, and at a switch from the third to the second document sheet, conversely, the sheet feed is switched from the intermediate tray 113 to the cassette 106*a*. For such a switching, the timings at which the sheet feed roller 109*a* and the sheet feed roller 114 are driven are controlled so that the register roller 160 can be driven at a constant cycle time, as described in the first to twelfth embodiments, by which the same effects as in those embodiments can be obtained.

What is claimed is:

1. A copying machine comprising:

document feed means for storing a plurality of document sheets on which an image has been drawn and continuously feeding the document sheets one by one to a predetermined image-reading position;

image-reading means for reading an image from a document sheet fed to the image-reading position;

at least one recording-sheet storage means for storing a plurality of recording sheets onto which an image is transferred;

image transfer means for transferring onto a recording sheet an image read by the image-reading means;

intermediate recording-sheet storage means for temporarily storing the recording sheet onto which the image has been transferred by image transfer means;

at least one first conveyance path for conveying a recording sheet from the recording-sheet storage means to the image transfer means;

a second conveyance path for conveying a recording sheet from the intermediate recording-sheet storage means to the image transfer means;

at least one first drive roller for feeding the recording sheets stored in the recording-sheet storage means one by one to the first conveyance path;

a second drive roller for feeding the recording sheets stored in the intermediate recording-sheet storage means one by one to the second conveyance path;

a third drive roller, which is driven in synchronization with the image-reading timing, for feeding a recording sheet conveyed along the first or second conveyance path to the image transfer means; and control means for controlling timing at which the first and second drive rollers are driven, so that the third drive roller can be driven at a constant cycle time when a recording sheet is conveyed along the first conveyance path with the conveyance path of previous recording sheets switched over after a recording sheet fed from the intermediate recording-sheet storage means by the second drive roller has been conveyed.

2. The copying machine according to claim 1, wherein the length from the conveyance-downstream side end of a recording sheet to the third drive roller is selected so as to be different between recording sheets stored in the recording-sheet storage means and recording sheets stored in the intermediate recording-sheet storage means, the control means controls the timing at which the first and second drive rollers are driven, so that the third drive roller can be driven at the same cycle time with respect to a plurality of recording sheets of different lengths which are fed along the first and second conveyance paths, respectively.

3. The copying machine according to claim 1, wherein the recording-sheet storage means and the intermediate recording-sheet storage means store a plurality of kinds of recording sheets having different sizes, and the length from the conveyance-downstream side end of a recording sheet to the third drive roller is selected so as to be different between recording sheets stored in the recording-sheet storage means and recording sheets stored in the intermediate recording-sheet storage means, the control means controls the timing at which the first and second drive rollers are driven, so that the third drive roller can be driven at the same cycle time with respect to a plurality of recording sheets of different lengths which are fed along the first and second conveyance paths, respectively.

4. The copying machine according to claim 1, wherein the control means comprises:

a timer for counting the lapse of time from a conveyance start of a recording sheet stored in the recording-sheet storage means to the first conveyance path or a conveyance start of a recording sheet stored in the intermediate recording-sheet storage means to the second conveyance path until the recording sheet reaches the third drive roller; and correction means for correcting a time shift of the timing at which the first or second drive roller is next driven, when the counted value has a shift from a time interval at which the first or second drive roller is driven, the time interval having been pre-selected so that the third drive roller can be driven at a constant cycle time with respect to a plurality of recording sheets fed in the first and second conveyance paths, respectively.

5. The copying machine according to claim 1, wherein the control means comprises:

a timer for counting a time interval at which recording sheets stored in the recording-sheet storage means are fed to the first conveyance path or a time interval at which recording sheets stored in the intermediate recording-sheet storage means are fed to the second conveyance path; and correction means for correcting a time shift of the timing at which the first or second drive roller is next driven, when the counted value has a shift from a time interval at which recording sheets stored in the recording-sheet storage means are fed to the first conveyance path or a time interval at which recording sheets stored in the intermediate recording-sheet storage means are fed to the second conveyance path, the time interval having been pre-selected so that the third drive roller can be driven at a constant cycle time with respect to a plurality of recording sheets fed in the first and second conveyance paths, respectively.

6. The copying machine according to claim 1, wherein the control means comprises:

a timer for counting a standby time of a recording sheet during which the recording sheet remains on standby at the third drive roller; and correction means for correcting a time shift of the timing at which the first or second drive roller is next driven, when the counted value has a shift from the standby time during which a recording sheet remains on standby at the third drive roller, the standby time having been pre-selected so that the third drive roller can be driven at a constant cycle time with respect to a plurality of recording sheets fed in the first and second conveyance paths, respectively.

7. The copying machine according to claim 1, further comprising a first sensor located on a side of the first conveyance path on which the recording-sheet storage means is provided and a second sensor located on a side of the second conveyance path on which the intermediate recording-sheet storage means is provided, the sensors serving for sensing that a recording sheet has passed, wherein the control means controls the driving of the first and second drive rollers in response to a turn-off of the respective sensors.

8. The copying machine according to claim 1, further comprising a first sensor located on a side of the first conveyance path on which the recording-sheet storage means is provided and a second sensor on a side of the second conveyance path on which the intermediate recording-sheet storage means is provided, the sensors serving for sensing that a recording sheet has passed, wherein the control means comprises:

a timer for counting the lapse of time from a conveyance start of a recording sheet stored in the recording-sheet storage means to the first conveyance path or a conveyance start of a recording sheet stored in the intermediate recording-sheet storage means to the second conveyance path until the corresponding sensor turns on; and correction means for correcting a time shift of the timing at which the first or second drive roller is next driven, when the counted value has a shift from a time interval from the conveyance start of a recording sheet stored in the recording-sheet storage means to the first conveyance path or the conveyance start of a recording sheet stored in the intermediate recording-sheet storage means to the second conveyance path until the corresponding sensor turns on, the time interval having been pre-selected so that the third drive roller can be driven at a constant cycle time with respect to a plurality of recording sheets fed in the first and second conveyance paths, respectively.

9. A copying machine comprising:

document feed means for storing a plurality of document sheets on which an image has been drawn and continuously feeding the document sheets one by one to a predetermined image-reading position;

image-reading means for reading an image from a document sheet fed to the image-reading position;

at least one recording-sheet storage means for storing a plurality of recording sheets onto which an image is transferred;

specific-paper storage means for storing cover-paper sheets or laminated-paper sheets;

image transfer means for transferring onto a recording sheet an image read by the image-reading means;

a plurality of conveyance paths for conveying recording sheets and cover-paper sheets or laminated-paper sheets from the recording-sheet storage means and the specific-paper storage means to the image transfer means;

at least two first drive rollers for feeding the recording sheets stored in the recording-sheet storage means and the cover-paper sheets or laminated-paper sheets stored in the specific-paper storage means one by one to the conveyance paths;

a second drive roller for feeding to the image transfer means the recording sheet and the cover-paper sheet or laminated-paper sheet conveyed along the conveyance paths; and control means for controlling timing at which the first drive rollers are driven, so that the second drive roller can be driven at a constant cycle time with respect to a plurality of recording sheets that pass the conveyance paths.

10. The copying machine according to claim 9, wherein the control means controls operation of the first drive rollers so that a cover-paper sheet or laminated-paper sheet is started to be conveyed immediately after the one-preceding sheet has completely been conveyed.

11. A copy machine comprising:

document feed means for storing a plurality of document sheets on which an image has been drawn and continuously feeding the document sheets one by one to a predetermined image-reading position;

image-reading means for reading an image from a document sheet fed to the image-reading position;

recording-sheet storage means for storing a plurality of kinds of recording sheets having different thicknesses onto which an image is transferred;

image transfer means for transferring onto a recording sheet an image read by the image-reading means;

a conveyance path for conveying a recording sheet from the recording-sheet storage means to the image transfer means;

a drive roller for feeding the recording sheets stored in the recording-sheet storage means one by one to the conveyance path at a predetermined timing;

command means for selecting a recording sheet of a specified kind having a relatively large thickness from among the plurality of kinds of recording sheets having different thicknesses stored in the recording-sheet storage means and commanding conveyance to the conveyance path; and control means for delaying timing at which the drive roller is driven, based on the command by the command means.

12. The copying machine according to claim 11, further comprising a sensor located on a side of the conveyance path on which the recording-sheet storage means is provided, the sensor serving for sensing that a recording sheet has passed, wherein the control means comprises:

a timer for counting the lapse of time from a conveyance start of a recording sheet stored in the recording-sheet storage means to the conveyance path until the sensor turns on, based on the command by the command means; and correction means for advancing, by a time shift, the timing at which the drive roller is next driven, when the counted value has a shortage of a time interval from the conveyance start of a recording sheet stored in the recording-sheet storage means to the conveyance path until the sensor turns on, the time interval having been pre-selected so that the turn-on of the sensor is delayed by a specified time period.

13. A copying machine comprising:

document feed means for storing a plurality of document sheets on which an image has been drawn and continuously feeding the document sheets one by one to a predetermined image-reading position, and further for re-storing the document sheets that have completely been read;

image-reading means for reading an image from a document sheet fed to the image-reading position;

first recording-sheet storage means for storing a plurality of recording sheets onto which an image is transferred;

second recording-sheet storage means for storing recording sheets onto one side of which an image has been transferred;

image transfer means for transferring onto a recording sheet an image read by the image-reading means;

a conveyance path for conveying recording sheets from the first and second recording-sheet storage means to the image transfer means;

a first drive roller for feeding the recording sheets stored in the first recording-sheet storage means one by one to the conveyance path;

an second drive roller for feeding the recording sheets stored in the second recording-sheet storage means one by one to the conveyance path;

a third drive roller for feeding a recording sheet conveyed along the conveyance path to the image transfer means; and control means for transferring an image onto both sides of a recording sheet from a document sheet on one side of which an image has been drawn, and for performing, in a process of transfer for a plurality of copies, control steps of:

at a first circulation of document sheets, driving the fifth drive roller so that the recording sheets stored in the first recording-sheet storage means are fed one by one to the conveyance path, driving the third drive roller so that the recording sheet fed to the conveyance path is fed to the image transfer means, transferring an image drawn on either one of odd page or even page of a fed document sheet onto one side of the recording sheet, and storing to the second recording-sheet storage means the recording sheet onto one side of which the image has been transferred;

at second and following circulations of the document sheets, controlling timing at which the first and second drive rollers are driven, alternately, so that the third drive roller can be driven at a constant cycle time with respect to a plurality of recording sheets stored in the first and second recording-sheet storage means and passing along the conveyance path, and when the first and third drive rollers are driven in the same manner as in the first circulation of the document sheets, feeding a recording sheet stored in the first recording-sheet storage means and transferring an image drawn on either one of odd page or even page of a fed document sheet onto one side of the recording sheet and storing to the second recording-sheet storage means the recording sheet onto one side of which the image has been transferred, and when the second and third drive rollers are driven, feeding the recording sheets stored in the second recording-sheet storage means one by one to the conveyance path, feeding to the image transfer means the recording sheet fed to the conveyance path, transferring the image drawn on the other one of odd page or even page of a fed document sheet onto the other side of the recording sheet, and discharging the recording sheet on both sides of which the images have been transferred, through a specified port; and at a final circulation of the document sheets, driving the second drive roller so that the recording sheets stored in the second recording-sheet storage means are fed one by one to the conveyance path, driving the third drive roller so that the recording sheet fed to the conveyance path is fed to the image transfer means, transferring an image drawn on the other one of odd page or even page of a fed document sheet, whichever it is, onto the other side of the recording sheet, and discharging the recording sheet on both sides of which the images have been transferred, through a specified port.

* * * * *